US006613504B2

(12) United States Patent
Oyamada et al.

(10) Patent No.: US 6,613,504 B2
(45) Date of Patent: Sep. 2, 2003

(54) PRODUCING METHOD OF FATTY ACID SILVER SALT AND PHOTOTHERMOGRAPHIC IMAGE-RECORDING MATERIAL

(75) Inventors: Takayoshi Oyamada, Kanagawa (JP); Takashi Ando, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/903,615

(22) Filed: Jul. 13, 2001

(65) Prior Publication Data

US 2002/0090582 A1 Jul. 11, 2002

(30) Foreign Application Priority Data

Jul. 14, 2000 (JP) ..... P.2000-214155

(51) Int. Cl.[7] ..... G03C 1/498; G03C 1/005

(52) U.S. Cl. ..... 430/619; 430/531; 430/567; 430/620

(58) Field of Search ..... 430/617, 620, 430/569, 619, 531

(56) References Cited

U.S. PATENT DOCUMENTS 6,096,486 A * 8/2000 Emmers et al. ..... 430/350
6,114,100 A * 9/2000 Geuens et al. ..... 430/350
6,127,102 A * 10/2000 Geuens et al. ..... 430/350

FOREIGN PATENT DOCUMENTS

EP 1069468 * 1/2001 ..... G03C/1/498

* cited by examiner

*Primary Examiner*—Thorl Chea
(74) *Attorney, Agent, or Firm*—Birch, Stewart, Kolasch & Birch, LLP

(57) ABSTRACT

A producing method of a fatty acid silver salt is described, which comprises adding (1) a solution of silver ions comprising water or a mixed solution of an organic solvent and water containing therein silver ions, and (2) a solution of a fatty acid alkali metal salt which is a solution or a suspension comprising water, an organic solvent, or a mixed solution of water and an organic solvent, containing therein an alkali metal salt of a fatty acid to a closed mixing means to react the solution (1) and the solution (2), wherein from 50 to 99.5 mol % of the entire fatty acid alkali metal salt solution is added to the closed mixing means under such a condition that the concentration of the fatty acid alkali metal salt is higher than the silver ion concentration, and from 0.5 to 30 mol % of the entire fatty acid alkali metal salt solution is added to the closed mixing means or to the downstream of the closed mixing means after the silver ion solution has been added to the closed mixing means. A photothermographic image-recording material comprising the fatty acid silver salt produced by the above-mentioned method is also described.

20 Claims, 5 Drawing Sheets

PRODUCING METHOD OF FATTY ACID SILVER SALT AND PHOTOTHERMOGRAPHIC IMAGE-RECORDING MATERIAL

FIELD OF THE INVENTION

The present invention relates to a producing method of a fatty acid silver salt for use in a photothermographic image-recording material, preferably a photothermographic material. The present invention also relates to a photothermographic image-recording material using the fatty acid silver salt which is used as an excellent photothermographic image-recording material for medical diagnosis, whose image-forming layer at the cut end hardly peels off when cut to an H cut (35 cm×43 cm), B4 size or the like.

BACKGROUND OF THE INVENTION

A variety of photographic materials comprising a support having provided thereon a photosensitive layer and forming an image by image exposure are known.

Reduction of waste solution has been strongly desired in recent years in the field of photomechanical process and in the medical field from the viewpoint of environmental protection and space saving. Accordingly, a technique concerning a photothermographic image-recording material for photomechanical process and medical use which can be exposed efficiently with laser beams, from which a clear black image having high resolving power and sharpness can be formed has been required. Such a photothermographic image-recording material can offer to customers a simpler and environmentally benign heat development processing system in which the use of solvent system processing chemicals can be done away with.

An image-forming method by heat development is described, e.g., in U.S. Pat. Nos. 3,152,904 and 3,457,075, D. Klostervoer, *Thermally Processed Silver Systems,* "Imaging Processes and Materials", compiled by Sturge, V. Walworth and A. Shepp, Noblette 8th Ed., Chap. 9, p. 279 (1989). The photothermographic image-recording material contains in general a reducible photo-insensitive silver source (e.g., an organic silver salt), a catalytically active amount of photocatalyst (e.g., a silver halide), and a reducing agent of silver dispersed in an organic binder matrix. A photothermographic image-recording material is stable at normal temperature but forms a silver by heating at high temperature (e.g., 80° C. or more) after image exposure through an oxidation reduction reaction between the reducible silver source (which functions as an oxidizing agent) and the reducing agent. The oxidation reduction reaction is accelerated by the catalytic action of the latent image generated by exposure. The silver formed by the reaction of the reducible silver source in the exposed domain offers a black image contrasting with the non-exposed domain to thereby form an image.

The silver sources which are used in these systems are in general a fatty acid silver salt, and various producing methods are known. For example, a method of producing an organic silver salt in the coexistence of water and a hardly water-soluble solvent as disclosed in JP-A-49-93310 (the term "JP-A" as used herein means an "unexamined published Japanese patent application"), JP-A-49-94619, and JP-A-53-68702, a method of producing an organic silver salt in an aqueous solution as disclosed in JP-A-53-31611, JP-A-54-4117, and JP-A-54-46709, and a method of producing an organic silver salt in an organic solvent as disclosed in JP-A-57-186745, JP-A-47-9432 and U.S. Pat. No. 3,700,458. A fatty acid silver salt is fundamentally produced by heating a fatty acid in water to higher than the melting point, adding a sodium hydroxide or an alkali metal salt to the molten fatty acid with vigorously stirring, and then adding a silver nitrate to convert an alkali soap to a silver soap.

Such an alkali soap forms micelle in an aqueous solution and an alkali soap is a white turbid solution in appearance. The reaction from micelle to silver soap often causes a problem of production stability. Therefore, a method of using a mixture of water and alcohol as a solvent is disclosed in JP-A-55-40607 for making an alkali soap a uniform solution.

Further, a method of making an alkali soap a uniform solution by using a mixed solvent of water and alcohol and adding the alkali soap with a silver solution for improving photographic properties is disclosed in JP-A-11-349325.

It has become possible to produce a fatty acid silver salt by a uniform reaction by using the simultaneous addition method disclosed in JP-A-11-349325. However, when a fatty acid alkali metal salt solution and a silver ion solution are added to a reaction tank as disclosed in the example of the above publication, foams are generated during the reaction and the viscosity of the solution increases at the final stage of the reaction, therefore, there is an anxiety in scale up.

Therefore, a method of adding a fatty acid alkali metal salt solution and a silver ion solution into a closed mixing means is discussed. However, the hydrophilic property of the surface of the particle decreases by adding the solutions into a closed mixing means, which leads to another problem of the deterioration of the film-forming property.

The deterioration of the film-forming property of photothermographic image-recording materials has come to a great problem to each manufacturer. If the film-forming property is bad, the inside of the layer containing a fatty acid silver is destroyed by the shock of the work blade when the photothermographic image-recording material is cut to a prescribed size and peeling is caused. As a result, the peeled part falls off during the succeeding transportation and the like and results in the trouble of a blank area. For example, the end face of a commercially available photothermographic image-recording material, Dry View Laser Imaging Film manufactured by Eastman Kodak Co. also suffers film peeling. For producing a photothermographic image-recording material, it is necessary to form a layer by dispersing a fatty acid silver salt in a binder, and the problem is attributed to the fact that the film of a fatty acid silver salt is difficult to form as compared with the film of ordinary silver halide. This is presumably due to the fact that the volume occupied by a fatty acid silver salt per mol is large hence the volume of the binder occupied by a fatty acid silver salt is also large. A method to cope with this problem by increasing the ratio of a binder is known at present, however, this method also influences photographic properties and attended by many disadvantages. Therefore, it has been required to improve film-forming property of a fatty acid silver salt without affecting photographic properties.

SUMMARY OF THE INVENTION

In view of the above problems of the conventional techniques, an object of the present invention is to provide a producing method of a fatty acid silver salt which can prevent the occurrence of the trouble of a blank area attributable to film-forming hindrance and can lessen fog when used in a photothermographic image-recording material (in particular, a photothermographic material). Another object of the present invention is to provide a photothermographic image-recording material, in particular a photothermographic material which can control the trouble of a blank area attributable to film-forming hindrance and lessens fog.

As a result of eager investigation, the present inventors have found that a fatty acid silver salt showing the expected effect can be obtained by mixing a silver ion solution and a fatty acid alkali metal salt solution according to the prescribed conditions. Thus, the present invention has been achieved.

That is, the present invention provide a producing method of a fatty acid silver salt which comprises adding (1) a solution of silver ions comprising water, or a mixed solution of an organic solvent and water, containing therein silver ions, and (2) a solution of a fatty acid alkali metal salt which is a solution or a suspension comprising water, an organic solvent, or a mixed solution of water and an organic solvent, containing therein an alkali metal salt of a fatty acid to a closed mixing means to react the solution (1) and the solution (2), wherein from 50 to 99.5 mol % of the entire fatty acid alkali metal salt solution is added to the closed mixing means under such a condition that the concentration of the fatty acid alkali metal salt is higher than the silver ion concentration, and from 0.5 to 30 mol % of the entire fatty acid alkali metal salt solution is added to the closed mixing means or to the downstream of the closed mixing means after the silver ion solution has been added to the closed mixing means. In the producing method of a fatty acid silver salt according to the present invention, it is preferred that from 0.5 to 30 mol % of the entire fatty acid alkali metal salt solution is added to a formation tank equipped downstream from the closed mixing means after the silver ion solution has been added to the closed mixing means.

Further, the present invention provide a photothermographic image-recording material comprising a support having provided thereon a reducing agent, a binder and a photo-insensitive organic silver salt, wherein the fatty acid silver salt produced by the above-described producing method is used as the photo-insensitive organic silver salt. It is preferred that the photothermographic image-recording material according to the present invention further contain a photosensitive silver halide on a support, and further, the ratio of the aqueous latex solid content weight to the fatty acid silver weight in the layer containing the fatty acid silver salt be from 1.0 to 2.5.

In the present invention, "from x to y" means the range including the numerical values x and y as the minimum value and maximum value respectively.

KEY TO THE SYMBOLS

Figure 1:
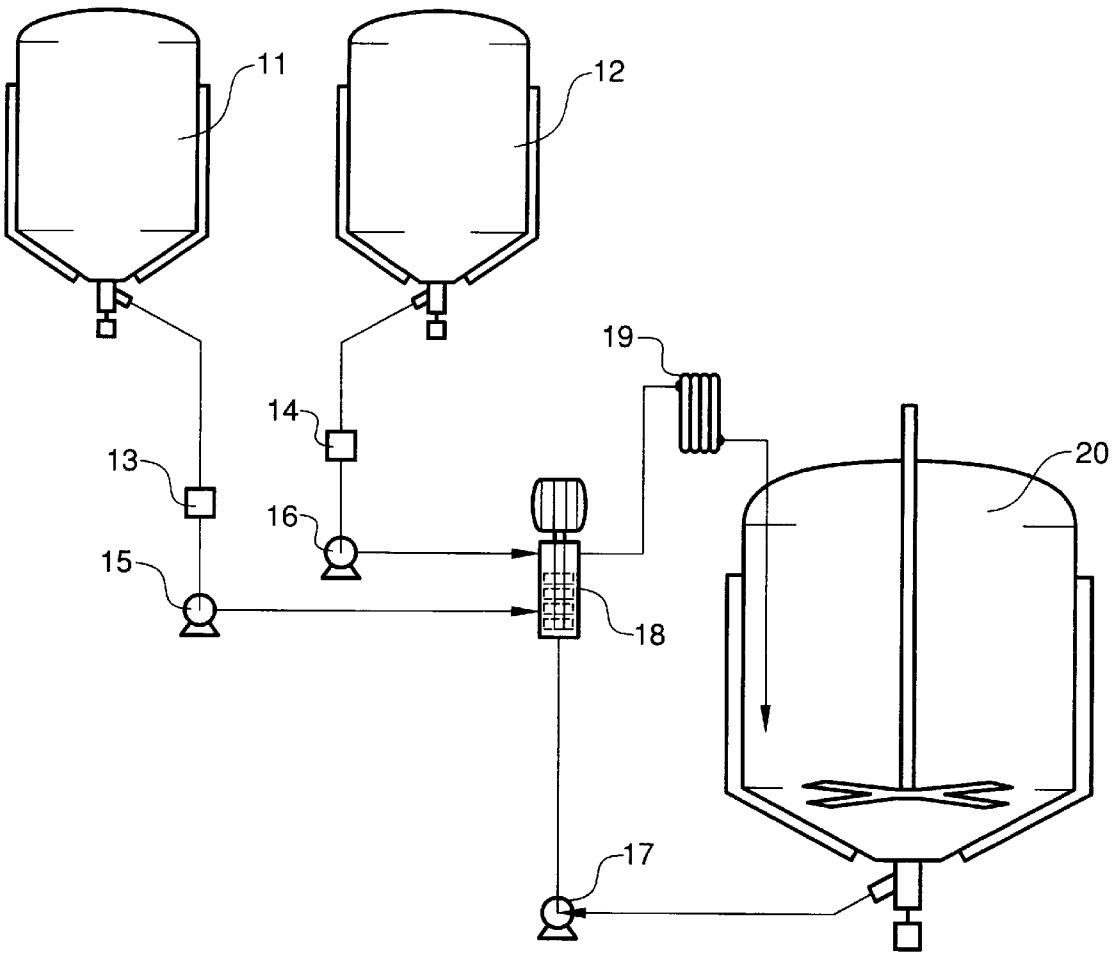
FIG. 1 is an explanatory view showing one embodiment of a producing apparatus of a fatty acid silver salt for use in the present invention.

11, 12, 22, 31, 32, 41: Storage tank
13, 14, 23, 33, 34, 42: Flowmeter
15, 16, 17, 24, 35, 36, 37: Pump
18, 38: Mixing unit
19, 39: Heat exchanger
20, 40: Formation tank
21: Three way valve

DETAILED DESCRIPTION OF THE INVENTION

The producing method of a fatty acid silver salt and the photothermographic image-recording material according to the present invention are described in detail below.

The producing method of a fatty acid silver salt according to the present invention includes the stage of adding a silver ion solution and a fatty acid alkali metal salt into a closed mixing means and reacting therein. In the present invention, "a silver ion solution" is a solution comprising water or a mixed solution of an organic solvent and water containing a silver ion, and "a fatty acid alkali metal salt solution" is a solution or a suspension comprising water, or an organic solvent, or a mixed solution of water and an organic solvent, containing therein an alkali metal salt of a fatty acid. The producing method of a fatty acid silver salt according to the present invention is characterized in that from 50 to 99.5 mol % of the entire fatty acid alkali metal salt solution is added to the closed mixing means under such a condition that the concentration of the fatty acid alkali metal salt is higher than the silver ion concentration, and from 0.5 to 30 mol % of the entire fatty acid alkali metal salt solution is added to the closed mixing means or to the downstream of the closed mixing means after the silver ion solution has been added to the closed mixing means. By adding a silver ion solution and a fatty acid alkali metal salt solution so as to satisfy these conditions, it becomes possible to produce a fatty acid silver salt having high hydrophilicity on its surface, and by using the fatty acid silver salt, a photothermographic image-recording material excellent in film-forming property and restrained in the trouble of a blank area can be obtained.

A fatty acid alkali metal salt solution for use in the producing method of the present invention can be obtained by alkali-processing a fatty acid. As the kinds of the salts, an Na salt, a K salt, an Li salt, etc., can be used.

A fatty acid for use in the present invention is comparatively stable against light in the form of a silver salt but becomes a silver salt for forming a silver image when heated at 80° C. or higher in the presence of an exposed photocatalyst (e.g., the latent image of a photosensitive silver halide) and a reducing agent. The fatty acid is a long chain aliphatic carboxylic acid preferably having from 10 to 30, more preferably from 12 to 26, carbon atoms. As the preferred examples of the aliphatic carboxylic acids, a cerotic acid, a lignoceric acid, a behenic acid, an erucic acid, an arachidic acid, a stearic acid, an oleic acid, a lauric acid, a caproic acid, a myristic acid, a palmitic acid, a maleic acid, a fumaric acid, a tartaric acid, a linoleic acid, a butyric acid, a camphoric acid, and mixtures of these acids can be exemplified.

As the alkali metals of the alkali metal salts of the fatty acids for use in the present invention, Na, K and Li can be specifically exemplified, and Na and K are preferably used. A fatty acid alkali metal salt for use in the present invention can be prepared by adding NaOH or KOH to a fatty acid. It is preferred at that time to make the amount of the alkali equivalent or less of the amount of the fatty acid to leave an unreacted fatty acid. The amount of the unreacted residual fatty acid in this case is from 3 to 50 mol %, preferably from 3 to 30 mol %, based on the entire fatty acid. Alternatively, alkali of the amount larger than the expected amount may be added and the excess amount of alkali may be neutralized by adding an acid such as a nitric acid or a sulfuric acid afterward.

The concentration of the fatty acid alkali metal salt solution for use in the present invention is from 5 to 50 wt %, preferably from 7 to 45 wt %, and more preferably from 10 to 40 wt %, by weight ratio.

It is sufficient for the silver ion solution for use in the present invention to contain a water-soluble silver salt, and silver nitrate is preferably used. The concentration of the silver ion of the silver ion solution for use in the present invention can be determined arbitrarily but is preferably from 0.03 to 6.5 mol/liter, more preferably from 0.1 to 5 mol/liter, in molar concentration. The pH of the silver ion solution for use in the present invention is preferably from 1 to 6, more preferably from 1.5 to 4. An acid or an alkali can be added for pH adjustment. The kinds of acids and alkalis are not particularly restricted.

For forming fatty acid silver salt particles by the producing method according to the present invention, an organic solvent of the amount by which a fatty acid alkali metal salt is capable of becoming substantially a transparent solution without forming a string-like associated product or a micelle should be contained in at least one of a silver ion solution, a fatty acid alkali metal salt solution and a solution prepared in advance in a reaction field. The fatty acid alkali metal salt solution and the solution prepared in advance in a reaction field may be an organic solvent alone but they are preferably mixed solutions of an organic solvent and water.

The organic solvents for use in the present invention are not particularly restricted so long as they are water-soluble and have the above property, but those which are hindrance to photographic properties are not preferred. The preferred organic solvents are those capable of being mixed with water, e.g., alcohol and acetone, and more preferred are tertiary alcohols having from 4 to 6 carbon atoms.

The amount of the organic solvent in the fatty acid alkali metal salt solution for use in the present invention is preferably from 3 to 70% by volume, more preferably from 5 to 50% by volume, of the amount of the water content. At this time, since the optimal volume of the solvent varies according to the reaction temperature, the optimal amount can be determined by try and error.

There can be added to the silver ion solution and the fatty acid alkali metal salt solution for use in the present invention, or the solution in the closed mixing vessel to which the above solutions are added, for example, a compound represented by formula (1) as disclosed in JP-A-62-65035, an N heterocyclic compound having a water-soluble group as disclosed in JP-A-62-150240, an inorganic peroxide as disclosed in JP-A-50-101019, a sulfur compound as disclosed in JP-A-51-78319, a disulfide compound as disclosed in JP-A-57-643, or a hydrogen peroxide.

The silver ion solution and the fatty acid alkali metal salt solution to be added may be prepared in a storage tank and then set at a prescribed temperature, or the solutions prepared separately may be added to a storage tank and then set at a prescribed temperature.

Figure 2:
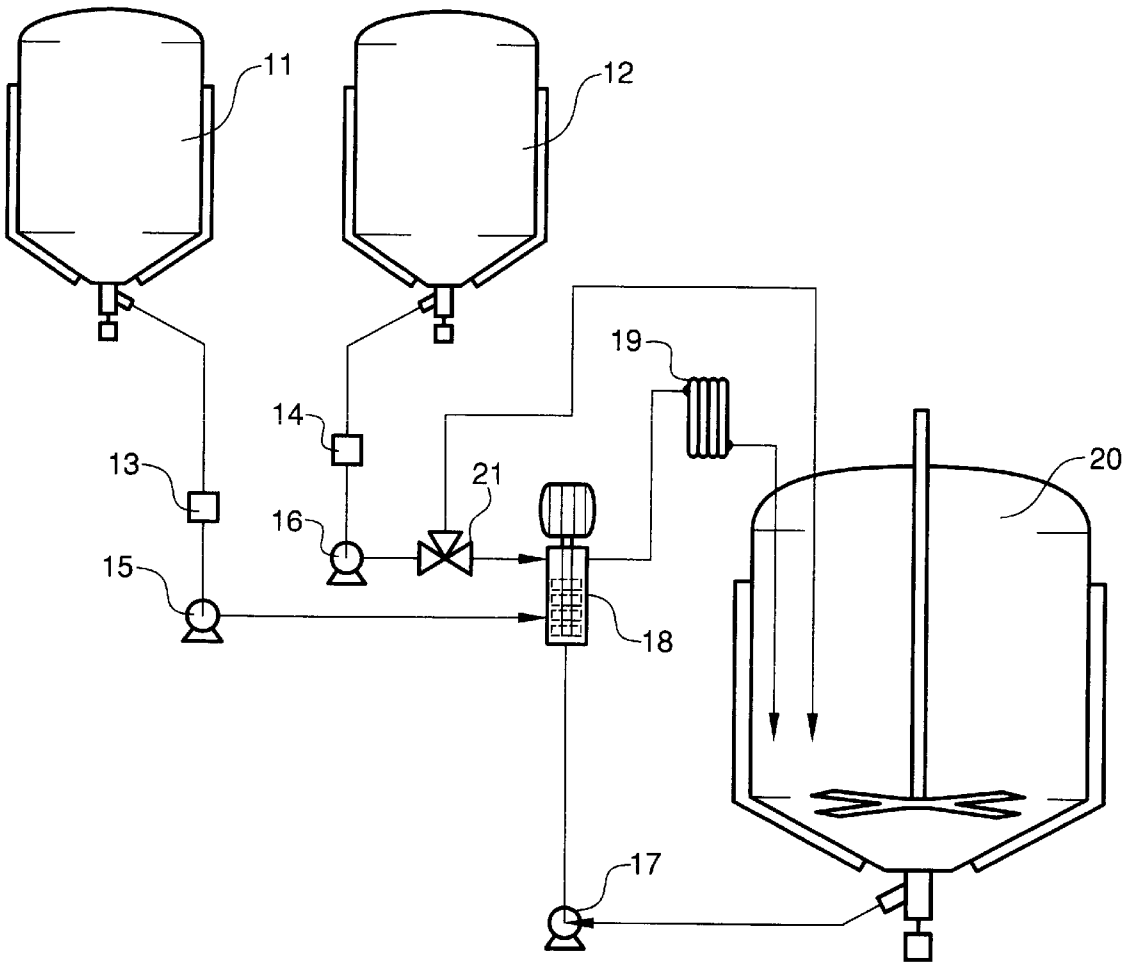
FIG. 2 is an explanatory view showing another embodiment of a producing method of a fatty acid silver salt for use in the present invention.
Figure 3:
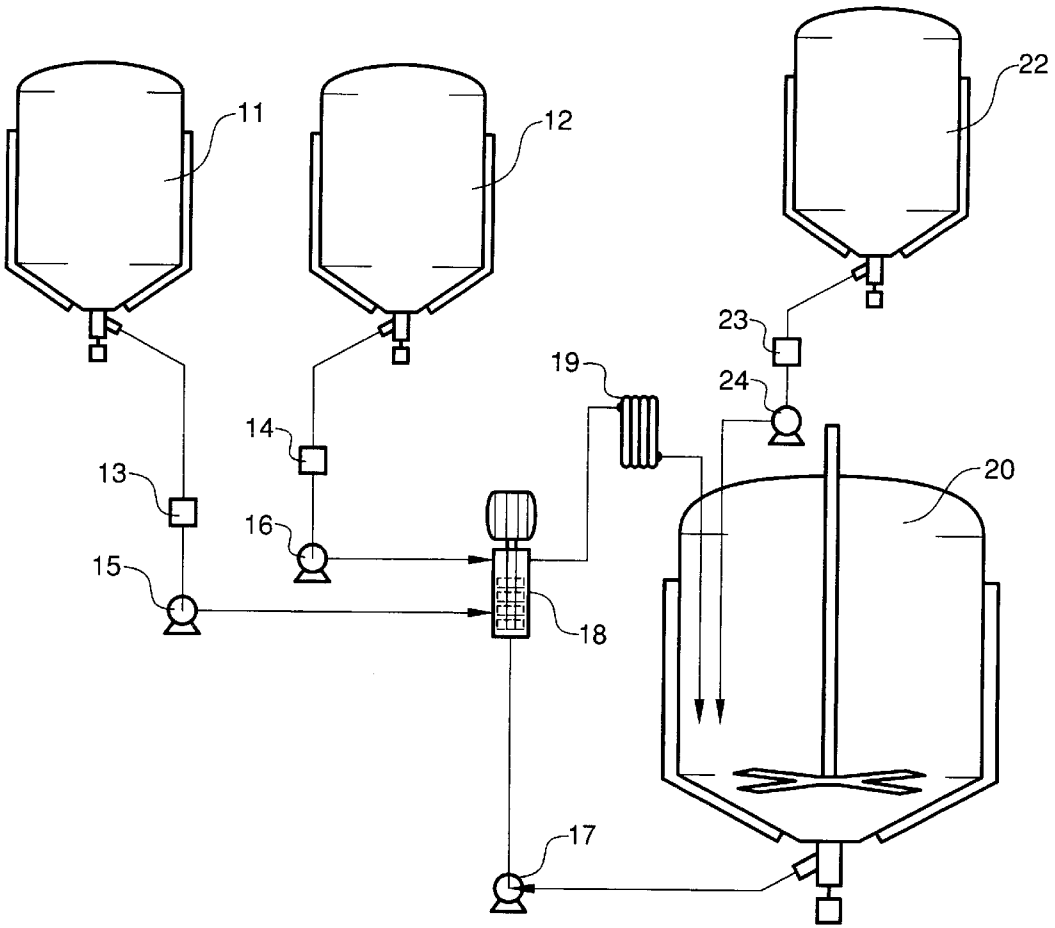
FIG. 3 is an explanatory view showing another embodiment of additionally arranging storage tank of a fatty acid alkali metal salt solution for introducing into formation tank.

The procedure of the producing method of the present invention will be described with referring to the drawings of the representative apparatus for performing the producing method of the present invention (FIG. 1 to FIG. 3).

For example, when the production is performed with the apparatus shown in FIG. 1, a silver ion solution and a fatty acid alkali metal salt solution for use in the present invention are stored in storage tank 11 and storage tank 12 respectively at a prescribed temperature. The silver ion solution and the fatty acid alkali metal salt solution are introduced into closed mixing unit 18 via pump 15 and pump 16 respectively. Flowmeters 13 and 14 are equipped along the introduction line for measuring the flow rates at this time, and the motive powers of the pumps are arbitrarily controlled with checking the flow rates by these flowmeters. A dispersed product of a fatty acid silver salt prepared as the third component is introduced into closed mixing means 18 via pump 17. The reaction mixture mixed in closed mixing means 18 is introduced into heat exchanger 19, cooled rapidly and then introduced into formation tank 20.

When the production is performed with the apparatus shown in FIG. 2, the same as the apparatus shown in FIG. 1, a silver ion solution and a fatty acid alkali metal salt solution are stored in storage tank 11 and storage tank 12 respectively at a prescribed temperature. The silver ion solution and the fatty acid alkali metal salt solution are introduced into closed mixing unit 18 via pump 15 and pump 16 respectively. However, the introduction line of the fatty acid alkali metal salt solution is equipped with three way valve 21, by which the introduction of the fatty acid alkali metal salt solution can be switched from closed mixing unit 18 to formation tank 20. When three way valve 21 is switched to formation tank 20, flowmeter 14 shows the flow rate to formation tank 20. A dispersed product of a fatty acid silver salt prepared as the third component is introduced into closed mixing means 18 via pump 17, the same as the apparatus shown in FIG. 1. The reaction mixture mixed in closed mixing means 18 is introduced into heat exchanger 19 and cooled rapidly and then introduced into formation tank 20.

The apparatus shown in FIG. 3 is an apparatus further equipped with independent storage tank 22, the introduction line connecting storage tank 22 with formation tank 20, and flowmeter 23 and pump 24 along the introduction line in addition to the apparatus shown in FIG. 1. When the production is performed with the apparatus shown in FIG. 3, a fatty acid alkali metal salt solution is stored in storage tank 22 at a prescribed temperature, and introduced into formation tank 20 via pump 24 at prescribed timing, and the other procedures are the same as those in FIG. 1.

Figure 4:
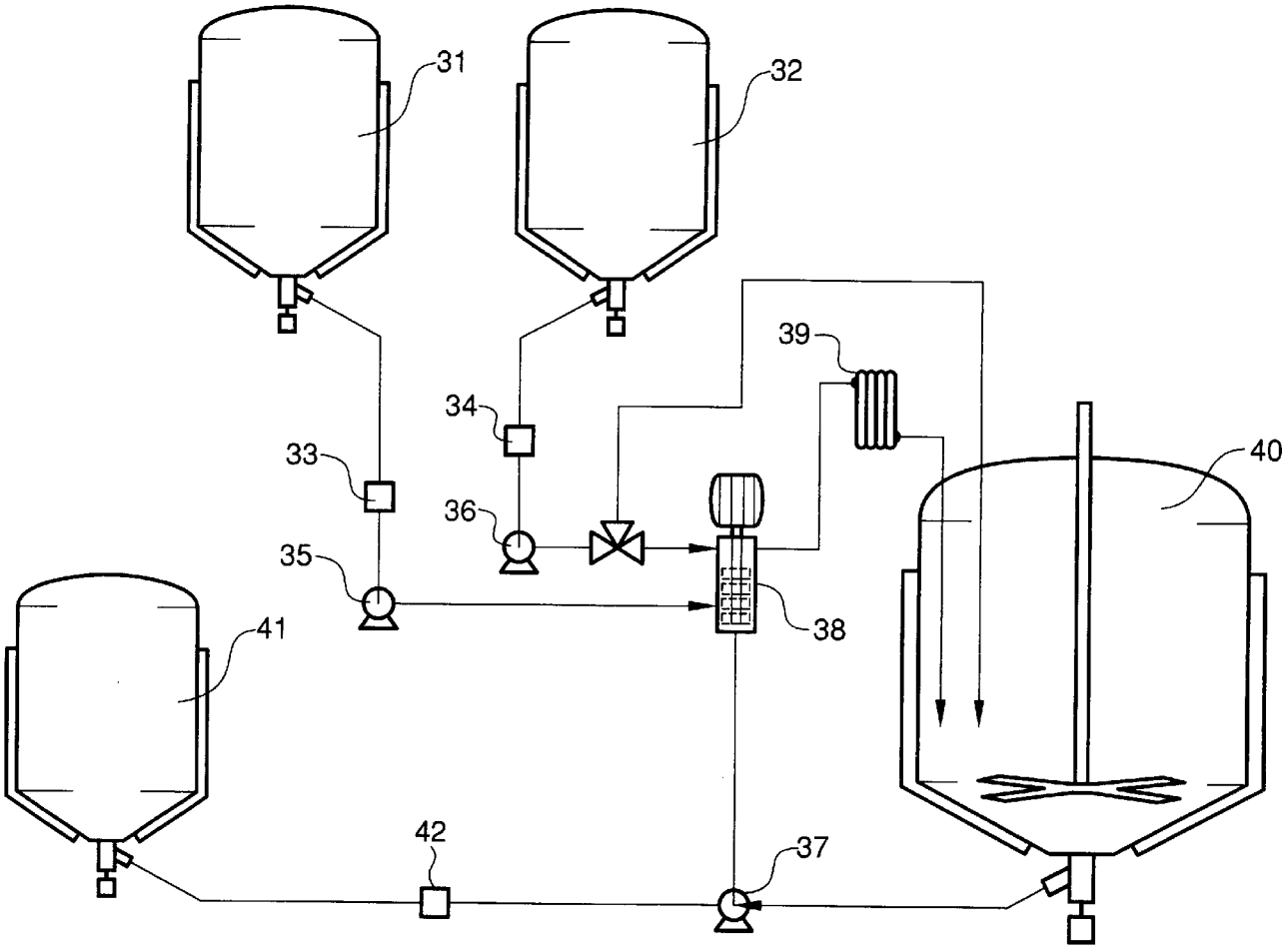
FIG. 4 is an explanatory view showing another embodiment of additionally arranging storage tank of a solvent for introducing into closed mixing unit.

The apparatus shown in FIG. 4 is an apparatus further equipped with independent storage tank 41, the introduction line connecting storage tank 41 with closed mixing unit 38, and flowmeter 42 and pump 37 along the introduction line in addition to the apparatus shown in FIG. 2. When the production is performed with the apparatus shown in FIG. 4, water, or a mixture of water and an organic solvent (a dispersant may be further contained) is stored in storage tank 41, and introduced into closed mixing unit 38 through the introduction line. Other procedures are the same as those in FIG. 2.

In the producing method of a fatty acid silver salt according to the present invention, from 50 to 99.5 mol % of the entire fatty acid alkali metal salt solution is added to the closed mixing means under such a condition that the concentration of the fatty acid alkali metal salt is higher than the concentration of the silver ion. The addition amount is preferably from 70 to 95 mol %, more preferably from 80 to 90 mol %.

The condition where the concentration of a fatty acid alkali metal salt is higher than the concentration of a silver ion can be turned out by arbitrarily controlling the concentration of each solution to be added to a closed mixing means, the timing of addition or the like. For example, when a silver ion solution is added at a constant rate prior to a fatty acid alkali metal salt solution, by adding a fatty acid alkali metal salt solution higher in concentration than a silver ion, the concentration of the fatty acid alkali metal salt can be made higher than that of the silver ion from the middle. Contrary to this, when a fatty acid alkali metal salt solution is added prior to a silver ion solution, if the fatty acid alkali metal salt solution is the same as or higher than the silver ion solution in molar concentration, the higher concentration of the fatty acid alkali metal salt solution can be maintained even if the silver ion solution is added. In the present invention, the former method of adding a silver ion solution prior to a fatty acid alkali metal salt solution is preferred.

In the producing method of a fatty acid silver salt according to the present invention, from 0.5 to 30 mol % of the entire fatty acid alkali metal salt solution is added to the closed mixing means or to the downstream of the closed mixing means after a silver ion solution has been added to the closed mixing means. The addition amount is preferably from 3 to 20 mol %, more preferably from 10 to 15 mol %.

When the apparatus shown in FIG. 1 is used, all the fatty acid alkali metal salt solution is to be introduced into the closed mixing means, and when the apparatus shown in FIG. 2 or 3 is used, a part of the fatty acid alkali metal salt solution can be introduced directly into the formation tank. It is preferred that from 0.5 to 30 mol % of the entire fatty acid alkali metal salt solution is added to the formation tank. However, in the present invention, it is sufficient that from 0.5 to 30 mol % of the entire fatty acid alkali metal salt solution is added to the closed mixing means or the downstream of the closed mixing means, accordingly, the fatty acid alkali metal salt solution may be added between the closed mixing means and the formation tank. For example, a mixing means is installed between the closed mixing means and the formation tank and the fatty acid alkali metal salt solution may be added to the mixing means. The fatty acid alkali metal salt solution may be introduced directly into the introduction line without providing such a mixing means.

By adding from 0.5 to 30 mol % of the entire fatty acid alkali metal salt solution according to the producing method of the present invention, the hydrophilicity of the surfaces of the fatty acid silver salt particles to be produced can be increased. As a result, when the fatty acid silver salt is used in a photothermographic image-recording material, the film-forming property is improved and the film peeling resistance can be improved. In particular, when a fatty acid silver salt is produced by adding a fatty acid alkali metal salt solution to the formation tank, Dmin of a photothermographic image-recording material obtained by using this fatty acid silver salt can be effectively reduced, hence this method is preferred.

In the producing method of the present invention, a silver ion solution and a fatty acid alkali metal salt solution may be added continuously or intermittently, and the flow rate and the concentration during addition may be constant or variable. When the addition flow rate is varied, they can be added by acceleration or deceleration mode by arbitrary time function.

For instance, a fatty acid alkali metal salt solution can be divided into two to six parts, preferably from two to four parts, and added separately. Since the conditions of the addition, such as the addition which affects photographic properties, the addition which varies the hydrophilicity of the surface, etc., can be controlled arbitrarily by the divided addition, the function to be desired to give to the particles can be controlled by each addition.

Further, since a fatty acid alkali metal salt solution solidifies if not under a high temperature, it is necessary to provide a plurality of addition lines or to contrive a circulating system, etc.

As the flowmeter for a silver ion solution for use in the apparatus for executing the producing method of the present invention, an electromagnetic flowmeter or a weight flowmeter showing measurement error of less than 1% and at the same time a time coefficient of less than 1 second can be used. As the flowmeter for an organic acid metal salt solution, a weight flowmeter showing measurment error of less than 1% and at the same time a time coefficient of less than 1 second can be used.

As the pump for use in the present invention, a pump capable of feedback control from the measured value of the above flowmeter (e.g., a rotary pump, a sanitary pump, a gear pump, a mohno pump, a plunger pump, a diaphragm pump), or a pump capable of providing stable discharge by determined error of less than 1% (e.g., a gear pump, a mohno pump, a plunger pump, a diaphragm pump) can be exemplified. A pump having a ripple factor of less than 5% is preferred.

"A closed mixing means" for use in the producing method of the present invention is a means of stirring and mixing a liquid in such a state that the inside of a container is filled with the liquid to be mixed and there is substantially no air, i.e., the interface of air/liquid is absent. A closed mixing unit can adopt every mixing system, such as a bulk stirrer, e.g., anchor blades and paddle blades, an emulsifying and dispersing unit, e.g., a dissolver and a homogenizer, and a stationary mixer, e.g., a static mixer, and combined types of these.

When liquids are mixed, if stirring force is too weak, the liquids are not mixed sufficiently, while if stirring force is too strong, heat generation and cavitation occur. Accordingly, stirring must be performed within a preferred range. In a mixing unit having rotary blades, the outermost circumferential linear velocity of the rotary blade is preferably from 1 to 50 m/sec., more preferably from 1 to 30 m/sec., and consumed stirring power per liquid unit volume is preferably from 0.1 to 10 KW/liter, more preferably from 0.5 to 5 KW/liter. Further, as a means for inhibiting cavitation from occurring, a method of reducing the dissolved air in a liquid or increasing the pressure in a mixing unit higher than the atmospheric pressure by 0.1 to 2 $kgf/cm^2$ or so can be adopted.

The materials of a closed mixing unit are not particularly restricted so long as they have appropriate mechanical strength but materials inert to a silver ion solution, a fatty acid alkali metal salt solution and an organic solvent to be used are preferred. It is also necessary to select materials stable against heat since the temperature of a fatty acid alkali metal salt solution is generally as high as 50° C. or higher. As those which satisfy these conditions, stainless steel materials (SUS304, SUS316, etc.), titanium or titanium alloys, metals coated with glass lining, ceramics or fluorine-containing resins, composite resins, e.g., glass fiber and Kevlar, engineering plastics, e.g., polyacetal and modified polyphenylene oxide can be exemplified.

In the producing method of the present invention, it is preferred to further add water or a mixture of water and an organic solvent to a closed mixing means. It is particularly preferred for the water or the mixture to be added to contain a dispersant. It is also preferred that at least a part of the mixture obtained after reaction is circulated to the above closed mixing means.

Further, it is also preferred to cool the mixture obtained after reaction. For rapidly lowering the liquid temperature after reaction of the silver ion solution and the fatty acid alkali metal salt solution, a method of cooling the mixing unit itself, or providing a heat exchanger between the mixing unit and the tank can be adopted besides the method of cooling in advance the silver ion solution, water, or the mixture of water and an organic solvent to be fed to the mixing unit, and the solution of fatty acid silver salt particles obtained by reaction. The temperature of the solution after reaction of the silver ion solution and the fatty acid alkali metal salt solution is preferably from 5 to 70° C., more preferably from 10 to 50° C., and particularly preferably from 20 to 45° C.

The fatty acid silver salt particles prepared are preferably introduced into a formation tank after being cooled. For homogenizing the reaction solution, a formation tank is preferably equipped with a stirring/mixing means. As the stirring/mixing means, every mixing system, such as a bulk stirrer, e.g., anchor blades and paddle blades, an emulsifying and dispersing unit, e.g., a dissolver and a homogenizer, and a stationary mixer, e.g., a static mixer, and combined types of these can be used.

In the producing method of the present invention, ripening may be performed in the formation tank by increasing the temperature in the formation tank after the completion of addition of a silver ion solution and/or a fatty acid alkali metal salt solution. Ripening is preferably performed at a temperature higher than the addition temperature of the solutions by 0 to 20° C., more preferably by 0 to 10° C. It is preferred to determine the time of ripening by try and error. The hydrophilicity of the surfaces of the particles can be increased by performing ripening, as a result the film-forming property can be further improved.

The fatty acid silver salt produced by the producing method according to the present invention is not particularly restricted but a scaly fatty acid silver salt is preferred. The scaly fatty acid silver salt is defined as follows in the present invention: A fatty acid silver salt is observed with an electron microscope, the shape of the fatty acid silver salt particle is approximated to a rectangular parallelepiped, and when the sides of the rectangular parallelepiped are taken as a, b and c from the shortest (c may be equal to b), x is calculated from the shorter numerical values a and b as follows:

$$x=b/a$$

x is obtained about 200 particles by the above equation, and when the average value is taken as x (average), those satisfy the relationship x (average)$\geqq$1.5 are regarded as scaly particles, preferably 30$\geqq$x (average)$\geqq$1.5, more preferably 20$\geqq$x (average)$\geqq$2.0. In this connection, acicular is 1$\leqq$x (average)<1.5.

In a scaly particle, a can be regarded as a thickness of a tubular particle having a plane making b and c the sides as a main plane. The average of a is preferably from 0.01 to 0.23 $\mu$m, and more preferably from 0.1 to 0.20 $\mu$m. The average of c/b is preferably from 1 to 6, more preferably from 1.05 to 4, still more preferably from 1.1 to 3, and particularly preferably from 1.1 to 2.

The particle size distribution of a fatty acid silver salt is preferably monodispersion. Monodispersion means that the values in terms of percentage obtained by dividing the standard deviations of the respective lengths of short axis and long axis by the respective lengths of short axis and long axis are preferably 100% or less, more preferably 80% or less, and still more preferably 50% or less. The shape of a fatty acid silver salt can be obtained from the transmission electron microscopic image of a fatty acid silver salt dispersion product. As another method of measuring monodispersing property, a method of obtaining the standard deviation of the volume weighted average diameter of a fatty acid silver salt can be used. The value obtained in terms of percentage (variation coefficient) by dividing the standard deviation of the volume weighted average diameter by the volume weighted average diameter is preferably 100% or less, more preferably 80% or less, and most preferably 50% or less. The standard deviation of volume weighted average diameter can be obtained from the particle size (volume weighted average diameter) obtained by irradiating the fatty acid silver salt dispersed in a solution with laser beams, and finding the autocorrelation function to the time variation of fluctuation of light scattering.

When the scaly fatty acid silver salt preferably used in the present invention is produced by reacting a silver ion solution and a tertiary alcohol aqueous solution containing a fatty acid alkali metal salt in a closed mixing means, it is preferred to differentiate the temperature of the solution introduced into the closed mixing means (preferably a silver ion solution added in advance, or when a silver ion solution and a tertiary alcohol aqueous solution containing a fatty acid alkali metal salt are added simultaneously from the first, the solution is water or a mixture of water and a tertiary alcohol as described later, and when a silver ion solution is added in advance, water or a mixture of water and a tertiary alcohol may also be added in advance) and the tertiary alcohol aqueous solution containing a fatty acid alkali metal salt added thereto by 20 to 85° C.

The crystal shape of the fatty acid silver salt is preferably controlled by maintaining such differentiation of temperature during the addition of the tertiary alcohol aqueous solution containing a fatty acid alkali metal salt.

A tertiary alcohol having from 4 to 6 carbon atoms may be contained in the organic solvent of the present invention, and in such a case the content of the tertiary alcohol is 70% by volume or less, preferably 50% by volume or less, based on the total volume of the silver ion solution. The temperature of the aqueous solution is preferably from 0° C. to 50° C., more preferably from 5° C. to 30° C. When the silver ion solution is added simultaneously with the tertiary alcohol aqueous solution containing a fatty acid alkali metal salt, the temperature is most preferably from 5° C. to 15° C. as is described later.

The temperature of the tertiary alcohol aqueous solution containing a fatty acid alkali metal salt added to a closed mixing means or a reaction vessel is preferably from 50 to 90° C., more preferably from 60 to 85° C., and most preferably from 65 to 85° C., for the purpose of maintaining a temperature necessary for preventing phenomena such as crystallization and solidification of the fatty acid alkali metal salt. The reaction temperature is preferably controlled at a certain constant temperature within the above range throughout the reaction.

The temperature in a closed mixing means or a reaction vessel is preferably from 5 to 75° C., more preferably from 5 to 60° C., and most preferably from 10 to 50° C. Although it is preferred to control the reaction temperature at a certain constant temperature selected from the above range throughout the reaction, it is also preferred to control the temperature in some temperature patterns within the above range.

The temperature difference between the tertiary alcohol aqueous solution containing a fatty acid alkali metal salt and the solution in a closed mixing means or a reaction vessel is preferably from 20 to 85° C., more preferably from 30 to 80° C. In this case, it is preferred that the temperature of the tertiary alcohol aqueous solution containing a fatty acid alkali metal salt is higher than that of the solution in the closed mixing means or the reaction vessel.

Thus, the rate of crystallite-like precipitation of the aqueous tertiary alcohol solution containing a fatty acid alkali metal salt of high temperature as a result of sudden quenching in the closed mixing means and the rate of coming into a fatty acid silver salt by the reaction with the water-soluble silver salt are preferably controlled. As a result, the crystal shape and the crystal size of the organic acid silver salt and the crystal size distribution can be preferably controlled. At the same time, the characteristics of the photothermographic image-recording material, in particular, the photothermographic material, can be further improved.

A solvent may be put in a reaction vessel in advance, e.g., water is preferably used as a solvent previously added and a mixed solvent of a tertiary alcohol with water is also preferably used.

An auxiliary dispersant which is soluble in an aqueous medium can be added to the tertiary alcohol aqueous solution containing a fatty acid alkali metal salt, the silver ion solution or the reaction solution. Any compound can be used as the auxiliary dispersant so long as it can disperse the fatty acid silver salt formed. Specific examples thereof correspond to the auxiliary dispersants of fatty acid silver salts described later.

In the producing method of the fatty acid silver salt according to the present invention, it is preferred to perform desalting/dehydrating process after silver salt formation. Methods of desalting/dehydrating are not particularly restricted and well-known means so far been used can be utilized. For example, well-known filtration methods such as centrifugal filtration, suction filtration, ultrafiltration, and washing of floc formed by agglomeration can be preferably used. The removal of a supernatant by centrifugal separation precipitation is also preferably used. Desalting/dehydrating may be performed only one time or may be repeated a plurality of times. Addition and removal of water may be performed continuously or separately. Desalting/dehydrating is performed until the conductivity of the dehydrated water finally reaches preferably 300 $\mu$S/cm or less, more preferably 100 $\mu$S/cm or less, and most preferably 60 $\mu$S/cm or less. The lower limit of the conductivity in this case is not particularly limited but is generally about 5 $\mu$S/cm.

Further, for improving the coating surface condition of a photothermographic material, in particular, a photothermographic material, it is preferred to prepare a fine particle dispersion by adding a dispersant to the desalted and dehydrated fatty acid silver salt.

A fatty acid silver salt can be mechanically finely dispersed in the presence of an auxiliary dispersant using well-known dispersing means (e.g., a high speed mixer, a homogenizer, a high speed impinging mill, a banbury mixer, a homomixer, a kneader, a ball mill, a vibrating ball mill, a planetary ball mill, an attritor, a sand mill, a beads mill, a colloid mill, a jet mill, a roller mill, a trommel and a high speed stone mill).

For obtaining a solid dispersion of a fatty acid silver salt having a high S/N ratio, a small particle size, no agglomeration and of homogeneous, it is preferred to give large force within the range not to cause the breakage and the temperature increase of fatty acid silver salt particles which are image-forming media. For the above purpose, a dispersing method in which the flow rate of a dispersion product comprising a fatty acid silver salt and a dispersant solution is converted to a high flow rate and then the pressure is lowered is preferably used. The dispersant in this case may be any compound so long as it does not hinder the function of the auxiliary dispersant and water alone is preferred, and an organic solvent may be contained in the dispersion medium provided that the amount is 20 wt % or less. Further, if a photosensitive silver salt is present with the fatty acid silver salt during dispersion, fog increases and sensitivity extremely lowers. Thus, it is more preferred not to substantially contain a photosensitive silver salt. The content of a photosensitive silver salt in the solution to be dispersed is 0.1 mol % or less per mol of the fatty acid silver salt in the solution, thus it is preferred not to add a photosensitive silver salt positively.

Dispersing apparatus and techniques for performing the foregoing redispersing method are described in detail, for example, in Toshio Kajiuchi, Hiroshi Usui, *Bunsankei Rheology to Bunsanka Gijutsu* (*Rheology of Dispersion System and Techniques of Dispersion*), pp. 357 to 403, Shinzan-sha Publishing Co., Ltd. (1991), *Kagaku Kogaku no Shinpo, Dai* 24 *Shu* (*Advancement of Chemical Engineering, the* 24*th Series*), pp. 184 and 185, compiled by the Tokai Branch of the Chemical Engineering Society, published by Maki Shoten (1990), JP-A-59-49832, U.S. Pat. No. 4,533,254, JP-A-8-137044, JP-A-8-238848, JP-A-2-261525, JP-A-1-94933, etc. The redispersing method according to the present invention is a method in which a dispersion solution containing at least a fatty acid silver salt is fed into piping by high pressure using a high pressure pump and the like, passed through a fine slit in the piping, and then the pressure applied to the dispersion solution is suddenly reduced to thereby effect fine dispersion.

In a high pressure homogenizer, (a) "shear force" is generated when a dispersoid passes through a narrow gap (from 75 $\mu$m to 350 $\mu$m or so) at high pressure and a high flow rate, and (b) impact force generated by liquid-liquid impinging under high pressure and in a narrow gap and impinging against wall further strengthens cavitation force generated by the pressure drop thereafter, and it is thought that the dispersion to fine particles can be brought about uniformly and effectively by the shear force and the cavitation force. As a dispersing apparatus of this type, a Gaulin homogenizer can be exemplified, wherein a solution to be dispersed fed at high pressure is converted to high speed flow in a narrow gap on cylindrical plane, the solution is impinged against the surrounding walls by that force, and emulsification and dispersion are effected by that impact force. As the apparatus of the above liquid-liquid impinging, Y-type chamber of micro-fluidizer, a spherical chamber making use of spherical check valves as disclosed in JP-A-8-103642 described later, etc., can be exemplified, and as liquid-wall impinging, Z-type chamber of micro-fluidizer, etc., can be exemplified. The applied pressure is in general within the range of from 100 to 600 kg/cm$^2$ and a flow rate is from several meters to 30 meters/second, and some means have been elaborated to heighten a dispersion efficiency, such as to provide sawtooth blades at high speed flow zone to increase the number of times of impinging. As representative examples of this type of apparatus, a Gaulin homogenizer, a micro-fluidizer (manufactured by Micro Fluidex International Corp.), a micro-fluidizer (manufactured by Mizuho Kogyo Co., Ltd.), and a nanomizer (manufactured by Tokushu Kika Kogyo Co., Ltd.) are exemplified. Similar apparatuses are also disclosed in JP-A-8-238848, JP-A-8-103642 and U.S. Pat. No. 4,533,254.

In the present invention, it is possible to achieve the dispersion of the fatty acid silver salt of the desired particle size by adjusting flow rate, differential pressure at the time of pressure drop, and the number of times of processing. From the viewpoint of the photographic characteristics and the particle size, the flow rate is preferably from 200 to 600 m/sec, more preferably from 300 to 600 m/sec, and differential pressure at pressure drop is preferably from 900 to 3,000 kg/cm$^2$, more preferably from 1,500 to 3,000 kg/ cm$^2$. The number of times of dispersion processing can be selected according to necessity and, in general, from 1 to 10 times, but in view of productivity, preferably from 1 to 3 or so. It is not preferred from the point of dispersion properties and photographic characteristics to keep the temperature of the dispersion solution high under high pressure, and when the temperature exceeds as high as 90° C., the particle size is liable to increase and fog is also liable to increase. Accordingly, it is preferred in the present invention to include a cooler in steps prior to conversion to high pressure/high flow rate, after pressure drop, or in both steps, to thereby keep the temperature of the dispersion preferably from 5 to 90° C., more preferably from 5 to 80° C., and particularly preferably from 5 to 65° C. In particular, it is effective to provide such a cooling process during high pressure dispersion of from 1,500 to 3,000 kg/cm$^2$. A cooler can be arbitrarily selected from, e.g., a double pipe and a triple pipe using a static mixer, a shell and tube heat exchanger, and a coiled heat exchanger, according to the required heat exchange amount. Further, for increasing heat exchange efficiency, it is necessary to select appropriate diameter, thickness and material of the pipe with taking the pressure used into consideration. As a cooling medium in a cooler, well water of 20° C., chilled water of from 5 to 10° C. treated with a refrigerator, or, if necessary, a cooling medium such as ethylene glycol/water of −30° C. can be used according to heat exchange amount.

When a fatty acid silver salt is made solid fine particles with a dispersant, the following dispersants can be arbitrarily selected, e.g., synthetic anion polymers such as polyacrylic acid, acrylic acid copolymers, maleic acid copolymers, maleic acid monoester copolymers, and acryloylmethylpropanesulfonic acid copolymers, semi-synthetic anion polymers such as carboxymethyl starch and carboxymethyl cellulose, anionic polymers of alginic acid and pectic acid, the anionic surfactants disclosed in JP-A-52-92716 and WO 88/04794, the compounds disclosed in JP-A-9-179243, well-known anionic, nonionic and cationic surfactants, other well-known polymers such as polyvinyl alcohol, polyvinyl pyrrolidone, carboxymethyl cellulose, hydroxypropyl cellulose, and hydroxypropylmethyl cellulose, and natural high molecular compounds such as gelatin. Further, when a solvent is used as a dispersion medium, polyvinyl butyral, butylethyl cellulose, methacrylate copolymer, maleic anhydride ester copolymer, polystyrene, and butadiene-styrene copolymer are preferably used.

An auxiliary dispersant is commonly mixed with the powder of a fatty acid silver salt or a fatty acid silver salt in a wet cake-like state before dispersion and fed to a disperser as a slurry, but an auxiliary dispersant may be previously mixed with a fatty acid silver salt and subjected to heat treatment or treatment with a solvent to thereby make fatty acid silver salt powder or a wet cake. pH may be adjusted before, after or during dispersion with a proper pH adjustor.

In addition to mechanical dispersion, a fatty acid silver salt may be coarsely dispersed in a solvent by pH controlling, and then atomized by changing pH in the presence of an auxiliary dispersant. At this time, a fatty acid solvent may be used for coarse dispersion.

Nonionic high polymer dispersants can be used in the present invention. Nonionic high polymer dispersants are not particularly restricted so long as they have the function of dispersing an organic acid silver salt, and have a molecular weight of from five to ten times of the molecular cutoff of the ultrafiltration film used in desalting of the by-produced salts generated from the reaction of a solution containing a silver ion and an organic acid alkali metal salt solution, and dispersants soluble in a reactive aqueous solvent can be exemplified. Polyvinyl alcohol, polyvinyl pyrrolidone, hydroxypropyl cellulose, and hydroxypropylmethyl cellulose are preferably used as such a dispersant.

The concentration of nonionic high polymer dispersants is generally from 0.1 to 30 wt %, particularly preferably from 0.5 to 30 wt %, based on the organic acid silver salt. The addition time of nonionic high polymer dispersants is not particularly restricted but is preferably after completion of the reaction of an organic acid silver salt and before desalting processing with the intention of preventing the hindrance of organic acid silver salt reaction.

In further preferred embodiment of the present invention, desalting is performed by ultrafiltration, and a nonionic high polymer dispersant is added after the electric conductivity of the organic acid silver dispersion solution has lowered. The electric conductivity at this time is preferably 2,000 $\mu$S/cm or less.

The methods used in desalting/concentration process of a silver halide emulsion can be used in ultrafiltration. *Research Disclosure,* 208, No. 10 (1972), ibid., 122, No. 13 (1975) and ibid., 351, No. 16 (1977) can be referred to. Pressure difference and flow rate which are important as operating conditions can be selected with referring to the characteristic curves described in Haruhiko Ohya, *Maku Riyo Gijutsu Handbook* (*Handbook of Techniques Using Films*), p. 275, Saiwai Shobo Co., Ltd. (1978), and for processing the objective organic acid silver dispersion, it is necessary to find out an optimal condition to inhibit agglomeration and fog of the particles. In the method of replenishing the lost solvent due to filtration, there are a constant volume system of continuously adding the solvent and a batch system of adding intermittently in parts, but a constant volume system requiring comparatively short desalting processing time is preferred.

Ion exchange water or distilled pure water is used as the thus-replenished solvent, but a pH adjustor may be mixed in pure water for maintaining the objective pH value, or the replenisher may be added directly to the organic acid silver dispersion.

As the ultrafiltration film, ready-integrated modules, e.g., a plate type, a spiral type, a cylindrical type, a hollow yarn type, and a hollow fiber type are commercially available from Asahi Kasei Corporation, Daicel Chemical Industries, Ltd., Toray Industries Inc. and Nitto Denko Corporation. In view of the total film area and cleaning property, a spiral type or a hollow yarn type is preferably used in the present invention.

Further, the molecular cutoff which is the index of the threshold value of the components which can penetrate through the film is preferably ⅕ or less of the molecular weight of the high polymer dispersant to be used.

The liquid temperature is preferably maintained low after silver particles are formed until desalting process progresses. The reason is that with the state of the organic solvent used for dissolving the organic acid alkali metal salt being permeated into particles, a silver nucleus is easily generated by the charging operation and the shear field and pressure field when the particles pass through an ultrafiltration film. Therefore, ultrafiltration processing is performed with maintaining the temperature of the organic acid silver particle dispersion from 1 to 30° C., preferably from 5 to 25° C. in the present invention.

The dispersion solution produced can be stored with stirring for preventing the precipitation of the fine particles during storage or can be stored in a colloidal highly viscous state (e.g., in a jelly state with gelatin). It is also possible to add antiseptics to the dispersion solution for preventing the proliferation of various bacteria during storage.

The fatty acid silver salt produced according to the producing method of the present invention is preferably mixed with a photosensitive silver salt solution and supplied as the coating solution for producing a photothermographic image-recording material after being dispersed in a solvent.

A starting solution is subjected to coarse dispersion (preliminary dispersion) prior to dispersing operation. As coarse dispersing means, known dispersing means (e.g., a high speed mixer, a homogenizer, a high speed impinging mill, a banbury mixer, a homomixer, a kneader, a ball mill, a vibrating ball mill, a planetary ball mill, an attritor, a sand mill, a beads mill, a colloid mill, a jet mill, a roller mill, a trommel and a high speed stone mill) can be used. In addition to mechanical dispersion, a starting material may be coarsely dispersed in a solvent by pH controlling, and then atomized by changing pH in the presence of an auxiliary dispersant. At this time, an organic solvent may be used for coarse dispersion.

The particle size of the fatty acid silver salt solid fine particle dispersion (volume weighted average diameter) according to the present invention can be obtained from the particle size (volume weighted average diameter) obtained by irradiating the solid fine particle dispersion dispersed in the solution with laser beams, and finding the autocorrelation function to the time variation of the fluctuation of light scattering. The solid fine particle dispersion preferably has the average particle size of from 0.05 to 10.0 $\mu$m, more preferably from 0.1 to 5.0 $\mu$m, and most preferably from 0.1 to 2.0 $\mu$m.

The fatty acid silver salt solid fine particle dispersion preferably used in the present invention comprises at least a fatty acid silver salt and water. The ratio of the fatty acid silver salt and water is not particularly limited, but preferably the fatty acid silver salt accounts for from 5 to 50 wt %, particularly preferably from 10 to 30 wt %, of the total composition. The foregoing auxiliary dispersant is preferably used but the use amount is preferably the possible minimum amount within the range capable of obtaining the smallest particle size. The amount is preferably from 1 to 30 wt %, particularly preferably from 3 to 15 wt %, based on the fatty acid silver salt.

A photothermographic image-recording material can be prepared by mixing a dispersion solution of a fatty acid silver salt and a dispersion solution of a photosensitive silver salt according to the present invention. The mixing ratio of a fatty acid silver salt and a photosensitive silver salt can be selected according to purposes, but the ratio of a photosensitive silver salt to a fatty acid silver salt is preferably from 1 to 30 mol %, more preferably from 3 to 20 mol %, and particularly preferably from 5 to 15 mol %. Mixture of two or more kinds of dispersion solutions of fatty acid silver salts and two or more kinds of dispersion solutions of photosensitive silver salts is preferably used for adjusting photographic characteristics.

The fatty acid silver salt according to the present invention can be used in a desired amount but the amount is preferably from 0.1 to 5 g/m$^2$, more preferably from 1 to 3 g/m$^2$, as silver amount, of the photothermographic image-recording material.

The photothermographic image-recording material according to the present invention comprises a support having thereon a reducing agent, a binder and photoinsensitive organic silver salt. It is preferred to further contain a photosensitive silver halide on a support.

The halogen composition of the photosensitive silver halide for use in the present invention is not particularly limited. Silver chloride, silver chlorobromide, silver bromide, silver iodobromide, and silver iodochlorobromide can be used in the present invention. The distribution of the halogen composition in the grain may be uniform, the halogen composition may be changed stepwise or may be continuously changed. Silver halide grains having a core/shell structure can be preferably used. The grain structures are preferably from a double structure to a quintuple structure, and the core/shell grains having a double structure to a quadruple structure can be more preferably used. The technique of localizing silver bromide on the surface of silver chloride or silver chlorobromide grains can also preferably be used.

A photosensitive silver halide can be produced using the methods well-known in this industry, for example, the methods disclosed in *Research Disclosure,* No. 17029 (June, 1978) and U.S. Pat. No. 3,700,458 can be used. Specifically, the photosensitive silver halide is produced as a silver halide emulsion by the reaction of a silver nitrate and a soluble halide. The silver halide may be produced by reacting a fatty acid silver salt with a halogen ion, and converting to a halogen. Alternatively, a halogen ion may be added during formation of a fatty acid silver salt.

The grain size of the photosensitive silver halide is preferably small for the purpose of suppressing the white turbidity after image formation to low degree, specifically preferably 0.20 $\mu$m or less, more preferably from 0.01 to 0.15 $\mu$m, and still more preferably from 0.02 to 0.12 $\mu$m. The grain size in the present invention means the edge length when silver halide grains have a so-called regular crystal form such as a cubic or octahedral form, when silver halide grains do not have regular crystal forms, e.g., in the case of a spherical or cylindrical form, the grain size means the diameter of the sphere having the same volume as the volume of the silver halide grains, and when silver halide grains are tabular grains, it means the diameter of a circle having the same area as the projected area of the main plane of the grain.

The silver halide grain may have a crystal form such as a cubic, octahedral, tabular, spherical, cylindrical, or pebble-like form. Cubic grains are particularly preferably used in the present invention. The silver halide grain having rounded corners can also be preferably used in the present invention. A plane index (Miller index) of the outer surface of the photosensitive silver halide grains is not particularly limited, but it is preferred that the proportion occupied by {100} planes which have high ratio of spectral sensitizing efficiency when spectral sensitizing dyes are adsorbed is high. The proportion of {100} plane is preferably 50% or more, more preferably 65% or more, and still more preferably 80% or more. The ratio of Miller index {100} plane can be obtained by the method described in T. Tani, *J. Imaging Sci.,* 29, 165 (1985), which makes use of adsorption dependence of {111} plane and {100} plane in adsorption of sensitizing dyes.

It is preferred to localize hexacyano metal complexes on the outermost surface of a silver halide grain. As the hexacyano metal complexes, $[Fe(CN)_6]^{4-}$, $[Fe(CN)_6]^{3-}$, $[Ru(CN)_6]^{4-}$, $[Os(CN)_6]^{4-}$, $[Co(CN)_6]^{3-}$, $[Rh(CN)_6]^{3-}$, $[Ir(CN)_6]^{3-}$, $[Cr(CN)_6]^{3-}$ and $[Re(CN)_6]^{3-}$ can be exemplified. Of these, hexacyano Fe complexes are preferred.

Since a hexacyano metal complex is present in an aqueous solution in the form of an ion, a counter cation is not important, but it is preferred to use those which are easily miscible with water and applicable to precipitation processing of silver halide emulsion as the counter cation, such as an alkali metal ion, e.g., a sodium ion, a potassium ion, a rubidium ion, a cesium ion, and a lithium ion, an ammonium ion, and an alkylammonium ion (e.g., a tetramethylammonium ion, a tetraethylammonium ion, a tetrapropylammonium ion and a tetra(n-butyl)-ammonium ion).

A hexacyano metal complex can be added as mixture with water, with a mixed solvent of appropriate solvent miscible with water (e.g., alcohols, ethers, glycols, ketones, esters, amides, etc.) and water, and with gelatin.

The addition amount of hexacyano metal complexes is preferably from $1\times10^{-5}$ to $1\times10^{-2}$ mol, more preferably from $1\times10^{-4}$ to $1\times10^{-3}$ mol, per mol of the silver.

For localizing hexacyano metal complexes on the outermost surface of a silver halide grain, they are directly added after the addition of a silver nitrate aqueous solution for grain formation is finished and before the completion of charging process before chemical sensitization, e.g., chalcogen sensitization of sulfur sensitization, selenium sensitization and tellurium sensitization, and noble metal sensitization, e.g., gold sensitization, etc., during washing process, during dispersing process, or before chemical sensitization process. Hexacyano metal complexes are preferably added rapidly after grain formation so as not to grow silver halide fine grains and the addition is preferably performed before charging process is completed.

The addition of hexacyano metal complexes may be started after 96 wt % of the total amount of a silver nitrate which is added for improving grain forming property has been added, more preferably after 98 wt % has been added, and particularly preferably after 99 wt % has been added.

If hexacyano metal complexes are added after the addition of a silver nitrate aqueous solution and just before completion of the grain formation, they can be adsorbed onto the outermost surfaces of the silver halide grains, and almost all of the hexacyano metal complexes form a hardly soluble salt with the silver ions on the grain surfaces. Since the silver salt of hexacyanoferrate(II) is a more hardly soluble salt than AgI, re-dissolution of fine grains can be prevented, thus the production of silver halide grains having smaller grain sizes can be realized.

The photosensitive silver halide grains preferably used in the present invention contain metals or metal complexes belonging to group 8 to group 10 of the Periodic Table (group 1 to group 18 are shown). Preferred metals or central metals of metal complexes belonging to group 8 to group 10 of the Periodic Table are rhodium, rhenium, ruthenium, osmium and iridium. These metal complexes may be used alone, or two or more of the complexes of the same or different metals can be used in combination. The content of these metals or metal complexes is preferably from $1\times10^{-9}$ mol to $1\times10^{-3}$ mol per mol of the silver. These metal complexes are disclosed in paragraphs from [0018] to [0024] of JP-A-11-65021.

It is particularly preferred to contain iridium compounds in the silver halide grains according to the present invention, e.g., hexachloroiridium, hexaammineiridium, trioxalatoiridium, hexacyanoiridium, pentachloronitrosyliridium and the like can be exemplified. These iridium compounds are used by dissolving in water or an appropriate solvent. A method so far been generally widely used to stabilize the solution of iridium compound, e.g., a method of adding an aqueous solution of a hydrogen halide (e.g., hydrochloric acid, hydrobromic acid, hydrofluoric acid, etc.) or an alkali halide (e.g., KCl, NaCl, KBr, NaBr, etc.) can be used. It is also possible to add and dissolve other silver halide grains which have been previously doped with iridium during the preparation of silver halide instead of using water-soluble iridium. The addition amount of these iridium compounds is preferably from $1\times10^{-8}$ mol to $1\times10^{-3}$ mol, and more preferably from $1\times10^{-7}$ mol to $5\times10^{-4}$ mol, per mol of the silver halide.

Further, metal atoms which can be contained in the silver halide grains for use in the present invention (e.g., $[Fe(CN)_6]^{4-}$), desalting methods and chemical sensitization are disclosed in paragraphs [0046] to [0050] of JP-A-11-84574 and paragraphs [0025] to [0031] of JP-A-11-65021.

The sensitizing dyes for use in the present invention can be advantageously selected from the sensitizing dyes which can spectrally sensitize silver halide grains in a desired wavelength region when they are adsorbed onto the silver halide grains, and have spectral sensitivity appropriate to the spectral characteristics of the exposure light sources. The sensitizing dyes and the addition methods are disclosed in paragraphs [0103] to [0109] of JP-A-11-65021, JP-A-10-186572 (the compound represented by formula (II)), and EP-A-0803764, line 38, page 19 to line 35, page 20. The preferred addition time of the sensitizing dyes to the silver halide emulsion in the present invention is after desalting and before coating, and more preferred time is after desalting and before beginning of chemical sensitization.

The photosensitive silver halide grains according to the present invention are preferably chemically sensitized by sulfur sensitization, selenium sensitization or tellurium sensitization. Well known compounds, e.g., the compounds disclosed in JP-A-7-128768, can be used in sulfur sensitization, selenium sensitization or tellurium sensitization. Tellurium sensitization is particularly preferred in the present invention, and as the tellurium sensitizers, e.g., diacyltellurides, bis(oxycarbonyl)tellurides, bis(carbamoyl)tellurides, diacyltellurides, bis(oxycarbonyl)ditellurides, bis(carbamoyl)ditellurides, compounds having a P═Te bond, tellurocarboxylates, tellurosulfonates, compounds having a P—Te bond, and tellurocarbonyl compounds can be used in the present invention. As the specific examples of tellurium sensitizers which can be used in the present invention, the compounds disclosed in paragraph [0030] of JP-A-11-65021 can be exemplified. The compounds represented by formulae (II), (III) and (IV) disclosed in JP-A-5-313284 are particularly preferred.

Chemical sensitization may be performed any time after grain formation and before coating, for example, chemical sensitization may be performed after desalting and (1) before spectral sensitization, (2) at the same time with spectral sensitization, (3) after spectral sensitization, or (4) just before coating, and it is particularly preferred to be performed after spectral sensitization.

The amount of the sulfur, selenium and tellurium sensitizers to be used in the present invention varies according to the silver halide grains used and the conditions of chemical ripening, but is generally about $10^{-8}$ to $10^{-2}$ mol, preferably about $10^{-7}$ to $10^{-3}$ mol, per mol of the silver halide. There is no particular limitation on the conditions of chemical sensitization in the present invention, but pH is from 5 to 8, pAg is from 6 to 11, preferably from 7 to 10, and temperature is from 40 to 95° C., preferably from 44 to 70° C.

The photosensitive silver halide emulsion in the photothermographic image-recording material of the present invention may be one kind, or two or more kinds of silver halide emulsions (for example, those differing in average grain sizes, differing in halogen compositions, differing in crystal habits, or differing in the conditions of chemical sensitization) may be used in combination. Gradation can be controlled by using a plurality of photosensitive silver halides having different sensitivities. Techniques with respect to these are disclosed in JP-A-57-119341, JP-A-53-106125, JP-A-47-3929, JP-A-48-55730, JP-A-46-5187, JP-A-50-73627, and JP-A-57-150841. It is preferred for each emulsion to have sensitivity difference of 0.2logE or more.

The photosensitive silver halide according to the present invention is preferably used in an amount of from 0.03 to 0.6 $g/m^2$, more preferably from 0.05 to 0.4 $g/m^2$, and most preferably from 0.1 to 0.4 $g/m^2$, in silver amount per $m^2$ of the photothermographic image-recording material, and the use amount of the photosensitive silver halide per mol of the fatty acid silver salt is preferably from 0.01 to 0.5 mol, more preferably from 0.02 to 0.3 mol, and particularly preferably from 0.03 to 0.25 mol.

With respect to the mixing method and the mixing condition of the photosensitive silver halides and the fatty acid silver salts prepared separately, there are a method of mixing the photosensitive silver halide grains with the fatty acid silver salt each having been prepared using a high speed stirrer, a ball mill, a sand mill, a colloid mill, a vibrating mill or a homogenizer, and a method of mixing the photosensitive silver halide having been prepared with the fatty acid silver salt at any time during preparation to complete the production of the fatty acid silver salt. There is no restriction as to the methods so long as the effect of the present invention can be sufficiently exhibited.

When the silver halide according to the present invention is added to the coating solution of an image-forming layer, there is no particular limitation so long as the effect of the present invention can be sufficiently exhibited. As the specific mixing methods, a method of performing mixture in a tank in such a manner that the average residence time, which is calculated from the addition flow rate and the charging amount to the coater, coincides with the desired time, and a method of using a static mixer and the like as described in N. Harnby, M. F. Edwards, A. W. Nienow, translated by Koji Takahashi, *Liquid Mixing Techniques,* Chap. 8, published by Nikkan Kogyo Shinbun-sha (1989) can be used.

The examples of the reducing agents preferably used in the photothermographic image-recording material of the present invention include phenidone, hydroquinones, catechol and hindered phenol. With respect to the reducing agents, U.S. Pat. Nos. 3,770,448, 3,773,512, 3,593,863, 4,460,681, and *Research Disclosure,* No. 17029 and ibid., No. 29963 can be referred to.

The specific examples of the reducing agents include an aminohydroxycycloalkenone compound (e.g., 2-hydroxypiperidino-2-cyclohexenone), an N-hydroxuurea derivative (e.g., N-p-methylphenyl-N-hydroxyurea), hydrazones of aldehyde or ketone (e.g., anthracenealdehydephenylhydrazone), phosphor amidophenols, phosphor amidoanilines, polyhydroxybenzenes (e.g., hydroquinone, t-butylhydroquinone, isopropylhydroquinone, 2,5-dihydroxyphenylmethylsulfone), sulfohydroxamic acids (e.g., benzenesulfohydroxamic acid), sulfonamidoanilines (e.g., 4-(N-methanesulfonamido)aniline), 2-tetrazolylthiohydroquinones (e.g., 2-methyl-5-(1-phenyl-5-tetrazolylthio)hydroquinone), tetrahydroquinoxalines (e.g., 1,2,3,4-tetrahydroquinoxaline), amidoxines, combinations of azines (e.g., aliphatic carboxylic acid arylhydrazides) with ascorbic acid, combinations of polyhydroxybenzene with hydroxylamine, reductone, hydrazine, hydroxamic acids, combinations of azines with sulfonamidophenols, an α-cyanophenylacetic acid derivative, combinations of bis-β-naphthol with a 1,3-dihydroxybenzene derivative, 5-pyrazolones, sulfonamidophenols, 2-phenylindane-1,3-dione, chroman, 1,4-dihydropyridines (e.g., 2,6-dimethoxy-3,5-dicarboethoxy-1,4-dihydropyridine), bisphenols (e.g., 2,2'-methylene-bis(4-methyl-6-tert-butylphenol), bis(2-hydroxy-3-tert-butyl-5-methylphenyl)methane, bis(6-hydroxy-m-tri)mesitol, 2,2-bis(4-hydroxy-3-methylphenyl)propane, 1,1-bis(2-hydroxy-3,5-dimethylphenyl)-3,3,5-trimethylhexane, 4,4-ethylidene-bis(2-tert-butyl-6-methyl)phenol), UV-sensitive ascorbic acid derivatives, and 3-pyrazolidones.

Esters of amino reductones which function as a reducing agent precursor (e.g., piperidinohexose reductone monoacetate) may be used as a reducing agent.

A particularly preferred reducing agent is bisphenol. The compound represented by the following formula (I) is particularly preferably used in the present invention.

(I)

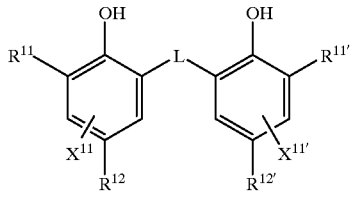

wherein $R^{11}$ and $R^{11'}$ each represents an alkyl group; $R^{12}$ and $R^{12'}$ each represents a hydrogen atom or a group capable of substituting on a benzene ring; $X^{11}$ and $X^{11'}$ each represents a hydrogen atom or a group capable of substituting on a benzene ring; $R^{11}$ and $X^{11}$, $R^{11'}$ and $X^{11'}$, $R^{12}$ and $X^{11}$, and $R^{12'}$ and $X^{11'}$ may be bonded to each other to form a ring; L represents an —S— group or a —$CHR^{13}$— group; and $R^{13}$ represents a hydrogen atom or an alkyl group.

In formula (I), $R^{11}$ and $R^{11'}$ each represents an alkyl group, specifically a substituted or unsubstituted, straight chain, branched or cyclic alkyl group preferably having from 1 to 20 carbon atoms. The substituents of the alkyl group are not particularly restricted, and preferably an aryl group, a hydroxyl group, an alkoxyl group, an aryloxy group, an alkylthio group, an arylthio group, an acylamino group, a sulfonamido group, a sulfonyl group, a phosphoryl group, an acyl group, a carbamoyl group, an ester group and a halogen atom are exemplified.

$R^{11}$ and $R^{11'}$ each more preferably represents a secondary or tertiary alkyl group having from 3 to 15 carbon atoms (e.g., isopropyl, isobutyl, t-butyl, t-amyl, t-octyl, cyclohexyl, cyclopentyl, 1-methylcyclohexyl, 1-methylcyclopropyl), still more preferably a tertiary alkyl group having from 4 to 12 carbon atoms, of the tertiary alkyl groups, t-butyl, t-amyl and 1-methylcyclohexyl are especially preferred, and t-butyl is most preferred.

$R^{12}$ and $R^{12'}$ each represents a hydrogen atom or a group capable of substituting on a benzene ring. $X^{11}$ and $X^{11'}$ each represents a hydrogen atom or a group capable of substituting on a benzene ring. As the group capable of substituting on a benzene ring, an alkyl group, an aryl group, a halogen atom, an alkoxyl group and an acylamino group can be preferably exemplified.

$R^{12}$ and $R^{12'}$ each preferably represents an alkyl group having from 1 to 20 carbon atoms (e.g., methyl, ethyl, propyl, butyl, isopropyl, t-butyl, t-amyl, cyclohexyl, 1-methylcyclohexyl, benzyl, methoxymethyl, methoxyethyl), more preferably methyl, ethyl, propyl, isopropyl or t-butyl.

$X^{11}$ and $X^{11'}$ each preferably represents a hydrogen atom, a halogen atom or an alkyl group, particularly preferably a hydrogen atom.

$R^{11}$ and $X^{11}$, $R^{11'}$ and $X^{11'}$, $R^{12}$ and $X^{11}$, and $R^{12'}$ and $X^{11'}$ may be bonded to each other to form a ring, and the ring is preferably a 5- to 7-membered ring, and more preferably a saturated 6-membered ring.

L represents an —S— group or a —$CHR^{13}$— group, and $R^{13}$ represents a hydrogen atom or an alkyl group. $R^{13}$ specifically represents a substituted or unsubstituted, straight chain, branched or cyclic alkyl group preferably having from 1 to 20 carbon atoms. As the specific examples of the unsubstituted alkyl group represented by $R^{13}$, a methyl group, an ethyl group, a propyl group, a butyl group, a heptyl group, an undecyl group, an isopropyl group, a 1-ethylpentyl group, and a 2,4,4-trimethylpentyl group can be exemplified. The substituents of the substituted alkyl group represented by $R^{13}$ are the same as the substituents of the alkyl group represented by $R^{11}$ and $R^{11'}$.

L preferably represents a —$CHR^{13}$— group.

$R^{13}$ preferably represents a hydrogen atom or an alkyl group having from 1 to 15 carbon atoms, the alkyl group is preferably a primary or secondary alkyl group having from 1 to 8 carbon atoms, more preferably a methyl group, an ethyl group, an n-propyl group, an isopropyl group, or a 2,4,4-trimethylpentyl group, still more preferably a methyl group, an ethyl group, an n-propyl group, or an isopropyl group, and particularly preferably a methyl group, an ethyl group, or an n-propyl group.

When $R^{13}$ represents a hydrogen atom, $R^{12}$ and $R^{12'}$ each preferably represents an alkyl group having 2 or more carbon atoms, more preferably an alkyl group having from 2 to 5 carbon atoms, still more preferably an ethyl group or a propyl group, and most preferably an ethyl group.

When $R^{13}$ represents an alkyl group, $R^{12}$ and $R^{12'}$ each preferably represents an alkyl group, and particularly preferably a methyl group.

The specific examples of the compounds represented by formula (I) are shown below, but the compounds which can be used in the present invention are not limited thereto.

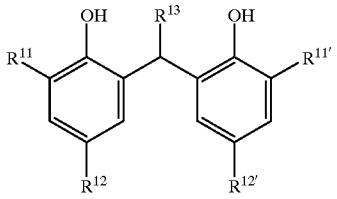

| | $R^{11}$ | $R^{11'}$ | $R^{12}$ | $R^{12'}$ | $R^{13}$ |
|---|---|---|---|---|---|
| I-1 | $CH_3$ | $CH_3$ | $CH_3$ | $CH_3$ | H |
| I-2 | $CH_3$ | $CH_3$ | $CH_3$ | $CH_3$ | $CH_3$ |
| I-3 | $CH_3$ | $CH_3$ | $CH_3$ | $CH_3$ | $C_3H_7$ |
| I-4 | $CH_3$ | $CH_3$ | $CH_3$ | $CH_3$ | i-$C_3H_7$ |
| I-5 | $CH_3$ | $CH_3$ | $CH_3$ | $CH_3$ | $CH(C_2H_5)C_4H_9$ |

-continued

| | | | | | |
|---|---|---|---|---|---|
| I-6 | $CH_3$ | $CH_3$ | $CH_3$ | $CH_3$ | $CH_2CH(CH_3)CH_2C(CH_3)_3$ |
| I-7 | $CH_3$ | $CH_3$ | $C_2H_5$ | $C_2H_5$ | H |
| I-8 | $CH_3$ | $CH_3$ | $C_2H_5$ | $C_2H_5$ | i-$C_3H_7$ |
| I-9 | $C_2H_5$ | $C_2H_5$ | $CH_3$ | $CH_3$ | H |
| I-10 | $C_2H_5$ | $C_2H_5$ | $CH_3$ | $CH_3$ | i-$C_3H_7$ |
| I-11 | t-$C_4H_9$ | t-$C_4H_9$ | $CH_3$ | $CH_3$ | H |
| I-12 | t-$C_4H_9$ | t-$C_4H_9$ | $CH_3$ | $CH_3$ | $CH_3$ |
| I-13 | t-$C_4H_9$ | t-$C_4H_9$ | $CH_3$ | $CH_3$ | $C_2H_5$ |
| I-14 | t-$C_4H_9$ | t-$C_4H_9$ | $CH_3$ | $CH_3$ | n-$C_3H_7$ |
| I-15 | t-$C_4H_9$ | t-$C_4H_9$ | $CH_3$ | $CH_3$ | n-$C_4H_9$ |
| I-16 | t-$C_4H_9$ | t-$C_4H_9$ | $CH_3$ | $CH_3$ | n-$C_7H_{15}$ |
| I-17 | t-$C_4H_9$ | t-$C_4H_9$ | $CH_3$ | $CH_3$ | n-$C_{11}H_{21}$ |
| I-18 | t-$C_4H_9$ | t-$C_4H_9$ | $CH_3$ | $CH_3$ | i-$C_3H_7$ |
| I-19 | t-$C_4H_9$ | t-$C_4H_9$ | $CH_3$ | $CH_3$ | $CH(C_2H_5)C_4H_9$ |
| I-20 | t-$C_4H_9$ | t-$C_4H_9$ | $CH_3$ | $CH_3$ | $CH_2CH(CH_3)_2$ |
| I-21 | t-$C_4H_9$ | t-$C_4H_9$ | $CH_3$ | $CH_3$ | $CH_2CH(CH_3)CH_2C(CH_3)_3$ |
| I-22 | t-$C_4H_9$ | t-$C_4H_9$ | $CH_3$ | $CH_3$ | $CH_2OCH_3$ |
| I-23 | t-$C_4H_9$ | t-$C_4H_9$ | $CH_3$ | $CH_3$ | $CH_2CH_2OCH_3$ |
| I-24 | t-$C_4H_9$ | t-$C_4H_9$ | $CH_3$ | $CH_3$ | $CH_2CH_2OC_4H_9$ |
| I-25 | t-$C_4H_9$ | t-$C_4H_9$ | $CH_3$ | $CH_3$ | $CH_2CH_2SC_{12}H_{25}$ |
| I-26 | t-$C_4H_9$ | t-$C_4H_9$ | $C_2H_5$ | $C_2H_5$ | H |
| I-27 | t-$C_4H_9$ | t-$C_4H_9$ | $C_2H_5$ | $C_2H_5$ | $CH_3$ |
| I-28 | t-$C_4H_9$ | t-$C_4H_9$ | $C_2H_5$ | $C_2H_5$ | n-$C_3H_7$ |
| I-29 | t-$C_4H_9$ | t-$C_4H_9$ | $C_2H_5$ | $C_2H_5$ | i-$C_3H_7$ |
| I-30 | t-$C_4H_9$ | t-$C_4H_9$ | $C_2H_5$ | $C_2H_5$ | $CH_2CH_2OCH_3$ |
| I-31 | t-$C_4H_9$ | t-$C_4H_9$ | n-$C_3H_7$ | n-$C_3H_7$ | H |
| I-32 | t-$C_4H_9$ | t-$C_4H_9$ | n-$C_3H_7$ | n-$C_3H_7$ | $CH_3$ |
| I-33 | t-$C_4H_9$ | t-$C_4H_9$ | n-$C_3H_7$ | n-$C_3H_7$ | n-$C_3H_7$ |
| I-34 | t-$C_4H_9$ | t-$C_4H_9$ | n-$C_4H_9$ | n-$C_4H_9$ | H |
| I-35 | t-$C_4H_9$ | t-$C_4H_9$ | n-$C_4H_9$ | n-$C_4H_9$ | $CH_3$ |
| I-36 | t-$C_5H_{11}$ | t-$C_5H_{11}$ | $CH_3$ | $CH_3$ | H |
| I-37 | t-$C_5H_{11}$ | t-$C_5H_{11}$ | $CH_3$ | $CH_3$ | $CH_3$ |
| I-38 | t-$C_5H_{11}$ | t-$C_5H_{11}$ | $C_2H_5$ | $C_2H_5$ | H |
| I-39 | t-$C_5H_{11}$ | t-$C_5H_{11}$ | $C_2H_5$ | $C_2H_5$ | $CH_3$ |
| I-40 | i-$C_3H_7$ | i-$C_3H_7$ | $CH_3$ | $CH_3$ | H |
| I-41 | i-$C_3H_7$ | i-$C_3H_7$ | $CH_3$ | $CH_3$ | n-$C_3H_7$ |
| I-42 | i-$C_3H_7$ | i-$C_3H_7$ | $C_2H_5$ | $C_2H_5$ | H |
| I-43 | i-$C_3H_7$ | i-$C_3H_7$ | $C_2H_5$ | $C_2H_5$ | n-$C_3H_7$ |
| I-44 | i-$C_3H_7$ | i-$C_3H_7$ | i-$C_3H_7$ | i-$C_3H_7$ | H |
| I-45 | i-$C_3H_7$ | i-$C_3H_7$ | i-$C_3H_7$ | i-$C_3H_7$ | $CH_3$ |
| I-46 | t-$C_4H_9$ | $CH_3$ | $CH_3$ | $CH_3$ | H |
| I-47 | t-$C_4H_9$ | $CH_3$ | $CH_3$ | $CH_3$ | $CH_3$ |
| I-48 | t-$C_4H_9$ | $CH_3$ | $CH_3$ | $CH_3$ | n-$C_3H_7$ |
| I-49 | t-$C_4H_9$ | $CH_3$ | t-$C_4H_9$ | $CH_3$ | $CH_3$ |
| I-50 | i-$C_3H_7$ | $CH_3$ | $CH_3$ | $CH_3$ | $CH_3$ |

I-51

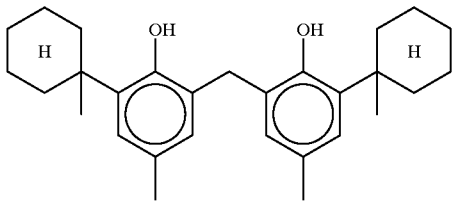

I-52

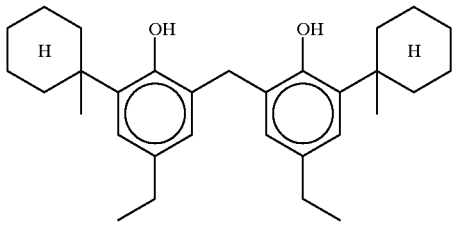

I-53

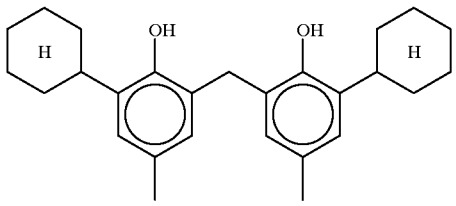

-continued
I-54
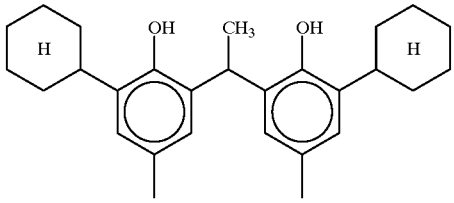
I-55
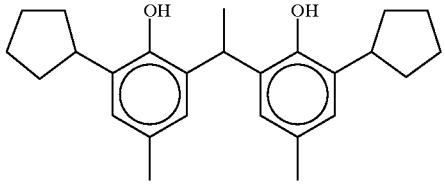
I-56
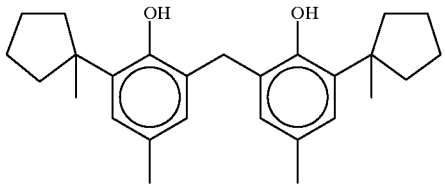
I-57
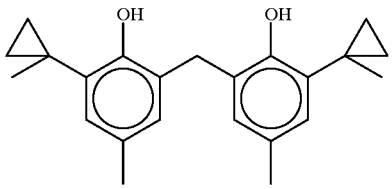
I-58
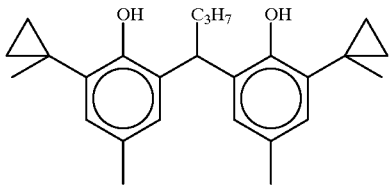
I-59
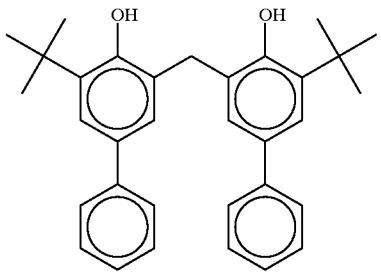
I-60
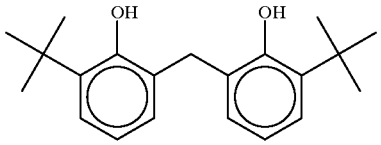
-continued
I-61
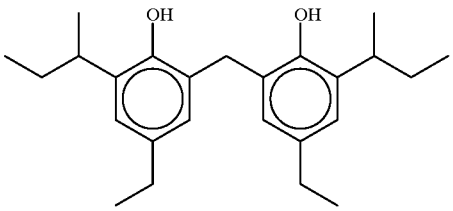
I-62
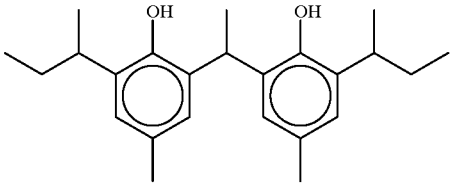
I-63
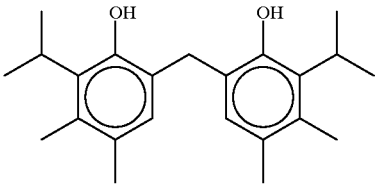
I-64
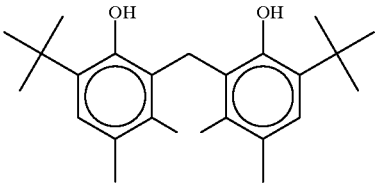
I-65
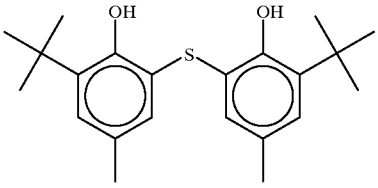
I-66
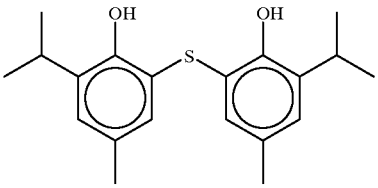
I-67
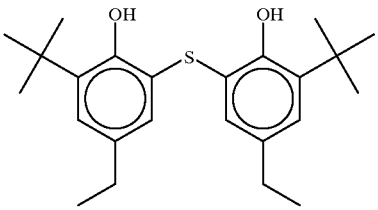

-continued

I-68

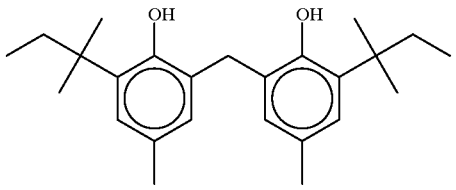

I-69

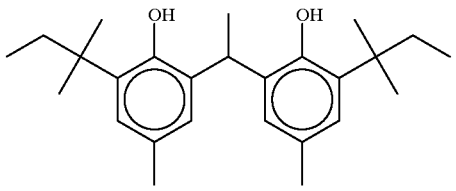

I-70

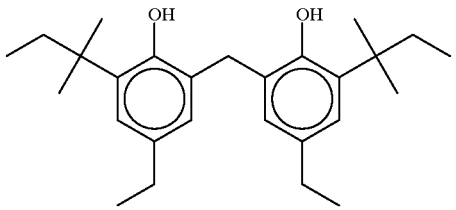

I-71

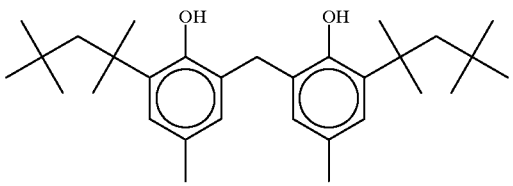

I-72

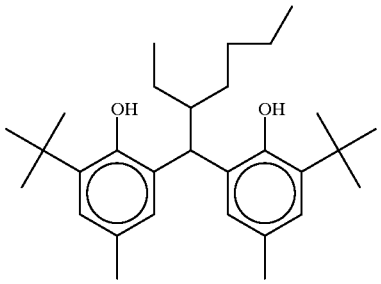

I-73

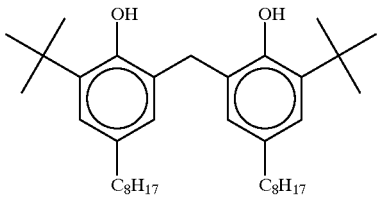

I-74

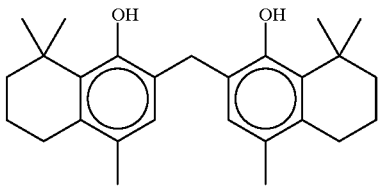

-continued

I-75

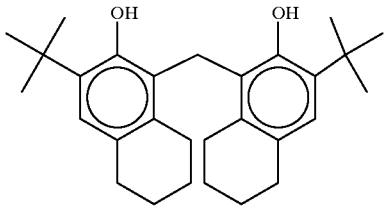

I-76

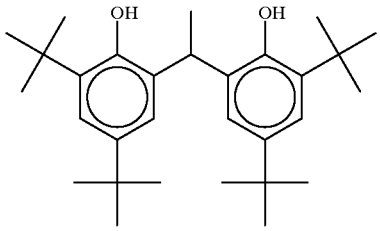

I-77

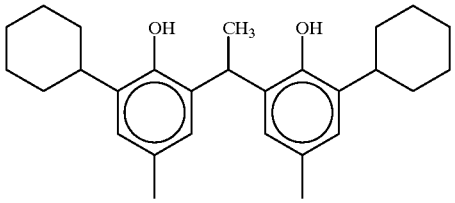

I-78

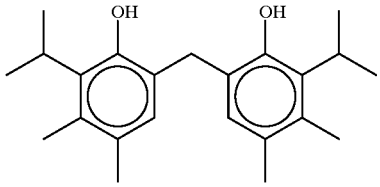

I-79

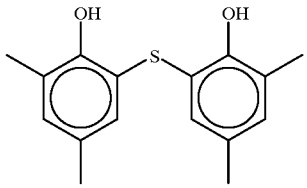

I-80

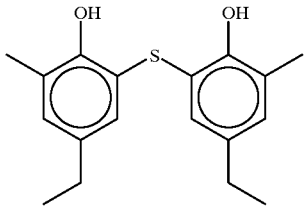

The addition amount of a reducing agent is preferably from 0.1 to 6 mmol/$m^2$, more preferably from 0.2 to 5.0 mmol/$m^2$, and preferably from 5 to 50 mol %, more preferably from 10 to 40 mol %, per mol of the silver contained on the side on which an image-forming layer is provided. A reducing agent is preferably contained in an image-forming layer.

A reducing agent is contained in a coating solution in a form of, e.g., a solution, an emulsified dispersion, or a solid fine particle dispersion, and added to an image-recording material.

As the well-known emulsifying dispersing method, a method of dissolving a reducing agent with oils, e.g., dibutyl phthalate, tricresyl phosphate, glyceryl triacetate or diethyl phthalate, and auxiliary solvents, e.g., ethyl acetate or cyclohexanone, and mechanically producing an emulsified dispersion can be exemplified.

The solid fine particle dispersion can be produced by a method of dispersing the powder of a reducing agent in an appropriate solvent, e.g., water, by means of a ball mill, a colloid mill, a vibrating ball mill, a sand mill, a jet mill, a roller mill or ultrasonic wave, as the solid fine particle dispersing method. At that time, a protective colloid (e.g., polyvinyl alcohol) and a surfactant (e.g., an anionic surfactant such as sodium triisopropylnaphthalenesulfonate (a mixture of three isopropyl groups having different substitution positions)) may be used. A water dispersion can contain an antiseptic (e.g., benzoisothiazolinone sodium salt).

As a hydrogen-bonding compound, the compound represented by the following formula (II) can be preferably used in the present invention.

(II)

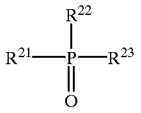

wherein $R^{21}$, $R^{22}$ and $R^{23}$ each represents an alkyl group, an aryl group, an alkoxyl group, an aryloxy group, an amino group, or a heterocyclic group, and these groups may be substituted or unsubstituted. Arbitrary two of $R^{21}$, $R^{22}$ and $R^{23}$ may be bonded to each other to form a ring.

When $R^{21}$, $R^{22}$ and $R^{23}$ each has a substituent, the examples of the substituents include a halogen atom, an alkyl group, an aryl group, an alkoxyl group, an amino group, an acyl group, an acylamino group, an alkylthio group, an arylthio group, a sulfonamido group, an acyloxy group, an oxycarbonyl group, a carbamoyl group, a sulfamoyl group, a sulfonyl group, and a phosphoryl group, and preferably an alkyl group and an aryl group (e.g., methyl, ethyl, isopropyl, t-butyl, t-octyl, phenyl, 4-alkoxyphenyl, 4-acyloxyphenyl).

As the specific examples of the groups represented by $R^{21}$, $R^{22}$ and $R^{23}$, a substituted or unsubstituted alkyl group, e.g., methyl, ethyl, butyl, octyl, dodecyl, isopropyl, t-butyl, t-amyl, t-octyl, cyclohexyl, 1-methylcyclohexyl, benzyl, phenethyl, 2-phenoxypropyl; a substituted or unsubstituted aryl group, e.g., phenyl, cresyl, xylyl, naphthyl, 4-t-butylphenyl, 4-t-octylphenyl, 4-anisidyl, 3,5-dichlorophenyl; a substituted or unsubstituted alkoxyl group, e.g., methoxy, ethoxy, butoxy, octyloxy, 2-ethylhexyloxy, 3,5,5-trimethylhexyloxy, dodecyloxy, cyclohexyloxy, 4-methylcyclohexyloxy, benzyloxy; a substituted or unsubstituted aryloxy group, e.g., phenoxy, cresyloxy, isopropylphenoxy, 4-t-butylphenoxy, naphthoxy, biphenyloxy; a substituted or unsubstituted amino group, e.g., amino, dimethylamino, diethylamino, dibutylamino, dioctylamino, N-methyl-N-hexylamino, dicyclohexylamino, diphenylamino, N-methyl-N-phenylamino; and a heterocyclic group, e.g., 2-pyridyl, 4-pyridyl, 2-furanyl, 4-piperidinyl, 8-quinolyl, 5-quinolyl, can be exemplified.

$R^{21}$, $R^{22}$ and $R^{23}$ each preferably represents an alkyl group, an aryl group, an alkoxyl group or an aryloxy group. From the point of the effect of the present invention, it is preferred that one or more of $R^{21}$, $R^{22}$ and $R^{23}$ represent an alkyl group or an aryl group, and it is more preferred that two or more represent an alkyl group or an aryl group. Further, from the point of inexpensive availability, it is preferred that $R^{21}$, $R^{22}$ and $R^{23}$ represent the same group.

The specific examples of the compounds represented by formula (II) are shown below, but the compounds which can be used in the present invention are not limited thereto.

(II-1)

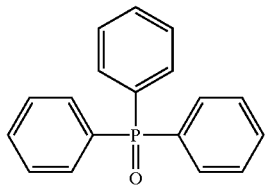

(II-2)

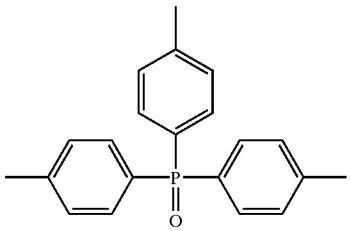

(II-3)

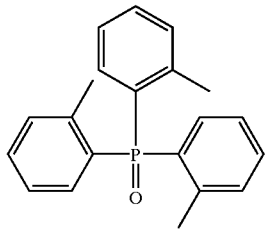

(II-4)

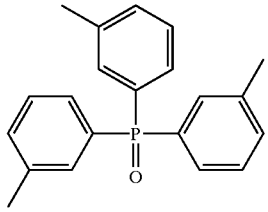

(II-5)

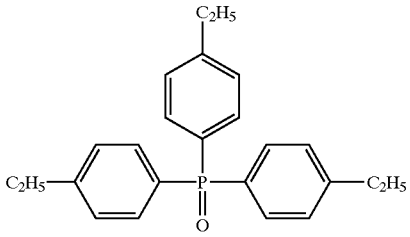

(II-6)

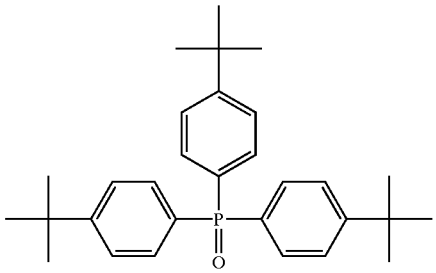

-continued
(II-7)
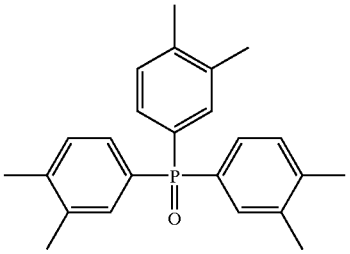
(II-8)
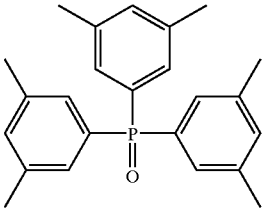
(II-9)
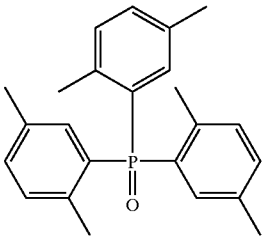
(II-10)
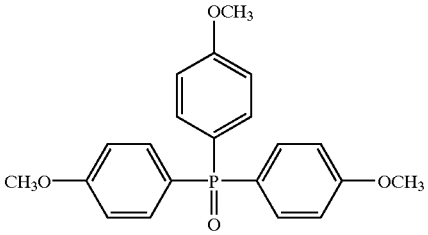
(II-11)
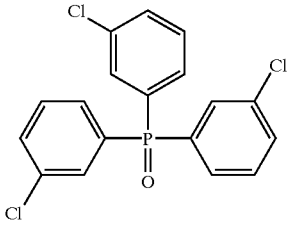
(II-12)
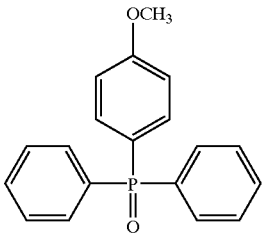
(II-13)
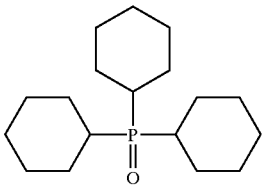
-continued
(II-14)
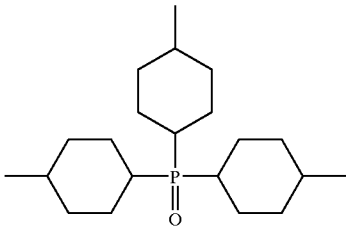
(II-15)
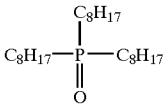
(II-16)
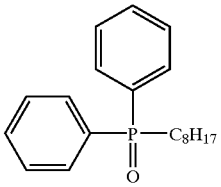
(II-17)
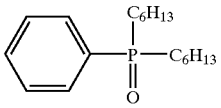
(II-18)
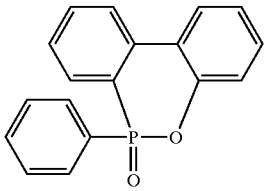
(II-19)
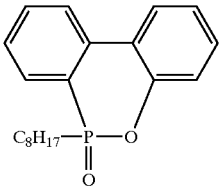
(II-20)
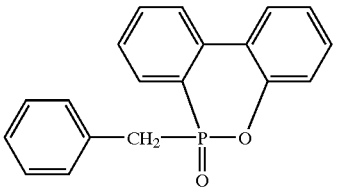
(II-21)
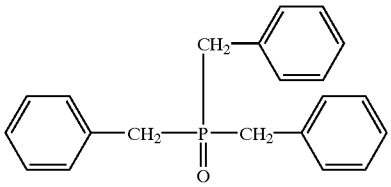

-continued
(II-22)
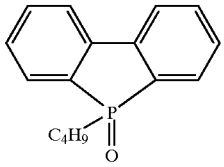
(II-23)
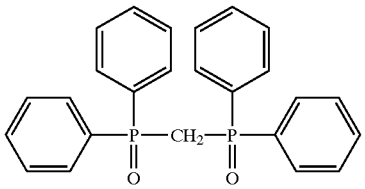
(II-24)
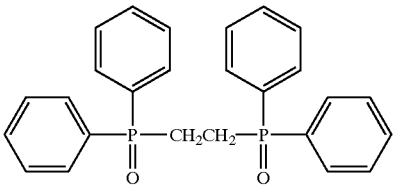
(II-25)
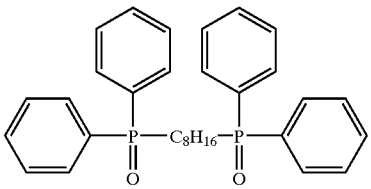
(II-26)
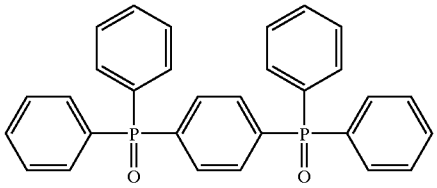
(II-27)
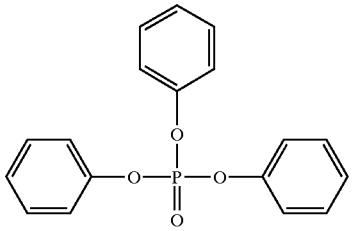
(II-28)
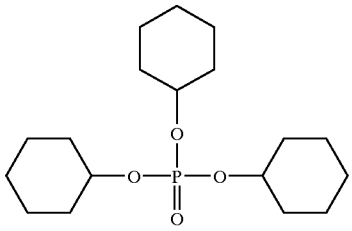
-continued
(II-29)
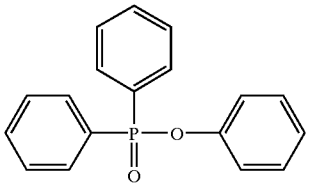
(II-30)
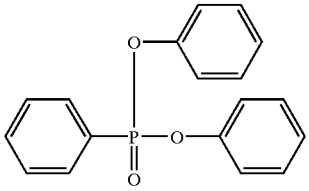
(II-31)
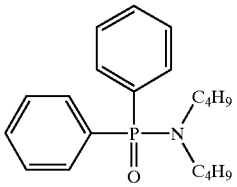
(II-32)
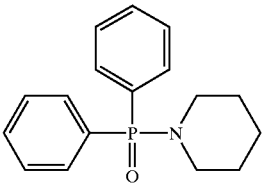
(II-33)
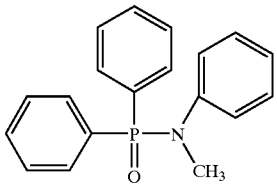
(II-34)
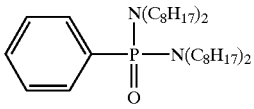
(II-35)
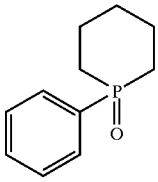
(II-36)
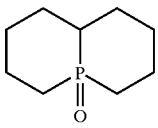

-continued (II-37)

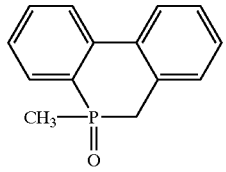

(II-38)

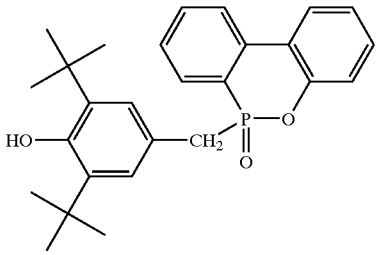

(II-39)

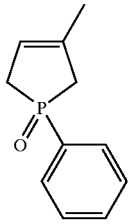

(II-40)

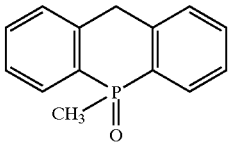

The hydrogen-bonding compound for use in the present invention is contained in a coating solution in a form of, e.g., a solution, an emulsified dispersion, or a solid fine particle dispersion, and added to a photothermographic image-recording material the same as the reducing agent. Since the hydrogen-bonding compound for use in the present invention in a state of a solution forms a hydrogen-bonding complex with a compound having a phenolic hydroxyl group or an amino group, it can be isolated as a complex in a crystal state by certain combination with a reducing agent. It is particularly preferred to use such an isolated crystal powder of a complex as a solid fine particle dispersion for obtaining stable performance. A method of mixing a reducing agent and a hydrogen-bonding complex as powders and forming a complex by dispersion in a sand grinder mill, etc., with a proper dispersant is also preferably used in the present invention.

The hydrogen-bonding compound is used in an amount of preferably from 1 to 200 mol %, more preferably from 10 to 150 mol %, and still more preferably from 30 to 100 mol %, based on the reducing agent.

An organic halogen compound represented by the following formula (III) is used in the photothermographic image-recording material of the present invention for preventing fog:

$$Q—(Y)_n—C(Z^1)(Z^2)X \quad \text{(III)}$$

wherein Q represents an alkyl group, an aryl group or a heterocyclic group, each of which may have a substituent.

The alkyl group represented by Q in formula (III) is a straight chain, branched or cyclic alkyl group preferably having from 1 to 20, more preferably from 1 to 12, and particularly preferably from 1 to 6, carbon atoms (e.g., methyl, ethyl, allyl, n-propyl, isopropyl, sec-butyl, isobutyl, tert-butyl, sec-pentyl, isopentyl, tert-pentyl, tert-octyl, 1-methylcyclohexyl). The alkyl group is preferably a tertiary alkyl group.

The alkyl group represented by Q may have a substituent, and the substituent may be any group so long as the photographic performance is not affected, e.g., a halogen atom (e.g., fluorine, chlorine, bromine, iodine) an alkyl group, an alkenyl group, an alkynyl group, an aryl group, a heterocyclic group (including an N-substituted nitrogen-containing heterocyclic group, e.g., morpholino), an alkoxycarbonyl group, an aryloxycarbonyl group, a carbamoyl group, an imino group, an imino group substituted with an N atom, a thiocarbonyl group, a carbazoyl group, a cyano group, a thiocarbamoyl group, an alkoxyl group, an aryloxy group, a heterocyclic oxy group, an acyloxy group, an alkoxycarbonyloxy group, an aryloxycarbonyloxy group, a sulfonyloxy group, an acylamido group, a sulfonamido group, a uredio group, a thioureido group, an imido group, an alkoxycarbonylamino group, an aryloxycarbonylamino group, a sulfamoylamino group, a semicarbazido group, a thiosemicarbazido group, an alkylsulfonylureido group, an arylsulfonylureido group, a nitro group, an alkylsulfonyl group, an arylsulfonyl group, a sulfamoyl group, a group containing phosphoric acid amide or phosphoric ester structure, a silyl group, a carboxyl group or a salt of it, a sulfo group or a salt of it, a phosphoric acid group, a hydroxyl group, and a quaternary ammonium group can be exemplified. These substituents may be further substituted with these substituents.

In formula (III), the aryl group represented by Q is a monocyclic or condensed aryl group preferably having from 6 to 20, more preferably from 6 to 16, and particularly preferably from 6 to 10, carbon atoms. The aryl group is preferably a phenyl group or a naphthyl group.

The aryl group represented by Q may have a substituent, and the substituent may be any group so long as the photographic performance is not affected, e.g., the groups exemplified above as the substituents of the alkyl group can be used as the substituents of the aryl group.

The heterocyclic group represented by Q in formula (III) is preferably a 5- or 7-membered saturated or unsaturated monocyclic or condensed ring in which the heterocyclic ring contains one or more hetero atom(s) selected from the group consisting of a nitrogen atom, an oxygen atom and a sulfur atom. The examples of the heterocyclic rings include preferably pyridine, quinoline, isoquinoline, pyrimidine, pyrazine, pyridazine, phthalazine, triazine, furan, thiophene, pyrrole, oxazole, benzoxazole, thiazole, benzothiazole, imidazole, benzimidazole, thiadiazole, and triazole, more preferably pyridine, quinoline, pyrimidine, thiadiazole, and benzothiazole, and particularly preferably pyridine, quinoline and pyrimidine.

The heterocyclic group represented by Q may have a substituent, e.g., the groups exemplified above as the substituents of the alkyl group represented by Q can be exemplified as the substituents of the heterocyclic group.

Q is preferably a phenyl group, a naphthyl group, a quinolyl group, a pyridyl group, a pyrimidyl group, a thiadiazolyl group, or a benzothiazolyl group, and particularly preferably a phenyl group, a naphthyl group, a quinolyl group, a pyridyl group, or a pyrimidyl group.

The substituents of Q may have a ballast group which is used for reducing diffusibility in a photographic material or a group which gives the adsorptivity to a silver salt or water solubility, the substituents may form a polymer by polymerizing with each other, or the substituents may be bonded to each other to form a bis type, a tris type or a tetrakis type group.

In formula (III), Y represents a divalent linking group, preferably —$SO_2$—, —SO— or —CO—, and particularly preferably —$SO_2$—.

In formula (III), n represents 0 or 1, preferably 1.

$Z^1$ and $Z^2$ in formula (III) each represents a halogen atom (e.g., fluorine, chlorine, bromine, iodine), and most preferably $Z^1$ and $Z^2$ each represents a bromine atom.

In formula (III) X represents a hydrogen atom or an electron attractive group. The electron attractive group represented by X is a substituent capable of having the Hammett's substituent constant $\sigma_p$ value of a positive value, specifically a cyano group, an alkoxycarbonyl group, an aryloxycarbonyl group, a carbamoyl group, a sulfamoyl group, an alkylsulfonyl group, an arylsulfonyl group, a halogen atom, an acyl group, and a heterocyclic group can be exemplified. X preferably represents a hydrogen atom or a halogen atom, most preferably a bromine atom.

As the polyhalogen compound represented by formula (III), the compounds disclosed in U.S. Pat. Nos. 3,874,946, 4,756,999, 5,340,712, 5,369,000, 5,464,737, JP-A-50-137126, JP-A-50-89020, JP-A-50-119624, JP-A-59-57234, JP-A-7-2781, JP-A-7-5621, JP-A-9-160164, JP-A-10-197988, JP-A-9-244177, JP-A-9-244178, JP-A-9-160167, JP-A-9-319022, JP-A-9-258367, JP-A-9-265150, JP-A-9-319022, JP-A-10-197989, J-A-11-242304, Japanese Patent Application Nos. 10-181459, 10-292864, 11-90095, 11-89773, and 11-205330 can be exemplified.

The specific examples of the polyhalogen compounds represented by formula (III) are shown below, but the compounds which can be used in the present invention are not limited thereto.

(P-1)

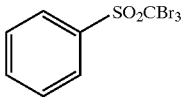

(P-2)

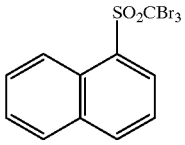

(P-3)

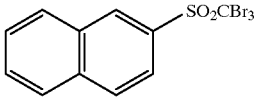

(P-4)

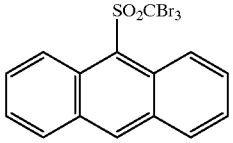

(P-5)

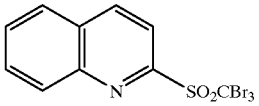

-continued (P-6)

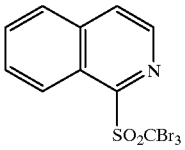

(P-7)

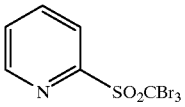

(P-8)

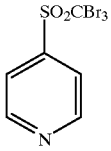

(P-9)

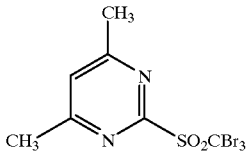

(P-10)

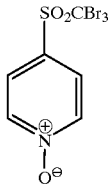

(P-11)

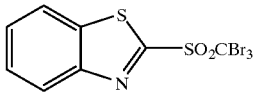

(P-12)

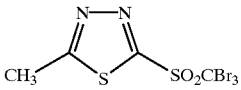

(P-13)

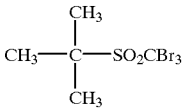

(P-14)

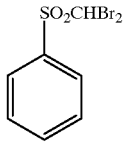

(P-15)

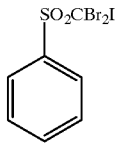

-continued
(P-16)
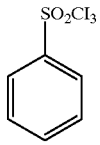
(P-17)
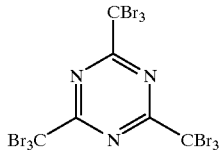
(P-18)
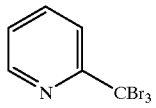
(P-19)
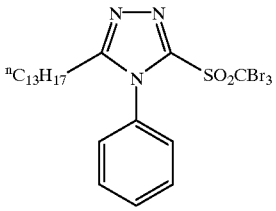
(P-20)
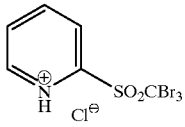
(P-21)
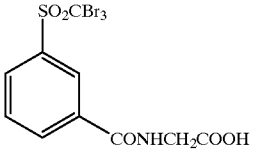
(P-22)
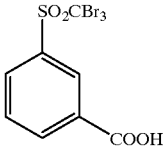
(P-23)
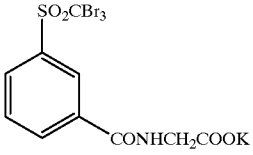
(P-24)
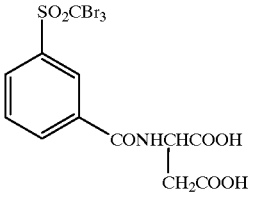
-continued
(P-25)
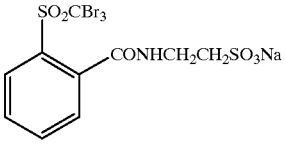
(P-26)
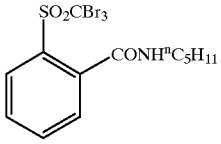
(P-27)
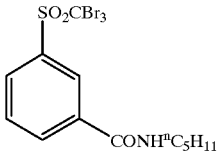
(P-28)
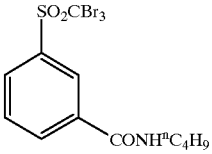
(P-29)
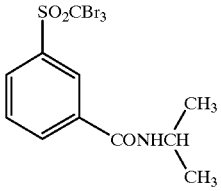
(P-30)
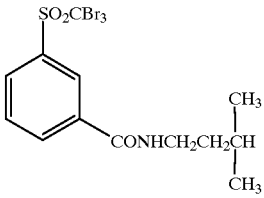
(P-31)
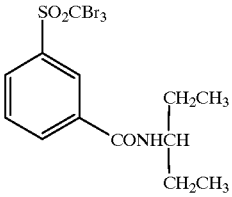
(P-32)
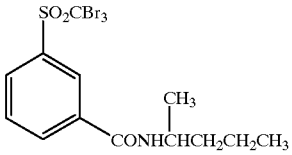

-continued (P-33)

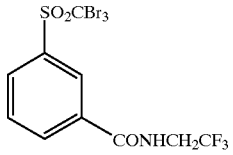

(P-34)

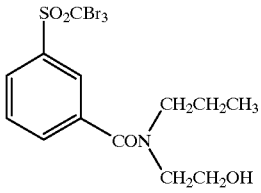

(P-35)

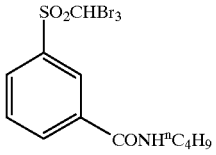

(P-36)

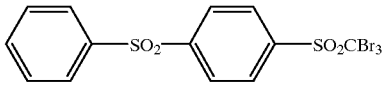

(P-37)

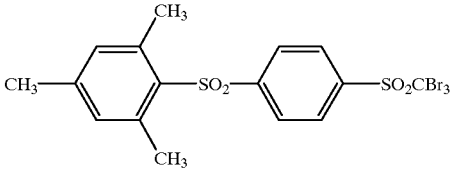

(P-38)

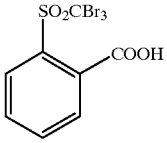

(P-39)

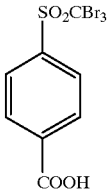

(P-40)

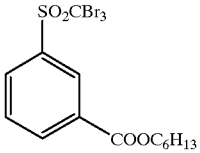

(P-41)

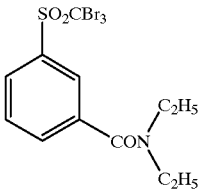

(P-42)

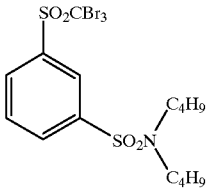

-continued (P-43)

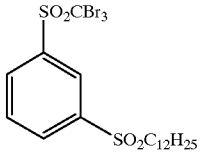

(P-44)

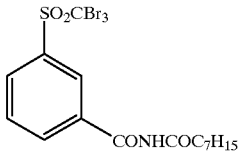

(P-45)

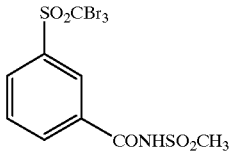

The polyhalogen compounds represented by formula (III) may be used alone or in combination of two or more of them. The use amount of the polyhalogen compound is preferably from $1\times10^{-6}$ to $1\times10^{-2}$ *mol/m2*, more preferably from $1\times10^{-5}$ to $5\times10^{-3}$ mol/m$^2$, and still more preferably from $2\times10^{-5}$ to $1\times10^{-3}$ mol/m$^2$, as the coating amount per m$^2$ of the photothermographic image-recording material.

The polyhalogen compounds represented by formula (III) may be added to any layer on the side of the support on which an image-forming layer is provided, that is, the image-forming layer and any layer on the same side with the image-forming layer, but is preferably added to the image-forming layer or layers contiguous to the image-forming layer.

The polyhalogen compounds represented by formula (III) can be used by being dissolved in water or an appropriate organic solvent, e.g., alcohols (e.g., methanol, ethanol, propanol, fluorinated alcohol), ketones (e.g., acetone, methyl ethyl ketone, methyl isobutyl ketone), dimethylformamide, dimethyl sulfoxide or methyl cellosolve, or they can be used by being dissolved according to well-known emulsifying dispersing method using oils, e.g., dibutyl phthalate, tricresyl phosphate, glyceryl triacetate or diethyl phthalate, and auxiliary solvents, e.g., ethyl acetate or cyclohexanone, and mechanically producing an emulsified dispersion. Alternatively, they can be used as a dispersion produced by a solid dispersing method of dispersing the powder of polyhalogen compounds in water by means of a ball mill, a colloid mill, a sand grinder mill, Manton Gaulin, microfluidizer, or ultrasonic wave.

In the present invention, it is preferred to use an electron donative compound in combination. The electron donative compound for use in the present invention is a compound which contains an atomic group having a lone pair in the molecule, e.g., a compound having an atomic group which can cause hydrogen-bonding with the group having an H atom capable of hydrogen-bonding, such as an N—H bond, an O—H bond or an S—H bond.

Specifically, an amido group, a ureido group, a carbonyl group, an imido group, a sulfoxido group, a phosphoryl group, an amino group or a heterocyclic group each of which is substituted with an alkyl, aryl or heterocyclic group can be exemplified.

A compound having a phosphoryl group is more preferred and phosphine oxides are particularly preferred.

Specifically, triphenylphosphine oxide, tri(4-methyl-phenyl) phosphine oxide, tri(4-methoxyphenyl)phosphine oxide, tri (tert-butylphenyl)phosphine oxide, tri(3-methylphenyl) phosphine oxide, and trioctylphosphine oxide can be exemplified.

The electron donative group according to the present invention can be incorporated into the photothermographic image-recording material in the same manner as in the reducing agent and the polyhalogen compound.

For providing a preferred image, it is necessary that the maximum image density of the photothermographic image-recording material of the present invention measured in terms of visual density fitted to the spectral sensitivity of the eye of human being should be 3.0 or more, more preferably 3.3 or more, and still more preferably 3.5 or more.

In the present invention, when a fatty acid silver salt-containing layer is formed by coating and drying a coating solution in which 30 wt % or more of the solvent is occupied by water, and further when a polymer latex which is soluble or dispersible in a water base solvent (water solvent) and, in particular, having an equilibrium moisture content at 25° C. 60% RH of 2 wt % or less is used as the binder of the fatty acid silver salt-containing layer, the effect of the present invention is improved. The most preferred polymer of the present invention is a polymer so prepared that ionic conductivity becomes 2.5 mS/cm or less. Such a polymer can be produced by a method of purification processing the polymer synthesized using a separating function film.

A water base solvent in which the above polymer is soluble or dispersible as used herein is water or water mixed with a water-miscible organic solvent in concentration of 70 wt % or less. As the water-miscible organic solvent, alcohols such as methyl alcohol, ethyl alcohol, and propyl alcohol, cellosolves such as methyl cellosolve, ethyl cellosolve, and butyl cellosolve, ethyl acetate and dimethylformamide can be exemplified.

The system of a so-called dispersing state in which a polymer is not dissolved thermodynamically is also called a water base solvent in the present invention.

"An equilibrium moisture content at 25° C. 60% RH" used in the present invention can be represented as follows with the weight of the polymer in humidity condition equilibrium at 25° C. 60% RH being $W^1$ and the weight of the polymer at 25° C. dry state being $W^0$:

An equilibrium moisture content at 25° C. 60% RH=

$$[(W^1-W^0)/W^0]\times 100 \text{ (wt \%)}$$

As for the definition and the measuring method of a moisture content, e.g., *High Polymer Engineering, Lecture* 14, "Test Method of Polymeric Materials", compiled by Kobunshi-Gakkai, published by Chijin Shokan Co. Ltd. can be referred to.

The equilibrium moisture content at 25° C. 60% RH of the binder polymer according to the present invention is preferably 2 wt % or less, more preferably from 0.01 to 1.5 wt %, and still more preferably from 0.02 to 1 wt %.

Polymers which are dispersible in a water base solvent are particularly preferably used in the present invention.

As the examples of dispersion states, there are latexes in which fine particles of solid polymers are dispersed and dispersions in which polymer molecules are dispersed in a molecular state or with forming micells, and any of these can be preferably used.

Hydrophobic polymers such as an acrylic resin, a polyester resin, a rubber-based resin (e.g., an SBR resin), a polyurethane resin, a vinyl chloride resin, a vinyl acetate resin, a vinylidene chloride resin, and a polyolefin resin can be preferably used in the present invention. Polymers may be straight chain, branched or crosslinked polymers. As polymers, any of homopolymers in which single monomers are polymerized and copolymers in which two or more monomers are copolymerized can be used. When copolymers are used, both of random copolymers and block copolymers can be used. The molecular weight of polymers is from 5,000 to 1,000,000, preferably from 10,000 to 200,000, in number average molecular weight. If the molecular weight is too small, the dynamic strength of the emulsion layer is insufficient, while when it is too large, the film property is disadvantageously deteriorated.

The binder polymers according to the present invention preferably have Tg of from −20° C. to 80° C., more preferably from 0° C. to 70° C., and still more preferably from 10° C. to 60° C., in view of film-forming property and image storing stability. Two or more kinds of polymers can be mixed as the binder, and in such a case, it is preferred to select the composition so that weighted average Tg be in the above range. In the case of phase separation or core/shell structure, it is preferred that the Tg of each phase becomes within the above range.

"A water base solvent" described above means a dispersion medium in which 30 wt % or more of the composition is occupied by water. As dispersion states, any of emulsified dispersion, micell dispersion, and dispersion in which polymers having hydrophilic parts in the molecule are dispersed in a molecular state can be used but latexes are particularly preferably used.

The specific examples of preferred polymer latexes are shown below. In the following, polymers are indicated as starting material monomers, the numerical values in parentheses are wt % and the molecular weights are number average molecular weights.

P-1: Latex comprising -MMA(70)-EA(27)-MAA(3)- (molecular weight: 37,000)

P-2: Latex comprising -MMA(70)-2EHA(20)-St(5)-AA(5)- (molecular weight: 40,000)

P-3: Latex comprising -St(50)-Bu(47)-MAA(3)- (molecular weight: 45,000)

P-4: Latex comprising -St(68)-Bu(29)-AA(3)- (molecular weight: 60,000)

P-5: Latex comprising -St(71)-Bu(26)-AA(3)- (molecular weight: 60,000)

P-6: Latex comprising -St(70)-Bu(27)-IA(3)- (molecular weight: 120,000)

P-7: Latex comprising -St(75)-Bu(24)-AA(1)- (molecular weight: 108,000)

P-8: Latex comprising -St(60)-Bu(35)-DVB(3)-MAA(2)- (molecular weight: 150,000)

P-9: Latex comprising -St(70)-Bu(25)-DVB(2)-AA(3)- (molecular weight: 280,000)

P-10: Latex comprising -VC(50)-MMA(20)-EA(20)-AN (5)-AA(5)- (molecular weight: 80,000)

P-11: Latex comprising -VDC(85)-MMA(5)-EA(5)-MAA (5)- (molecular weight: 67,000)

P-12: Latex comprising -Et(90)-MAA(10)- (molecular weight: 12,000)

P-13: Latex comprising -St(70)-2EHA(27)-AA(3)- (molecular weight: 130,000)

P-14: Latex comprising -MMA(63)-EA(35)-AA(2)- (molecular weight: 33,000)

Abbreviations in the above show the following monomers. MMA: methyl methacrylate, EA: ethyl acrylate, MAA: methacrylic acid, 2EHA: 2-ethylhexyl acrylate, St: styrene, Bu: butadiene, AA: acrylic acid, DVB: divinylbenzene, VC: vinyl chloride, AN: acrylonitrile, VDC: vinylidene chloride, Et: ethylene, and IA: itaconic acid.

The above-described polymers are commercially available and the following polymers can be used. As examples of acrylic resins, Sebian A-4635, 46583, and 4601 (manufactured by Daicel Chemical Industries Ltd.), Nipol Lx811, 814, 821, 820, and 857 (manufactured by Nippon Zeon Co., Ltd.), as examples of polyester resins, FINETEX ES650, 611, 675, and 850 (manufactured by Dainippon Ink & Chemicals, Inc.), WD-size and WMS (manufactured by Eastman Chemical Co.), as examples of polyurethane resins, HYDRAN AP10, 20, 30, and 40 (manufactured by Dainippon Ink & Chemicals, Inc.), as examples of rubber-based resins, LACSTAR 7310K, 3307B, 4700H, and 7132C (manufactured by Dainippon Ink & Chemicals, Inc.), Nipol Lx416, 410, 438C, and 2507 (manufactured by Nippon Zeon Co., Ltd.), as examples of vinyl chloride resins, G351 and G576 (manufactured by Nippon Zeon Co., Ltd.), as examples of vinylidene chloride resins, L502 and L513 (manufactured by Asahi Kasei Corporation), and as examples of olefin resins, Chemipearl S120 and SA100 (manufactured by Mitsui Petrochemical Industries, Ltd.) can be exemplified.

These polymer latexes may be used alone or two or more of them may be blended, if necessary.

Styrene/butadiene copolymer latexes are particularly preferably used as the polymer latexes in the present invention. The weight ratio of the styrene monomer unit and the butadiene monomer unit in styrene/butadiene copolymers is preferably from 40/60 to 95/5. The ratio occupied by the styrene monomer unit and the butadiene monomer unit in the copolymer is preferably from 60 to 99 wt %. The preferred molecular weight is the same as described above.

Preferred styrene/butadiene copolymer latexes which can be used in the present invention are the foregoing P-3 to P-9 and commercially available products LACSTAR-3307B, 7132C and Nipol Lx416.

The latexes for use in the present invention have a glass transition temperature (Tg) of preferably from 10° C. to 80° C., more preferably from 20° C. to 60° C. When two or more latexes having different Tg are used as mixture, it is preferred that the weight average Tg is in the above range.

Hydrophilic polymers such as gelatin, polyvinyl alcohol, methyl cellulose, and hydroxypropyl cellulose may be added to the fatty acid silver salt-containing layer of the photothermographic image-recording material of the present invention, according to necessity. The addition amount of these hydrophilic polymers is preferably 30 wt % or less, more preferably 20 wt % or less, based on the total amount of the binder of the fatty acid silver salt-containing layer.

The total amount of the binder in the image-forming layer according to the present invention is preferably from 0.2 to 30 g/m$^2$, more preferably from 1 to 15 g/m$^2$. The image-forming layer of the present invention may contain a crosslinking agent for crosslinking and a surfactant for improving coating property.

In the photothermographic image-recording material according to the present invention, the ratio of the solid content weight/fatty acid silver weight of the aqueous latex in the photosensitive layer of the photothermographic image-recording material is preferably from 1.0 to 2.5, more preferably from 1.3 to 2. If the weight ratio is smaller than this value, film-forming hindrance occurs, while when larger than this value, the image storage stability against heat and light is deteriorated.

In the photothermographic image-recording material according to the present invention, the aqueous latex weight/fatty acid silver weight×Tg of the aqueous latex in the photosensitive layer of the photothermographic image-recording material is preferably from 30 to 120. When this value is smaller than 30 or larger than 120, film-forming hindrance occurs.

The solvent for the coating solution of the fatty acid silver salt-containing layer of the photothermographic image-recording material of the present invention (solvent and dispersion medium are briefly expressed as solvent collectively) is a water base solvent containing 30 wt % or more of water. As components other than water, water-miscible organic solvents such as methyl alcohol, ethyl alcohol, isopropyl alcohol, methyl cellosolve, ethyl cellosolve, dimethylformamide and ethyl acetate may be arbitrarily used in the coating solution. The water content in the solvent of the coating solution is preferably 50 wt % or more, more preferably 70 wt % or more. Preferred examples of the compositions of the solvent include, in addition to water, water/methyl alcohol=90/10 (wt %, hereinafter the same), water/methyl alcohol=70/30, water/methyl alcohol/dimethylformamide=80/15/5, water/methyl alcohol/ethyl cellosolve=85/10/5, water/methyl alcohol/isopropyl alcohol=85/10/5, etc.

The antifoggants, stabilizers and stabilizer precursors which can be used in the present invention are disclosed in the paragraph [0070] of JP-A-10-62899, and line 57, page 20 to line 7, page 21 of EP-A-0803764. Further, the antifoggants which are preferably used in the present invention are organic halogen compounds, and they are disclosed in the patents exemplified in paragraphs [0111] and [0112] of JP-A-11-65021. The organic polyhalogen compounds represented by formula (II) disclosed in JP-A-10-339934 (specifically, tribromomethylnaphthylsulfone, tribromomethylphenylsulfone, tribromomethylpyridylsulfone, tribromomethylquinolylsulfone, tribromomethyl [4-(2,4,6-trimethylphenylsulfonyl)phenyl]sulfone, tribromomethyl [3-(butylcarbamoyl)phenyl]sulfone, etc.) are preferably used.

The antifoggants of the present invention can be added to the photothermographic image-recording material in the same manner as the addition method of the reducing agent, and the organic polyhalogen compound is also preferably added as the solid fine particle dispersion.

As the other antifoggants, the mercury(II) salts disclosed in paragraph [0113] of JP-A-11-65021 and the benzoic acids disclosed in paragraph [0114] of the same patent can be exemplified.

The photothermographic image-recording material according to the present invention may contain azolium salts for the purpose of preventing fog. As azolium salts which can be used in the present invention, the compounds represented by formula (XI) in JP-A-59-193447, the compounds disclosed in JP-B-55-12581 (the term "JP-B" as used herein means an "examined Japanese patent publication"), and the compounds represented by formula (II) in JP-A-60-153039 can be exemplified. Azolium salts can be added to anywhere of the photothermographic image-recording material, but they are preferably added to the layers on the side on which an image-forming layer is provided, more preferably added to the layer containing a fatty acid silver salt. The azolium salts may be added at any stage of the preparation of the coating solution. When they are added to the fatty acid silver salt-containing layer, they may be added at any stage from the preparation stage of the fatty acid silver salt to the preparation stage of the coating solution, but preferably they are added to the coating solution after preparation of the fatty acid silver salt and just before coating. Azolium salts may be added in the form of, e.g., a powder, a solution, or a solid fine particle dispersion. They may be added as the mixed solution with other additives such as sensitizing dyes, reducing agents and toners. The addition amount of the azolium salts may be any amount, but is preferably from $1\times10^{-6}$ to 2 mol, more preferably from $1\times10^{-3}$ to 0.5 mol, per mol of the silver.

The photothermographic image-recording material of the present invention can contain a mercapto compound, a disulfide compound and a thione compound for the purpose of controlling or accelerating development, improving spectral sensitization efficiency and improving storage stability before and after development. A mercapto compound, a disulfide compound and a thione compound are disclosed in JP-A-10-62899 (paragraphs [0067] to [0069]), JP-A-10-186572 (the compound represented by formula (I), and the specific examples of them are described in paragraphs [0033] to [0052]), and lines 36 to 56 on page 20 of EP-A-0803764.

A toner is preferably used in the present invention. The toners as disclosed in JP-A-10-62899 (paragraphs [0054] and [0055]), and lines 23 to 48 on page 21 of EP-A-0803764, and phthalazinone, phthalazinone derivatives or metal salts of them, or derivatives such as 4-(1-naphthyl) phthalazinone, 6-chlorophthalazinone, 5,7-dimethoxyphthalazinone, and 2,3-dihydro-1,4-phthalazinedinone; combinations of phthalazinone and phthalic acid derivatives (e.g., phthalic acid, 4-methylphthalic acid, 4-nitrophthalic acid, and tetrachlorophthalic anhydride); phthalazines (e.g., phthalazine, phthalazine derivatives or metal salts of them, or derivatives such as 4-(1-naphthyl)phthalazine, 6-isopropylphthalazine, 6-t-butylphthalazine, 6-chlorophthalazine, 5,7-dimethoxyphthalazine, and 2,3-dihydrophthalazine); and combinations of phthalazines and phthalic acid derivatives (e.g., phthalic acid, 4-methylphthalic acid, 4-nitrophthalic acid, and tetrachlorophthalic anhydride) are preferably used, and the combinations of phthalazines and phthalic acid derivatives are particularly preferably used.

Various kinds of image stabilizers can be used for stabilizing the image of the photothermographic image-recording material of the present invention. An electron donative compound, such as a phosphoryl compound, a sulfoxide, an amide compound, an aniline-based compound, and a pyridine-based compound are preferred, and a compound having a phosphoryl group is more preferred and phosphine oxides are most preferred. Specifically, triphenylphosphine oxide, triparatoluylphosphine oxide, tri(4-methoxyphenyl) phosphine oxide, and trioctylphosphine oxide can be exemplified.

Plasticizers and lubricants which can be used in the image-recording layer are disclosed in JP-A-11-65021 (paragraph [0117]), super-high contrast agents to form a super-high contrast image are disclosed in JP-A-11-65021 (paragraph [0118]), and Japanese Patent Application No. 11-91652 (a compound represented by formula (III), (IV) or (V), specific examples are Compounds 21 to 24), and high contrast accelerators are disclosed in JP-A-11-65021 (paragraph [0102]).

The photothermographic image-recording material according to the present invention can be provided with a surface protective layer for the purpose of preventing adhesion on the image-forming layer. The surface protective layer is disclosed in JP-A-11-60521 (paragraphs [0119] and [0120]).

Gelatin is preferably used as the binder of the surface protective layer but it is also preferred to use polyvinyl alcohol (PVA), for example, as a completely saponified product, PVA-105 [polyvinyl alcohol (PVA) content: 94.0 wt % or more, saponification degree: 98.5±0.5 mol %, sodium acetate content: 1.5 wt % or less, volatile content: 5.0 wt % or less, viscosity (4 wt %, 20° C.): 5.6±0.4 CPS], as a partially saponified product, PVA-205 [PVA content: 94.0 wt %, saponification degree: 88.0±1.5 mol %, sodium acetate content: 1.0 wt %, volatile content: 5.0 wt %, viscosity (4 wt %, 20° C.): 5.0±0.4 CPS], and modified polyvinyl alcohol MP-102, MP-202, MP-203, R-1130, and R-2105 (manufactured by Kuraray Co., Ltd.) can be exemplified. The coating amount of polyvinyl alcohol of the protective layer (per one layer) is preferably from 0.3 to 4.0 $g/m^2$, more preferably from 0.3 to 2.0 $g/m^2$, per $m^2$ of the support.

As the binder of the surface protective layer, styrene-containing elastomeric block copolymers (e.g., styrene-butadiene-styrene, styrene-isoprene-styrene), cellulose acetate, cellulose acetate butyrate and cellulose propionate can also be used.

The coating solution of the image-forming layer of the present invention is preferably prepared at temperature of from 30° C. to 65° C., more preferably from 35° C. to less than 60° C., and still more preferably from 35° C. to 55° C. Further, the temperature of the image-forming layer-coating solution immediately after the addition of a polymer latex is preferably maintained at from 30° C. to 65° C. It is preferred that a reducing agent and a fatty acid silver salt have been mixed before a polymer latex is added.

The liquid containing the fatty acid silver salt or the coating solution of the photothermographic image-forming layer according to the present invention is preferably a so-called thixotropic liquid. Thixotropy is the property which lowers in viscosity as the shear rate increases. Any test apparatus can be used in the viscosity measurement in the present invention. RFS Fluid Spectrometer manufactured by Rheometrics Far East Co. is preferably used. Measurement is performed at 25° C. The viscosity at the shear rate of 0.1 $S^{-1}$ of the liquid containing the fatty acid silver salt or the coating solution of the photothermographic image-forming layer according to the present invention is preferably from 400 mPa·s to 100,000 mPa·s, more preferably from 500 mPa·s to 20,000 mPa·s. The viscosity at shear rate of 1,000 $S^{-1}$ is preferably from 1 mPa·s to 200 mPa·s, more preferably from 5 mPa·s to 80 mPa·s.

Various systems exhibiting thixotropy are known and described, for example, in *Koza Rheology* (*Lecture, Rheology*), compiled by Kobunshi Kanko Kai, Muroi, Morino, *Kobunshi Latexes* (*High Molecular Latexes*), published by Kobunshi Kanko Kai. It is necessary for liquid to contain a large amount of solid fine particles to exhibit thixotropy. For heightening thixotropy, viscosity-increasing linear high molecules must be contained, and it is effective that solid fine particles contained have a large aspect ratio anisotropically, in addition, the use of alkali thickeners and surfactants is also effective.

The emulsion layer of the photothermographic material according to the present invention comprises one or more layers on a support. One layer constitution must contain a fatty acid silver salt, a silver halide, a developer, and a binder, in addition to these, desired additional materials, e.g., a toner, a covering aid, and other auxiliary agents. Two layer constitution must contain a fatty acid silver salt and a silver halide in the first emulsion layer (generally the layer contiguous to the support), and other several components in the second emulsion layer, or in both the first and second layers. However, there is another two layer constitution comprising a single emulsion layer containing all the components and a protective top coating layer. In the constitution of a multi-color heat-developable photographic material, each color may comprise a combination of these two layers. Alternatively, as disclosed in U.S. Pat. No. 4,708,928, a single layer may contain all the components. In the case of a multi-dye multi-color heat-developable photographic material, in general, a functional or non-functional barrier layer is provided between each image-forming layer to separate and retain each image-forming layer as disclosed in U.S. Pat. No. 4,460,681.

Various kinds of dyes and pigments can be used in the image-forming layer of the present invention with a view to improving tone, preventing generation of interference fringe by laser exposure, and preventing irradiation, which are disclosed in detail in WO 98/36322. As preferred dyes and pigments for use in the image-forming layer according to the present invention, anthraquinone dyes, azomethine dyes, indoaniline dyes, azo dyes, anthraquinone-based indanthrone pigments (e.g., C.I. Pigment Blue 60), phthalocyanine pigments (e.g., copper phthalocyanine such as C.I. Pigment Blue 15, nonmetal phthalocyanine such as C.I. Pigment Blue 16), dyeing lake pigment-based triarylcarbonyl pigments, indigo, and inorganic pigments (e.g., ultramarine blue, cobalt blue) can be exemplified. These dyes and pigments may be added in the form of, e.g., a solution, an emulsion, a solid fine particle dispersion, or in the state mordanted by a high molecular weight mordanting agent. The amount of these compounds is determined by the desired absorbing amount, but generally from 1 $\mu$g to 1 g per $m^2$ of the photothermographic image-recording material is preferred.

In the present invention, an antihalation layer can be provided farther than the image-forming layer from the light source. Antihalation layers are disclosed in paragraphs [0123] and [0124] of JP-A-11-65021.

It is preferred in the present invention that a decoloring dye and a base precursor are added to the photo-insensitive layer of the photothermographic image-recording material to make the photo-insensitive layer function as a filter layer or an antihalation layer. A photothermographic material generally has photoinsensitive layers in addition to photosensitive layers. Photo-insensitive layers can be classified from the arrangement to (1) a protective layer provided on a photosensitive layer (farther side from the support), (2) intermediate layers provided between a plurality of photosensitive layers or between a photosensitive layer and a protective layer, (3) an undercoat layer provided between a photosensitive layer and a support, and (4) a backing layer provided on the opposite side to a photosensitive layer. A filter layer is provided in the photothermographic material as a layer of (1) or (2). An antihalation layer is provided in the photographic material as a layer of (3) or (4).

A decoloring dye and a base precursor are preferably added to the same photo-insensitive layer but they may be added to two adjacent photo-insensitive layers separately. Further, a barrier layer may be provided between two photo-insensitive layers.

A decoloring dye can be added to the coating solution of the photo-insensitive layer as a solution, an emulsion, a solid fine particle dispersion, or a polymer impregnated product. A dye can also be added to the photo-insensitive layer using a polymer mordant. These addition methods are the same as the methods employed for adding dyes to general photothermographic image-recording materials. Latexes for use in polymer impregnated products are disclosed in U.S. Pat. No. 4,199,363, German Patent Publication Nos. 2,541,274 and 2,541,230, EP 029104, and JP-B-53-41091. With respect to the emulsifying method for adding a dye to a solution containing a dissolved polymer is disclosed in WO 88/00723.

The addition amount of a decoloring dye is determined by the use of the dye. In general, a decoloring dye is used in the amount that the optical density (absorbance) when measured at objective wavelength exceeds 0.1, preferably from 0.2 to 2. The addition amount of the dye for obtaining such optical density is in general from about 0.001 to about 1 g/$m^2$, particularly preferably from about 0.01 to about 0.2 g/$m^2$.

Decoloration of dyes results in the reduction of optical density to 0.1 or less. Two or more kinds of decoloring dyes may be used in combination in a thermal-decoloring type recording material or a photothermographic image-recording material. Two or more kinds of base precursors may also be used in combination.

The photothermographic image-recording material according to the present invention is preferably one sided photographic material having at least one photosensitive layer containing a silver halide emulsion on one side of the support and a backing layer on the opposite side of the support.

It is preferred that the photothermographic image-recording material according to the present invention contain matting agents for improving transporting property. Matting agents are disclosed in paragraphs [0126] and [0127] of JP-A-11-65021. The coating amount of the matting agent is preferably from 1 to 400 mg, more preferably from 5 to 300 mg, per $m^2$ of the photothermographic image-recording material.

The matting degree of the emulsion surface is not particularly limited so long as star dust hindrance does not occur, but Bekk second is preferably from 30 to 2,000 seconds, particularly preferably from 40 to 1,500 seconds.

The matting degree of the backing layer according to the present invention is preferably Bekk second of from 10 seconds to 1,200 seconds, more preferably from 20 seconds to 800 seconds, and still more preferably from 40 seconds to 500 seconds.

In the present invention, matting agents are preferably added to the outermost surface layer of the photothermographic image-recording material, the layer which functions as the outermost surface layer, or the layer near the outer surface. They are also preferably added to the layer functioning as a protective layer.

The backing layers which can be used in the present invention are disclosed in paragraphs [0128] to [0130] of JP-A-11-65021.

A hardening agent may be used in each of the image-forming layer, protective layer, and backing layer constituting the photothermographic image-recording material of the present invention. Examples of hardening agents are described in T. H. James, *The Theory of the Photographic Process,* the 4th Ed., pp. 77 to 87, Macmillan Publishing Co., Inc. (1977), and the polyvalent metal ions described on p. 78 of the above literature, the polyisocyanates disclosed in U.S. Pat. No. 4,281,060 and JP-A-6-208193, the epoxy compounds disclosed in U.S. Pat. No. 4,791,042, and the vinyl sulfone compounds disclosed in JP-A-62-89048 are preferably used in the present invention.

The hardening agent is added as a solution. The preferred addition time of the solution to the protective layer coating solution is from 180 minutes before coating to immediately before coating, preferably from 60 minutes before to 10 seconds before coating. The mixing method and the mixing condition are not particularly restricted so long as the effect of the present invention can be sufficiently exhibited. As the specific mixing methods, a method of performing mixture in a tank in such a manner that the average residence time, which is calculated from the addition flow rate and the charging amount to the coater, coincides with the desired time, and a method of using a static mixer and the like as described in N. Harnby, M. F. Edwards, A. W. Nienow, translated by Koji Takahashi, *Liquid Mixing Techniques,* Chap. 8, published by Nikkan Kogyo Shinbun-sha (1989) can be used.

Surfactants which can be used in the present invention are disclosed in paragraph [0132] of JP-A-11-65021, solvents are disclosed in paragraph [0133] of the same patent, supports in paragraph [0134] of the same patent, antistatic agents and electric conductive layers in paragraph [0135] of the same patent, and the methods for obtaining a color image are disclosed in paragraph [0136] of the same patent.

A transparent support may be colored with a bluing dye (e.g., Dye 1 disclosed in the Example of JP-A-8-240877), or may not be colored. The undercoating techniques of the support are disclosed in JP-A-11-84574 and JP-A-10-186565. The antistatic layer and undercoating are disclosed in JP-A-56-143430, JP-A-56-143431, JP-A-58-62646 and JP-A-56-120519, and these techniques can be used in the present invention.

The photothermographic image-recording material according to the present invention is preferably a monosheet type material (a type capable of forming an image on the photothermographic image-recording material not using other sheet, e.g., an image-receiving material).

The photothermographic image-recording material according to the present invention may further contain an antioxidant, a stabilizer, a plasticizer, an ultraviolet absorber, or a coating aid. Various additives are added to either a photosensitive layer or a photo-insensitive layer. With respect to the addition of these additives, WO 98/36322, EP-A-803764, JP-A-10-186567 and JP-A-10-18568 can be referred to.

The photothermographic image-recording material according to the present invention may be coated by any method. Specifically, extrusion coating, slide coating, curtain coating, immersion coating, knife coating, flow coating, and various coating methods including extrusion coating using hoppers disclosed in U.S. Pat. No. 2,681,294 can be used. Extrusion coating and slide coating described in Stephen F. Kistler, Peter M. Schweizer, *Liquid Film Coating,* pp. 399 to 536, Chapman & Hall Co. (1997) are preferably used, particularly slide coating is preferably used. Examples of the shapes of slide coaters for use in slide coating are described in ibid., p. 427, FIG. 11b.1. Two or more layers can be coated simultaneously by the methods described in ibid., pp. 399 to 536, U.S. Pat. No. 2,761,791 and British Patent 837,095, if desired.

With respect to the techniques which can be used in the photothermographic image-recording material according to the present invention, the following patents can also be referred to: EP-A-803764, EP-A-883022, WO 98/36322, JP-A-56-62648, JP-A-58-62644, JP-A-9-281637, JP-A-9-297367, JP-A-9-304869, JP-A-9-311405, JP-A-9-329865, JP-A-10-10669, JP-A-10-62899, JP-A-10-69023, JP-A-10-186568, JP-A-10-90823, JP-A-10-171063, JP-A-10-186565, JP-A-10-186567, JP-A-10-186569 to JP-A-10-186572, JP-A-10-197974, JP-A-10-197982, JP-A-10-197983, JP-A-10-197985 to JP-A-10-197987, JP-A-10-207001, JP-A-10-207004, JP-A-10-221807, JP-A-10-282601, JP-A-10-288823, JP-A-10-288824, JP-A-10-307365, JP-A-10-312038, JP-A-10-339934, JP-A-11-7100, JP-A-11-15105, JP-A-11-24200, JP-A-11-24201, JP-A-11-30832, JP-A-11-84574, JP-A-11-65021, JP-A-11-125880, JP-A-11-129629, JP-A-11-133536 to JP-A-11-133539, JP-A-11-133542 and JP-A-11-133543.

The photothermographic image-recording material according to the present invention can be developed by any method. However, in general, the imagewise exposed photothermographic image-recording material is developed with increasing the temperature. The developing temperature is preferably from 100 to 140° C., more preferably from 110 to 140° C., and still more preferably from 115 to 135° C. The developing time is generally from 1 to 20 seconds, preferably from 2 to 18 seconds, more preferably from 3 to 15 seconds, and particularly preferably from 5 to 12 seconds.

A plate heater system is preferably used as the thermal developing method. The thermal developing method by plate heater systems disclosed in JP-A-11-133572 is preferably used in the present invention, which is the method using a heat developing apparatus to obtain a visible image by making a photothermographic image-recording material, in which a latent image has been formed, contact with a heating means at a heat developing zone. The foregoing heating means comprises a plate heater, and a plurality of pressing rollers arranged along one surface of the plate heater vis-a-vis with the plate heater. Heat development is performed by passing the foregoing photothermographic image-recording material between the above pressing rollers and the plate heater. It is preferred to divide the plate heater to two to six stages and make the temperature of the tip part of the heater low by 1 to 10° C. or so. Such a method is disclosed in JP-A-54-30032, which method is capable of removing the moisture content and the organic solvent contained out of the material, and inhibiting the deformation of the support of the photothermographic image-recording material due to sudden heating of the photothermographic image-recording material.

The photothermographic image-recording material according to the present invention may be exposed according to any method, but laser beams are preferably used as a light source. A gas laser ($Ar^+$, He—Ne), a YAG laser, a dye laser and a semiconductor laser are preferably used as laser beams in the present invention. A semiconductor laser and second harmonic generating element can also be used. A gas or semiconductor laser having red to infrared emission is preferably used.

A single mode laser can be utilized as the laser beam in the present invention, and the techniques disclosed in paragraph [0140] of JP-A-11-65021 can be used in the present invention.

Laser output is preferably 1 mW or more, more preferably 10 mW or more, and still more preferably high output of 40 mW or more. At that time, a plurality of lasers may be gathered together. The diameter of the laser beam can be made about 30 to 200 $\mu$m by Gaussian beam spot size of $1/e^2$.

As the laser imager equipped with an exposure zone and a thermal developing zone, Fuji Medical Dry Laser Imager FM-DPL can be exemplified.

It is preferred that the photothermographic image-recording material of the present invention be used, by forming a black-and-white image by a silver image, as a photothermographic material for medical diagnosis, a photothermographic material for industrial photography, a photothermographic material for printing, and a photothermographic material for COM. When the photothermographic image-recording material is used in these uses, it is a matter of course that as medical diagnosis use, a duplicated image can be made with duplication film MI-Dup (manufactured by Fuji Photo Film Co., Ltd.) from the black-and-white image formed, and as the printing use, the photothermographic image-recording material can be used as a mask for forming image on dot to dot work films DO-175, PDO-100 (manufactured by Fuji Photo Film Co., Ltd.) and an offset printing plate.

The present invention is described in detail with reference to the examples. The materials, use amounts, ratios, processing contents and processing procedures as described in the examples can be arbitrarily changed unless the invention departs the spirit thereof, accordingly the present invention is not limited to the following examples.

EXAMPLE 1

Preparation of Undercoated PET Support

Preparation of PET support

PET having an intrinsic viscosity IV=0.66 (measured in phenol/tetrachloroethane (6/4 by weight) at 25° C.) was obtained according to ordinary method with terephthalic acid and ethylene glycol. After the obtained PET was pelletized and dried at 130° C. for 4 hours, melted at 300° C., extruded from T-die, and suddenly cooled, thereby an unstretched film having a film thickness after thermal fixation of 175 μm was obtained.

The film was stretched to 3.3 times in the machine direction with rollers having different peripheral speeds, then 4.5 times in the transverse direction by means of a tenter. The temperatures at that time were 110° C. and 130° C. respectively. Subsequently, the film was subjected to thermal fixation at 240° C. for 20 seconds, then relaxation by 4% in the transverse direction at the same temperature. The chuck part of the tenter was then slit, and both edges of the film were knurled. The film was wound up at 4 kg/cm$^2$, thereby a roll of film having a thickness of 175 μm was obtained.

Corona Discharge Treatment of Support Surface

Both surfaces of the support were subjected to corona discharge treatment under room temperature at 20 m/min with a solid state corona treating apparatus model 6KVA manufactured by Piller Co. From the reading of electric current and voltage, treatment applied to the support at that time was revealed to be 0.375 kV·A·min/m$^2$. The frequency at treatment at that time was 9.6 kHz and the gap clearance between the electrode and the dielectric roll was 1.6 mm.

Preparation of Undercoated Support (1) Preparation of Coating Solution for Undercoat Layer Prescription (1) (for Undercoat Layer on the Photosensitive Layer Side)

| | |
|---|---|
| Pesresin A-515GB (30 wt % solution, manufactured by Takamatsu Yushi Co., Ltd.) | 234 g |
| Polyethylene glycol monononylphenyl ether (average ethylene oxide number: 8.5, 10 wt % solution) | 21.5 g |
| MP-1000 (polymer fine particles, average particle size: 0.4 μm, manufactured by Soken Kagaku Co. Ltd.) | 0.91 g |
| Distilled water | 744 ml |

Prescription (2) (for First Layer on the Back Surface Side)

| | |
|---|---|
| Butadiene/styrene copolymer latex (solid content: 40 wt %, weight ratio of butadiene/styrene: 32/68) | 158 g |

-continued

| | |
|---|---|
| Sodium 2,4-dichloro-6-hydroxy-s-triazine (8 wt % aqueous solution) | 20 g |
| Sodium laurylbenzenesulfonate (1 wt % aqueous solution) | 10 ml |
| Distilled water | 854 ml |

Prescription (3) (for Second Layer on the Back Surface Side)

| | |
|---|---|
| $SnO_2$/SbO (9/1 weight ratio, average particle size: 0.038 μm, 17 wt % dispersion) | 84 g |
| Gelatin (10% aqueous solution) | 89.2 g |
| Metrose TC-5 (2% aqueous solution, manufactured by Shin-Etsu Chemical Co., Ltd.) | 8.6 g |
| MP-1000 (polymer fine particles, manufactured by Soken Kagaku Co. Ltd.) | 0.01 g |
| Sodium dodecylbenzenesulfonate (1 wt % aqueous solution) | 10 ml |
| NaOH (1%) | 6 ml |
| Proxel (manufactured by ICI Co., Ltd.) | 1 ml |
| Distilled water | 805 ml |

Preparation of Undercoated Support

Both surfaces of the above-prepared biaxially stretched polyethylene terephthalate support having a film thickness of 175 μm were subjected to corona discharge treatment, then the above undercoating solution prescription 1 was coated on one side (image-forming layer surface) by means of a wire bar in a wet coating amount of 6.6 ml/m$^2$ (per one surface) and dried at 180° C. for 5 minutes. Subsequently, the above undercoating solution prescription 2 was coated on the back surface by means of a wire bar in a wet coating amount of 5.7 ml/m$^2$ and dried at 180° C. for 5 minutes, and further the above undercoating solution prescription 3 was coated on the back surface by means of a wire bar in a wet coating amount of 7.7 ml/m$^2$ and dried at 180° C. for 6 minutes. Thus, the undercoated support was prepared.

Preparation of Back Surface Coating Solution

Preparation of Solid Fine Particle Dispersion Solution (a) of Base Precursor

A base precursor compound 11 shown below (64 g) 28 g of diphenylsulfone, and 10 g of surfactant Demol N (manufactured by Kao Corporation) were mixed with 220 ml of distilled water. The mixed solution was dispersed using beads in a sand mill (¼ Gallon sand grinder mill, manufactured by Imex Co., Ltd.), thereby a solid fine particle dispersion solution (a) of the base precursor compound having an average particle size of 0.2 μm was obtained.

Preparation of Solid Fine Particle Dispersion Solution of Dye

Cyanine dye compound 13 shown below (9.6 g) and 5.8 g of sodium p-dodecylbenzenesulfonate were mixed with 305 ml of distilled water. The mixed solution was dispersed using beads in a sand mill (¼ Gallon sand grinder mill, manufactured by Imex Co., Ltd.), thereby a solid fine particle dispersion solution of the dye having an average particle size of 0.2 μm was obtained.

Preparation of Antihalation Layer Coating Solution

Gelatin (17 g), 9.6 g of polyacrylamide, 70 g of the above solid fine particle dispersion solution (a) of the base precursor, 56 g of the above solid fine particle dispersion solution of the dye, 1.5 g of polymethyl methacrylate fine particles (average particle size: 6.5 μm), 0.03 g of benzoylthiazolinone, 2.2 g of sodium polyethylenesulfonate, 0.2 g of a bluing dye compound 14 shown below, and 844 ml of water were mixed. Thus, an antihalation layer coating solution was prepared.

Preparation of Back Surface Protective Layer Coating Solution

To a reaction vessel maintained at 40° C. were added and mixed 50 g of gelatin, 0.2 g of sodium polystyrenesulfonate, 2.4 g of N,N'-ethylenebis(vinylsulfone acetamide), 1 g of sodium tert-octylphenoxyethoxyethanesulfonate, 30 mg of benzoisothiazolinone, 37 mg of N-perfluorooctylsulfonyl-N-propylalanine potassium salt, 0.15 g of polyethylene glycol mono(N-perfluorooctylsulfonyl-N-propyl-2-aminoethyl) ether (average polymerization degree of ethylene oxide: 15), 32 mg of $C_8F_{17}SO_3K$, 64 mg of $C_8F_{17}SO_2N(C_3H_7)(CH_2CH_2O)_4(CH_2)_4SO_3Na$, 8.8 g of acrylic acid/ethyl acrylate copolymer (copolymerization weight ratio: 5/95), 0.6 g of aerosol OT (manufactured by American Cyanamide Co.), 1.8 g of liquid paraffin emulsion product as a liquid paraffin, and 950 ml of water, thereby a back surface protective layer coating solution was prepared.

Preparation of Silver Halide Emulsion 1

To 1,421 ml of distilled water were added 3.1 ml of a 1 wt % potassium bromide solution, 3.5 ml of a sulfuric acid solution in concentration of 0.5 mol/liter, and 31.7 g of phthalated gelatin. This mixed solution was stirred in a titanium-coated stainless reaction vessel with maintaining the temperature at 34° C. Solution A (22.22 g of silver nitrate was diluted with distilled water to make the volume 95.4 ml) and solution B (15.9 g of potassium bromide was diluted with distilled water to make the volume 97.4 ml) were prepared. The entire amount of solution A and solution B was added to the reaction vessel at a constant flow rate over 45 seconds. Then, 10 ml of a 3.5 wt % hydrogen peroxide aqueous solution was added, further, 10.8 ml of a 10 wt % benzimidazole aqueous solution was added. Further, solution C (51.86 g of silver nitrate was diluted with distilled water to make the volume 317.5 ml), and solution D (45.8 g of potassium bromide was diluted with distilled water to make the volume 400 ml) were prepared. The entire amount of solution C was added to the reaction vessel at a constant flow rate over 20 minutes. Solution D was added by a controlled double jet method with maintaining pAg at 8.1. Ten minutes after the start of the addition of solution C and solution D, hexachloroiridate(III) potassium salt was added in an amount of $1\times10^{-4}$ mol per mol of the silver. Five seconds after the completion of the addition of solution C, an aqueous solution of potassium hexacyanoferrate(II) was added in an amount of $3\times10^{-4}$ mol per mol of the silver. pH was adjusted to 3.8 with a sulfuric acid in concentration of 0.5 mol/liter, and stirring was stopped. The reaction solution was subjected to precipitation, desalting and washing processes. pH was adjusted to 5.9 with sodium hydroxide in concentration of 1 mol/liter, thereby a silver halide dispersion having pAg of 8.0 was obtained.

The temperature of the above silver halide dispersion was maintained at 38° C. with stirring, then 5 ml of a 0.34 wt % methanol solution of 1,2-benzoisothiazolin-3-one was added, and 40 minute after, a methanol solution of spectral sensitizing dye A shown below was added in an amount of $1\times10^{-3}$ mol per mol of the silver, and 1 minute after, the temperature was raised to 47° C., 20 minutes after temperature up, a methanol solution of a sodium benzenethiosulfonate was added thereto in an amount of $7.6\times10^{-5}$ mol per mol of the silver, and further five minutes after, a methanol solution of tellurium sensitizer B shown below was added in an amount of $1.9\times10^{-4}$ mol per mol of the silver, and the reaction solution was subjected to ripening for 91 minutes. A methanol solution of a 0.8 wt % N,N'-dihydroxy-N"-diethylmelamine (1.3 ml) was added to the above reaction solution, and four minutes after then, a methanol solution of 5-methyl-2-mercaptobenzimidazole in an amount of $3.7\times10^{-3}$ mol per mol of the silver, and a methanol solution of 1-phenyl-2-heptyl-5-mercapto-1,3,4-triazole in an amount of $4.9\times10^{-3}$ mol per mol of the silver were further added, thus silver halide emulsion 1 was prepared.

The grains in the thus-prepared silver halide emulsion were pure silver bromide grains having an average equivalent-sphere diameter of 0.046 μm and a variation coefficient of equivalent-sphere diameter of 20%. The grain size was the average of 1,000 grains obtained by electron microscope. The {100} plane ratio of this grain obtained by the Kubelka-Munk method was 80%.

Preparation of Silver Halide Emulsion 2

Silver halide emulsion 2 was prepared in the same manner as in the preparation of silver halide emulsion 1 except that the temperature of the solution during grain formation of 34° C. was changed to 49° C., the addition time of solution C was changed to 30 minutes, and potassium hexacyanoferrate (II) was not used. The emulsion was subjected to precipitation, desalting, washing and dispersion in the same manner as in the preparation of silver halide emulsion 1. Spectral sensitization, chemical sensitization, and the addition of 5-methyl-2-mercaptobenzimidazole and 1-phenyl-2-heptyl-5-mercapto-1,3,4-triazole were performed in the same manner as in the preparation of silver halide emulsion 1 except for changing the addition amount of spectral sensitizing dye A to $7.5\times10^{-4}$ mol per mol of the silver, the addition amount of tellurium sensitizer B to $1.1\times10^{-4}$ mol per mol of the silver, and 1-phenyl-2-heptyl-5-mercapto-1,3,4-triazole to $3.3\times10^{-3}$ mol per mol of the silver, thus silver halide emulsion 2 was obtained. The grains in silver halide emulsion 2 were pure silver bromide cubic grains having an average equivalent-sphere diameter of 0.080 μm and a variation coefficient of equivalent-sphere diameter of 20%.

Preparation of Silver Halide Emulsion 3

Silver halide emulsion 3 was prepared in the same manner as in the preparation of silver halide emulsion 1 except that the temperature of the solution during grain formation of 34° C. was changed to 27° C. The emulsion was subjected to precipitation, desalting, washing and dispersion in the same manner as in the preparation of silver halide emulsion 1. Silver halide emulsion 3 was obtained in the same manner as in the preparation of silver halide emulsion 1 except for changing the addition amount of the solid dispersion of spectral sensitizing dye A (an aqueous solution of gelatin) to $6\times10^{-3}$ mol per mol of the silver and the addition amount of tellurium sensitizer B to $5.2\times10^{-4}$ mol per mol of the silver. The grains in silver halide emulsion 3 were pure silver bromide cubic grains having an average equivalent-sphere diameter of 0.038 μm and a variation coefficient of equivalent-sphere diameter of 20%.

Preparation of Mixed Emulsion A for Coating Solution

Silver halide emulsion 1 in an amount of 70 wt %, silver halide emulsion 2 in an amount of 15 wt % and silver halide emulsion 3 in an amount of 15 wt % were dissolved, and a 1 wt % aqueous solution of benzothiazolium iodide was added thereto in an amount of $7\times10^{-3}$ mol per mol of the silver.

Spectral Sensitizing Dye A

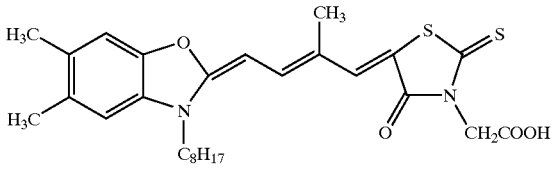

Tellurium Sensitizer B

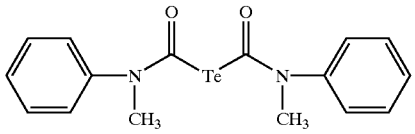

Base Precursor Compound 11

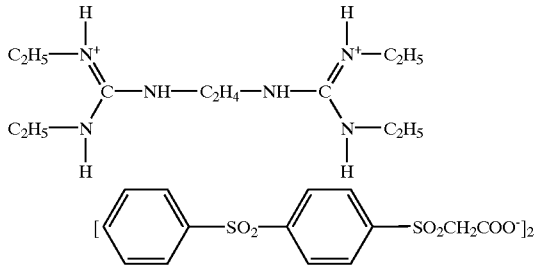

Cyanine Dye Compound 13

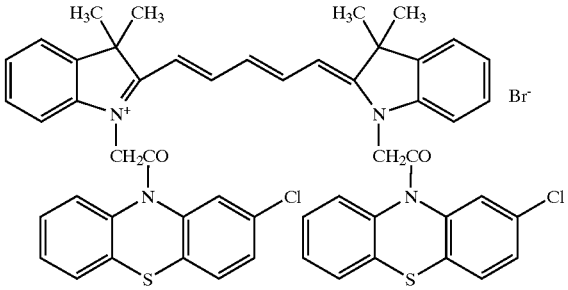

Bluing Dye Compound 14

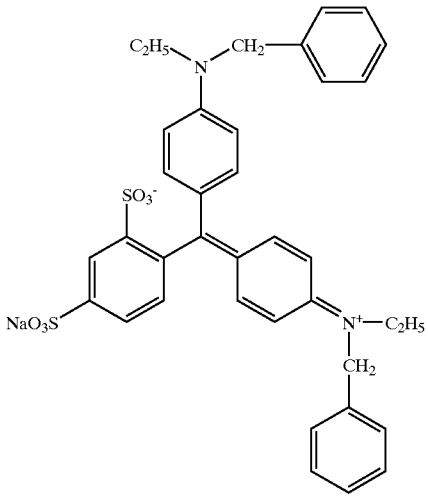

Preparation of Fatty Acid Silver Dispersions A to I (1) Preparation of Fatty Acid Alkali Metal Salt Solution Behenic acid (87.6 kg) (manufactured by Henkel Co., trade name: Edenor C22-85R), 423 liters of distilled water, 49.2 liters of an aqueous solution containing 5 mol/liter of NaOH, and 120 liters of tert-butanol were mixed, and the mixture was allowed to react for 1 hour at 75° C., thereby a sodium behenate solution was obtained.

(2) Preparation of Silver Ion Solution

An aqueous solution containing 40.4 kg of silver nitrate (pH 4.0) (206.2 liters) was prepared and maintained at 10° C.

(3) Preparation of Solution for Reaction Tank

A reaction vessel containing 635 liters of distilled water and 30 liters of tert-butanol was maintained at 30° C.

(4) Reaction

A fatty acid silver salt was prepared using the apparatus shown in FIG. 2. A fatty acid alkali metal salt solution prepared in (1) above and a silver ion solution prepared in (2) above were put in storage tanks 12 and 11 respectively and maintained at 75° C. and 10° C. respectively. A solution for reaction tank prepared in (3) above was put in formation tank 20 and circulated via pump 17 at flow rate of 250 liter/minute. The silver ion solution was introduced into closed mixing unit 18 via pump 15. The starting time of the introduction of the silver ion solution into closed mixing unit 18 was taken as a starting point (0 minute), and the silver ion solution was continued to be introduced at a constant flow rate (2.062 liters/min) for the time shown in Table 1 below. The thermal insulation of the piping of the addition system of the silver ion solution was performed by circulating chilled water around the outer pipe of the double pipe. The fatty acid alkali metal salt solution (total amount: 576 liters) was introduced into closed mixing unit 18 via pump 16 at a constant flow rate for the time and at the rate shown in Table 1. At this time, the rate shown in Table 1 of all the fatty acid alkali metal salt solution was introduced into the closed mixing unit. Of the introduced fatty acid alkali metal salt solution, the rate of the fatty acid alkali metal salt solution introduced into the closed mixing unit in higher concentration than the concentration of the silver ion solution is shown in Table 1. The piping of the addition system of the fatty acid alkali metal salt solution was heat insulated by double pipe, and the temperature of the insulating water in the piping was controlled so that the solution temperature at the outlet of the addition nozzle tip was maintained at 75° C.

While the silver ion solution was introduced into the closed mixing unit, the addition of the fatty acid alkali metal salt solution was stopped by switching three way valve 21, and further the fatty acid alkali metal salt solution was added to closed mixing unit 18 or formation tank 20 by switching three way valve 21 at the predetermined time shown in Table 1. The rate of the fatty acid alkali metal salt solution introduced into closed mixing unit 18 or formation tank 20 after the addition was reopened is shown in Table 1.

Figure 5:
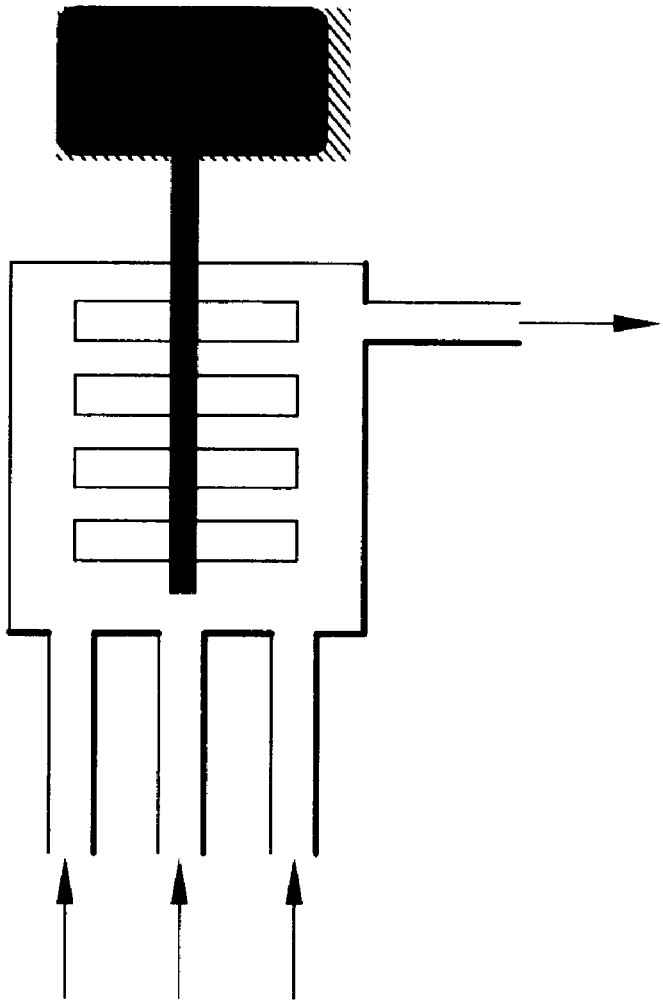
FIG. 5 is a schematic diagram of the closed mixing unit used in Example 1.

In the present invention, a small size crystallizer as shown in FIG. 5 (pipeline mixer model LR-I, manufactured by Mizuho Kogyo Co., Ltd.) was used as closed mixing unit 18. The fatty acid alkali metal salt solution and the silver ion solution were added to liquid level from the symmetrical positions with the mixing axis. The solutions were added from the height not touching the reaction solution. The solution mixed in closed mixing unit 18 was cooled by heat exchanger 19 and introduced into formation tank 20. Water of appropriate temperature was supplied to the jackets of heat exchanger 19 and formation tank 20 at a rate of 20 liters/minute and temperature was controlled so that the temperature of the formation tank was 30° C. Further, in formation tank 20, stirring was performed for smooth liquid flow with Pfaudler blades in a possible range of not causing a whirl of bubbles due to V cut.

The configuration of the fatty acid silver particles obtained was evaluated by an electron microscopic photographing. The results obtained are shown in Table 2 below.

Five minutes after the addition of the fatty acid alkali metal salt solution was terminated, the temperature of the reaction solution was raised to 35° C. over 30 minutes, and the reaction solution was stirred at the same temperature for 210 minutes and allowed to stand to lower the temperature to 25° C. to prepare an organic silver salt solution. The solid content was then filtered by suction. The solid content was washed with water until the conductivity of the filtrate reached 30 μS/cm. The thus-obtained solid content was not dried and stored as a wet cake.

Polyvinyl alcohol (trade name: PVA-217, average polymerization degree: about 1,700) (7.4 g) and water were added to the wet cake of the amount corresponding to 100 g of dried solid content to make the entire amount 385 g, and then the above product was preliminarily dispersed in a homomixer. The preliminarily dispersed starting solution was treated three times using a disperser (trade name: Micro-fluidizer M-610 equipped with Z type interaction chamber, manufactured by Micro Fluidex International Corp.). Pressure of the disperser was adjusted to 1,260 kg/cm$^2$. Thus, an organic acid silver dispersion was obtained. Cooling operation was performed by installing coiled heat exchangers respectively before and after the interaction chamber and setting the desired dispersion temperature by adjusting the temperature of the cooling medium.

The volume weighted average diameter, the average particle thickness, the variation coefficient of the volume weighted average diameter, and the ratio of the long side c to the short side b of the behenic acid silver particles contained in the thus-obtained organic silver dispersions A to I are shown in Table 2 below. The particle size was measured using Master Sizer X manufactured by Malvern Instruments Ltd.

Preparation of Fatty Acid Silver Dispersions J to M

Polyvinyl alcohol (trade name: PVA-217, average polymerization degree: about 1,700) (7.4 g) dissolved in 74 g of water was added to each of organic acid silver solutions prepared in the same manner as in the preparation of fatty acid silver dispersions A to D of the amount corresponding to 100 g of dried solid content, and then the solution was treated one time using the above Micro-fluidizer M-610, but the pressure was adjusted to 600 kg/cm$^2$. The solution was poured into an ultrafilter and desalted. The ultrafilter basically consists of a tank for storing the organic acid silver dispersion and a circulation pump for supplying the stored dispersion to an ultrafiltration module, and equipped with a flowmeter for measuring a replenishing pure water, a flowmeter for measuring a permeated water, and a pump for backward cleaning. The membrane module used was a hollow yarn type ACP-1050 manufactured by Asahi Kasei Corporation, a liquid flow rate was 18 liters/minute, and the pressure differential before and after the module was 1.0 kg/cm$^2$. The temperature of the processing solution was maintained at 17° C. or less during processing.

The replenishment of pure water was stopped when the electric conductivity lowered to 100 μS/cm, the solution was concentrated to 26 wt %, and then the solution was treated two times using the above Micro-fluidizer M-610 by adjusting the pressure to 1,750 kg/cm$^2$, thereby fatty acid silver dispersions H to K were obtained. The concentration of the solid content was measured with a digital specific gravity meter, model DA-300 manufactured by Kyoto Denshi-Sha Co., Ltd., and finally detected from the absolute dry weight. The volume weighted average diameter, the average particle thickness, the variation coefficient of the volume weighted average diameter, and the ratio of the long side c to the short side b of the particles contained in the thus-obtained behenic acid silver dispersions J to M are shown in Table 2 below. The particle size was measured using Master Sizer X manufactured by Malvern Instruments Ltd.

TABLE 1

| | Silver Ion Solution | Addition of Fatty Acid Alkali Metal Salt | | | | | |
|---|---|---|---|---|---|---|---|
| | | Addition to Closed Mixing Unit | | | Subsequent Addition | | |
| Organic Acid Silver Salt | Addition Time (min) | Addition Time (min) | Rate (%) | Rate of High Concentration Addition (%) | Addition Time (min) | Rate (%) | Place of Addition |
| A (Invention) | 0–100 | 1–79 | 90 | 85 | 130–139 | 10 | Formation tank |
| B (Invention) | 0–100 | 1–79 | 90 | 85 | 101–110 | 10 | Formation tank |
| C (Comparison) | 0–100 | 1–88 | 100 | 95 | | | |
| D (Comparison) | 0–100 | 1–79 | 90 | 95 | 91–100 | 10 | Formation tank |
| E (Invention) | 0–100 | 1–50 | 90 | 88 | 130–139 | 10 | Formation tank |
| F (Invention) | 0–100 | 1–80 | 92 | 87 | 130–132 | 2*2 | Formation tank |
| G (Invention) | 0–100 | 1–79 | 90 | 85 | 130–139 | 10 | Closed mixing unit |
| H (Comparison) | 0–100 | 1–90 | 88 | 35 | 130–132 | 2*2 | Formation tank |
| I (Comparison) | 0–100 | 1–58 | 65 | 62 | 130–160 | 35 | Formation tank |

*1"Rate of high concentration addition" means the rate of the fatty acid alkali metal salt solution introduced into the closed mixing unit in higher concentration than the concentration of the silver ion solution.

*2The procedure of the addition of 2% at a time for two minutes at a two minutes' interval was performed three times hereafter.

TABLE 2

| Organic Acid Silver Salt Dispersion | Volume Weighted Average: Kind of Organic Acid Silver Salt | Volume Weighted Average: Diameter (μm) | Average Particle Thickness (μm) | Variation Coefficient of Volume Weighted Average Diameter | Long Side c/ Short Side b |
|---|---|---|---|---|---|
| A (Invention) | A | 0.51 | 0.14 | 13 | 2.2 |
| B (Invention) | B | 0.51 | 0.14 | 13 | 2.2 |
| C (Comparison) | C | 0.52 | 0.14 | 13 | 2.2 |
| D (Comparison) | D | 0.52 | 0.14 | 13 | 2.2 |
| E (Invention) | E | 0.47 | 0.13 | 13 | 2.3 |
| F (Invention) | F | 0.52 | 0.14 | 13 | 2.2 |
| G (Invention) | G | 0.52 | 0.14 | 13 | 2.2 |
| H (Comparison) | H | 0.51 | 0.14 | 13 | 2.2 |
| I (Comparison) | I | 0.52 | 0.14 | 13 | 2.2 |
| J (Invention) | A | 0.51 | 0.14 | 13 | 2.2 |
| K (Invention) | B | 0.52 | 0.14 | 13 | 2.2 |
| L (Comparison) | C | 0.52 | 0.14 | 13 | 2.2 |
| M (Comparison) | D | 0.52 | 0.14 | 13 | 2.2 |

Preparation of 25 wt % Dispersion of Reducing Agent

Water (16 kg) was added to 10 kg of 1,1-bis(2-hydroxy-3,5-dimethylphenyl)-3,5,5-trimethylhexane and 10 kg of a 20 wt % aqueous solution of modified polyvinyl alcohol Poval MP203 (manufactured by Kuraray Co., Ltd.), and they were thoroughly mixed to make a slurry. The slurry was fed to a horizontal sand mill (UVM-2, manufactured by Imex Co., Ltd.) packed with zirconia beads having an average diameter of 0.5 mm by means of a diaphragm pump and dispersed for 3 hours and 30 minutes. Sodium salt of benzoisothiazolinone (0.2 g) and water were added to the above dispersion to make the concentration of the reducing agent 25 wt %, thereby the dispersion of the reducing agent was obtained. The particles of the reducing agent contained in the thus-obtained reducing agent dispersion had a median particle diameter of 0.42 μm and a maximum particle diameter of 2.0 μm or less. The obtained reducing agent dispersion was filtered through a polypropylene filter having a pore diameter of 10.0 μm to remove impurities such as dusts and stored.

Preparation of 25 wt % Dispersion of Reducing Agent Complex

Water (16 kg) was added to 10 kg of 1/1 complex of 2,2-methylene-bis(4-ethyl-6-tert-butylphenol) and triphenylphosphine oxide, and 10 kg of a 20 wt % aqueous solution of modified polyvinyl alcohol Poval MP203 (manufactured by Kuraray Co., Ltd.), and they were thoroughly mixed to make a slurry. The slurry was fed to a horizontal sand mill (UVM-2, manufactured by Imex Co., Ltd.) packed with zirconia beads having an average diameter of 0.5 mm by means of a diaphragm pump and dispersed for 3 hours and 30 minutes. Sodium salt of benzoisothiazolinone (0.2 g) and water were added to the above dispersion to make the concentration of the reducing agent 25 wt %, thereby the dispersion of the reducing agent was obtained. The particles of the reducing agent contained in the thus-obtained reducing agent dispersion had a median particle diameter of 0.46 μm and a maximum particle diameter of 2.0 μm or less. The obtained reducing agent dispersion was filtered through a polypropylene filter having a pore diameter of 10.0 μm to remove impurities such as dusts and stored.

Preparation of 10 wt % Dispersion of Mercapto Compound

Water (8.3 kg) was added to 5 kg of 1-phenyl-2-heptyl-5-mercapto-1,3,4-triazole and 5 kg of a 20 wt % aqueous solution of modified polyvinyl alcohol Poval MP203 (manufactured by Kuraray Co., Ltd.) and they were thoroughly mixed to make a slurry. The slurry was fed to a horizontal sand mill (UVM-2, manufactured by Imex Co., Ltd.) packed with zirconia beads having an average diameter of 0.5 mm by means of a diaphragm pump and dispersed for 6 hours. Water was added to the above dispersion to make the concentration of the mercapto compound 10 wt %, thereby the dispersion of the mercapto compound was obtained. The particles of the mercapto compound contained in the thus-obtained mercapto compound dispersion had a median particle diameter of 0.40 μm and a maximum particle diameter of 2.0 μm or less. The obtained mercapto compound dispersion was filtered through a polypropylene filter having a pore diameter of 10.0 μm to remove impurities such as dusts and stored. The dispersion was filtered again through a polypropylene filter having a pore diameter of 10 μm just before use.

Preparation of 20 wt % Organic Polyhalogen Compound Dispersion-1

Water (10 kg) was added to 5 kg of tribromomethylnaphthylsulfone, 2.5 kg of a 20 wt % aqueous solution of modified polyvinyl alcohol Poval MP203 (manufactured by Kuraray Co., Ltd.), and 213 g of a 20 wt % aqueous solution of sodium triisopropylnaphthalenesulfonate, and they were thoroughly mixed to make a slurry. The slurry was fed to a horizontal sand mill (UVM-2, manufactured by Imex Co., Ltd.) packed with zirconia beads having an average diameter of 0.5 mm by means of a diaphragm pump and dispersed for 5 hours. Sodium salt of benzoisothiazolinone (0.2 g) and water were added to the above dispersion to make the concentration of the organic polyhalogen compound 20 wt %, thereby the dispersion of the organic polyhalogen compound was obtained. The particles of the organic polyhalogen compound contained in the thus-obtained organic polyhalogen compound dispersion had a median particle diameter of 0.36 μm and a maximum particle diameter of 2.0 μm or less. The obtained organic polyhalogen compound dispersion was filtered through a polypropylene filter having a pore diameter of 3.0 μm to remove impurities such as dusts and stored.

Preparation of 25 wt % Organic Polyhalogen Compound Dispersion-2

In the preparation of 20 wt % organic polyhalogen compound dispersion-1, the procedure of dispersion was repeated in the same manner except for using 5 kg of tribromomethyl[4-(2,4,6-trimethylphenylsulfonyl)phenyl]-sulfone in place of 5 kg of tribromomethylnaphthylsulfone. The dispersion was diluted to 25 wt % of the organic polyhalogen compound and then filtered. The particles of the organic polyhalogen compound contained in the thus-obtained organic polyhalogen compound dispersion had a median particle diameter of 0.38 μm and a maximum particle diameter of 2.0 μm or less. The obtained organic polyhalogen compound dispersion was filtered through a polypropylene filter having a pore diameter of 3.0 μm to remove impurities such as dusts and stored.

Preparation of 26 wt % Organic Polyhalogen Compound Dispersion-3

In the preparation of 20 wt % organic polyhalogen compound dispersion-1, the procedure of dispersion was repeated in the same manner except for using 5 kg of tribromomethylphenylsulfone in place of 5 kg of tribromomethylnaphthylsulfone, and changing the amount of a 20 wt % aqueous solution of MP203 to 5 kg. The dispersion was diluted to 26 wt % of the organic polyhalogen compound and then filtered. The particles of the organic polyhalogen compound contained in the thus-obtained organic polyhalogen compound dispersion had a median particle diameter of 0.41 μm and a maximum particle diameter of 2.0 μm or less. The obtained organic polyhalogen compound dispersion was filtered through a polypropylene filter having a pore diameter of 3.0 μm to remove impurities such as dusts and stored. The dispersion was stored at 10° C. or less until use.

Preparation of 25 wt % Organic Polyhalogen Compound Dispersion-4

In the preparation of 20 wt % organic polyhalogen compound dispersion-1, the procedure of dispersion was repeated in the same manner except for using 5 kg of tribromomethyl-3-pentanoylaminophenylsulfone in place of 5 kg of tribromomethylnaphthylsulfone, and changing the amount of a 20 wt % aqueous solution of MP203 to 5 kg. The dispersion was diluted to 25 wt % of the organic polyhalogen compound and then filtered. The particles of the organic polyhalogen compound contained in the thus-obtained organic polyhalogen compound dispersion had a median particle diameter of 0.41 μm and a maximum particle diameter of 2.0 μm or less. The obtained organic polyhalogen compound dispersion was filtered through a polypropylene filter having a pore diameter of 3.0 μm to remove impurities such as dusts and stored.

Preparation of 5 wt % Solution of Phthalazine Compound

Modified polyvinyl alcohol MP203 (manufactured by Kuraray Co., Ltd.) (8 kg) was dissolved in 174.57 kg of water, then 3.15 kg of a 20 wt % aqueous solution of sodium triisopropylnaphthalene and 14.28 kg of a 70 wt % aqueous solution of 6-isopropylphthalazine were added, thereby a 5 wt % solution of 6-isopropylphthalazine was prepared.

Preparation of 20 wt % Dispersion of Pigment

Water (250 g) was added to 64 g of C.I. Pigment Blue 60 and 6.4 g of Demol N (manufactured by Kao Corporation), and they were thoroughly mixed to make a slurry. Zirconia beads (800 g) having an average diameter of 0.5 mm were added to a vessel with the above-obtained slurry and dispersed with a disperser (¼ G sand grinder mill, manufactured by Imex Co., Ltd.) for 25 hours, thereby the dispersion of the pigment was obtained. The particles of the pigment contained in the thus-obtained pigment dispersion had an average particle diameter of 0.21 μm.

Preparation of 40 wt % SBR Latex

SBR latex shown below was diluted with distilled water to 10 times, and purified by means of module FS03-FC-FUY03A1 for ultrafiltration purification (manufactured by Daisen Membrane System Co., Ltd.) until the ionic conductivity became 1.5 mS/cm, and Sandet BL (manufactured by Sanyo Chemical Industries Co., Ltd.) was added in 0.22 wt %. Further, NaOH and $NH_4OH$ were added so as to reach $Na^+$ ion/$NH_4^+$ ion of 1/2.3 (molar ratio), and pH was adjusted to 8.4. The concentration of the latex at this time was 40 wt %.

SBR Latex

Latex of -St(71)-Bu(26)-AA(3)-

Average particle size: 0.1 μm, concentration: 45%, equilibrium moisture content measured at 25° C. and 60% RH: 0.6 wt %, ionic conductivity: 4.2 mS/cm (ionic conductivity was measured using a conductometer CM-30S manufactured by Toa Denpa Kogyo Co., Ltd., and starting solution of the latex (40%) was measured at 25° C.), and pH: 8.2.

Preparation of Coating Solution for Image-forming Layer

The above-obtained 20 wt % water dispersion of pigment (1.1 g), 103 g of a 26 wt % of fatty acid silver dispersions A to M shown in Table 3, 5 g of a 20 wt % aqueous solution of modified polyvinyl alcohol PVA-205 (manufactured by Kuraray Co., Ltd.), 25 g of the above-prepared 25 wt % reducing agent dispersion, total weight of 16.3 g of the above-prepared organic polyhalogen compound dispersion-1, dispersion-2 and dispersion-3 in the ratio of 5/1/3 (weight ratio), 6.2 g of 10 wt % dispersion of mercapto compound, 40 wt % SBR latex purified by ultrafiltration to adjust pH in an amount shown in Table 3 below, and 18 ml of 5 wt % solution of phthalazine compound were mixed, and 10 g of the above-prepared silver halide mixed emulsion A was thoroughly mixed with the above reaction mixture, thus an image-forming layer (an emulsion layer, a photosensitive layer) coating solution was obtained. The obtained emulsion layer coating solution was fed to a coating die as it was in a coating amount of 70 ml/$m^2$ and coated.

The above image-forming layer coating solution was revealed to have viscosity of 85 (mPa·s) at 40° C. (No. 1 rotor) measured by Model B viscometer (manufactured by Tokyo Keiki Co., Ltd.).

The viscosity of the image-forming layer coating solution measured by RFS Fluid Spectrometer (manufactured by Rheometrics Far East Co.) at 25° C. was 1,500, 220, 70, 40, 20 (mPa·s) at shear rate of 0.1, 1, 10, 100, 1,000 (1/sec), respectively.

Preparation of Intermediate Layer Coating Solution of Emulsion Surface

To 772 g of a 10 wt % aqueous solution of polyvinyl alcohol PVA-205 (manufactured by Kurare Co., Ltd.), 5.3 g of a 20 wt % dispersion of pigment, and 226 g of a 27.5 wt % solution of latex of methyl methacrylate/styrene/butyl acrylate/hydroxyethyl methacrylate/acrylic acid copolymer (copolymerization weight ratio: 64/9/20/5/2) were added 2 ml of a 5 wt % aqueous solution of Aerosol OT (manufactured by American Cyanamide Co.), and 10.5 ml of a 20 wt % aqueous solution of phthalic acid diammonium salt. Water was added to make the total amount 880 g, thereby an intermediate layer coating solution was prepared, which was fed to a coating die in a coating amount of 10 ml/$m^2$.

The viscosity of the coating solution was 21 (mPa·s) at 40° C. (No. 1 rotor, 60 rpm) measured by Model B viscometer.

Preparation of First Emulsion Surface Protective Layer Coating Solution

Inert gelatin 64 g was dissolved in water, and 80 g of a 27.5 wt % latex solution of methyl methacrylate/styrene/butyl acrylate/hydroxyethyl methacrylate/acrylic acid copolymer (copolymerization ratio by weight: 64/9/20/5/2), 23 ml of a 10 wt % methanol solution of phthalic acid, 23 ml of a 10 wt % aqueous solution of 4-methylphthalic acid, 28 ml of a sulfuric acid of 0.5 mol/liter, 5 ml of a 5 wt % aqueous solution of Aerosol OT (manufactured by American Cyanamide Co.), 0.5 g of phenoxyethanol, and 0.1 g of benzoisothiazolinone were added thereto. Water was added to make the total amount 750 g, and this mixed solution was mixed with 26 ml of a 4 wt % of chrome alum just before coating, and the obtained coating solution was fed to a coating die in a coating amount of 18.6 ml/m$^2$.

The viscosity of the coating solution was 17 (mPa·s) at 40° C. (No. 1 rotor, 60 rpm) measured by Model B viscometer.

Preparation of Second Emulsion Surface Protective Layer Coating Solution

Inert gelatin 80 g was dissolved in water, and 102 g of a 7.5 wt % latex solution of methyl methacrylate/styrene/butyl acrylate/hydroxyethyl methacrylate/acrylic acid copolymer (copolymerization ratio by weight: 64/9/20/5/2), 3.2 ml of a 5 wt % aqueous solution of potassium salt of N-perfluorooctylsulfonyl-N-propylalanine, 32 ml of a 2 wt % aqueous solution of polyethylene glycol mono(N-perfluorooctylsulfonyl-N-propyl-2-aminoethyl) ether (average polymerization degree of ethylene oxide: 15), 23 ml of a 5 wt % aqueous solution of Aerosol OT (manufactured by American Cyanamide Co.), 4 g of polymethyl methacrylate fine particles (average particle size: 0.7 μm), 21 g of polymethyl methacrylate fine particles (average particle size: 6.4 μm), 1.6 g of 4-methylphthalic acid, 4.8 g of phthalic acid, 44 ml of sulfuric acid of 0.5 mol/liter, and 10 mg of benzoisothiazolinone were added thereto. Water was added to make the total amount 650 g, and this mixed solution was mixed with 445 ml of an aqueous solution containing a 4 wt % chrome alum and a 0.67 wt % phthalic acid by means of a static mixer just before coating, thereby a surface protective layer coating solution was obtained. The obtained coating solution was fed to a coating die in a coating amount of 8.3 ml/m$^2$.

The viscosity of the coating solution was 9 (mPa·s) at 40° C. (No. 1 rotor, 60 rpm) measured by Model B viscometer.

Preparation of Photothermographic Image-recording Material

On the back side surface of the above-prepared undercoated support, the antihalation layer coating solution and the back surface protective layer coating solution were simultaneously coated and dried in such a manner that the coating amount of the solid content of the solid fine particle dye of antihalation layer coating solution became 0.04 g/m$^2$ and the gelatin coating amount of the back surface protective layer coating solution became 1.7 g/m$^2$, thereby an antihalation backing layer was prepared.

The image-recording layer (the coating silver amount of the silver halide was 0.14 g/m$^2$), the intermediate layer, the first protective layer and the second protective layer were simultaneously multilayer-coated by slide bead coating on the opposite side of the backing layer side in this order from the undercoat surface, thereby photothermographic image-recording material samples A to Q were prepared.

Coating speed was 160 m/min. The distance between the tip of the coating die and the support was from 0.10 to 0.30 mm. The pressure in the pressure reducing chamber was set lower than atmospheric pressure by from 196 to 882 Pa. Ionic air was blown to the support before coating so as not to be charged with electricity.

In the subsequent chilling zone, air of dry-bulb temperature of from 10 to 20° C. was blown to cool the coating solution, each material sample was transported so as not to touch anything, and then dried by dry air of dry-bulb temperature of from 23 to 45° C. and wet-bulb temperature of from 15 to 21° C. on a helical floating type drying zone.

After drying, the sample was subjected to humidity conditioning at 25° C. and 40 to 60% RH. Subsequently, the film surface was heated to 70 to 90° C., and then cooled to 25° C.

The matting degree of the image-recording layer surface of the obtained photothermographic image-recording material was Bekk second of 550 seconds and the backing layer surface was 130 seconds. pH of the film surface of the image-forming layer was 6.0.

Evaluation of Cutting Quality

Each photothermographic image-recording material was cut using a cutter of a tool angle of 90° and a skew angle of 1° at a cutting speed of 30 m/minute. The cut surface was rubbed by hands and the cutting quality was evaluated whether the photothermographic image-recording material was separated or not. The results obtained are shown in Table 3.

○: Separation was not observed at all.

Δ: Separation was observed but did not peel off.

x: The material was separated and peeled off.

Evaluation of Wrought Product

Each of the prepared photothermographic image-recording material was cut into B4 sizes. 151 Sheets of the cut materials were piled with the image-forming surface facing one direction and packaged with a polypropylene inner package and an aluminum sheet outer package coated with polypropylene and the temperature in the package was 25° C. and the relative humidity in the package was 40%. Each sample was vibrated up and down and left and right respectively at vibration width of 1 cm and the frequency of 50 Hz for 10 minutes. Each material was then subjected to exposure and thermal development (about 120° C.) with Fuji Medical Dry Laser Imager FM-DPL (mounting 660 nm semiconductor laser having maximum output of 60 mW (IIIB)) so as to reach D=1.2, and the degree of a blank area hindrance was evaluated. The results obtained are shown in Table 3.

○: Blank area was not observed.

Δ: Blank area was observed but not became a diagnostic problem.

x: Blank area was observed and became a diagnostic problem.

Evaluation of Photographic Properties

Each of the prepared photothermographic image-recording material was cut into B4 sizes. 151 Sheets of the cut materials were piled with the image-forming surface facing one direction and packaged with a polypropylene inner package and an aluminum sheet outer package coated with polypropylene and the temperature in the package was 25° C. and the relative humidity in the package was 40%. Each material was then subjected to thermal development at about 120° C. with Fuji Medical Dry Laser Imager FM-DPL (mounting 660 nm semiconductor laser having maximum output of 60 mW (IIIB)), and the optical density at unexposed area was measured by a densitometer to determine Dmin. Dmin was expressed as a relative value with the density of photothermographic image-recording material A as 100.

TABLE 3

| Photothermographic Image-Recording Material | Kind of Organic Silver Salt Dispersion | Use Amount of Latex (g) | Weight of Latex/Weight of Fatty Acid Silver | Cutting Quality | Eval. of Wrought Product | Dmin |
|---|---|---|---|---|---|---|
| A (Invention) | A | 106 | 1.8 | ○ | ○ | 100 |
| B (Invention) | B | 106 | 1.8 | ○ | ○ | 100 |
| C (Comparison) | C | 106 | 1.8 | x | x | 100 |
| D (Comparison) | D | 106 | 1.8 | x | Δ | 100 |
| E (Invention) | E | 106 | 1.8 | ○ | ○ | 100 |
| F (Invention) | F | 106 | 1.8 | ○ | ○ | 100 |
| G (Invention) | G | 106 | 1.8 | ○ | ○ | 100 |
| H (Comparison) | H | 106 | 1.8 | Δ | Δ | 100 |
| I (Comparison) | I | 106 | 1.8 | Δ | Δ | 100 |
| J (Invention) | J | 106 | 1.8 | ○ | ○ | 100 |
| K (Invention) | K | 106 | 1.8 | ○ | ○ | 100 |
| L (Comparison) | L | 106 | 1.8 | x | x | 100 |
| M (Comparison) | M | 106 | 1.8 | x | Δ | 100 |
| N (Comparison) | J | 47 | 0.8 | x | x | 92 |
| O (Invention) | J | 71 | 1.2 | Δ | ○ | 96 |
| P (Invention) | J | 141 | 2.4 | ○ | ○ | 100 |
| Q (Comparison) | J | 177 | 3 | Δ | Δ | 122 |

EXAMPLE 2

Preparation of Photothermographic Materials 2A to 2Q

Photothermographic materials 2A to 2Q were prepared in the same manner as in the preparation of photothermographic materials A to Q except that the coating solution for the image-recording layer was changed as shown below.

Preparation of Coating Solution for Image-forming Layer

The above-obtained 20 wt % water dispersion of pigment (1.1 g), 103 g of a 26 wt % of fatty acid silver dispersions A to M shown in Table 3, 5 g of a 20 wt % aqueous solution of modified polyvinyl alcohol PVA-205 (manufactured by Kuraray Co., Ltd.), 26 g of the above-prepared 25 wt % reducing agent complex dispersion, 8.2 g of the above-prepared organic polyhalogen compound dispersion-3 and dispersion-4 in the ratio of 1/3, 6.2 g of 10 wt % dispersion of mercapto compound, 40 wt % SBR latex (Tg: 23° C.) purified by ultrafiltration to adjust pH in an amount shown in Table 3, and 18 ml of 5 wt % solution of phthalazine compound were mixed, and 10 g of the above-prepared silver halide mixed emulsion A was thoroughly mixed with the above reaction mixture just before coating, thus an image-forming layer (an emulsion layer, a photosensitive layer) coating solution was obtained. The obtained emulsion layer coating solution was fed to a coating die as it was in a coating amount of 70 ml/$m^2$ and coated.

Evaluation

The thus-prepared photothermographic material samples 2A to 2Q were evaluated in the same manner as in Example 1. The same results as in Example 1 were obtained.

The photothermographic image-recording material using the fatty acid silver prepared according to the producing method of the present invention is excellent in film-forming property, therefore, cutting property is good and also excellent in resistance to blank area hindrance. Fog is hardly generated and good photographic properties can be achieved.

While the invention has been described in detail and with reference to specific embodiments thereof, it will be apparent to one skilled in the art that various changes and modifications can be made therein without departing from the spirit and scope thereof.

What is claimed is:

1. A producing method of a fatty acid silver salt which comprises adding (1) a solution of silver ions comprising water or a mixed solution of an organic solvent and water containing therein silver ions, and (2) a solution of a fatty acid alkali metal salt which is a solution or a suspension comprising water, an organic solvent, or a mixed solution of water and an organic solvent, containing therein an alkali metal salt of a fatty acid to a closed mixing means to react the solution (1) and the solution (2), wherein from 50 to 99.5 mol % of the entire fatty acid alkali metal salt solution is added to the closed mixing means under such a condition that the concentration of the fatty acid alkali metal salt is higher than the silver ion concentration, and from 0.5 to 30 mol % of the entire fatty acid alkali metal salt solution is added to the closed mixing means or to the downstream of the closed mixing means after the silver ion solution has been added to the closed mixing means.

2. The producing method of a fatty acid silver salt as claimed in claim 1, wherein from 0.5 to 30 mol % of the entire fatty acid alkali metal salt solution is added to a formation tank equipped downstream from the closed mixing means after the silver ion solution has been added to the closed mixing means.

3. The producing method of claim 1, wherein said salt of the alkali metal of the fatty acid is selected from the group consisting of a Na salt, a K salt and a Li salt.

4. The producing method of claim 1, wherein said fatty acid is a long chain aliphatic carboxylic acid having 10 to 30 carbon atoms.

5. The producing method of claim 1, wherein said fatty acid is selected from the group consisting of cerotic acid, lignoceric acid, behenic acid, erucic acid, arachidic acid, stearic acid, oleic acid, lauric acid, caproic acid, myristic acid, palmitic acid, maleic acid, fumaric acid, tartaric acid, linoleic acid, butyric acid, camphoric acid and mixtures of any of said acids.

6. The producing method of claim 1, wherein said organic solvent of solution (1) or solution (2) is a tertiary alcohol having 4 to 6 carbon atoms.

7. The producing method of claim 1, wherein 70 to 95 mol % of said entire fatty acid alkali metal salt solution is added to the closed mixing means.

8. The producing method of claim 2, wherein 3 to 20 mol % of the entire fatty acid alkali metal salt solution is added to the formation tank equipped downstream from the closed mixing means after the silver ion solution has been added to the closed mixing means.

9. The producing method of claim 1, wherein said solution (1) or solution (2) further comprises an auxiliary dispersant.

10. The producing method of claim 1, wherein said closed mixing means is a bulk stirrer, an emulsifying and dispersing unit, or a stationary mixer.

11. A photothermographic image-recording material comprising a support having provided thereon a reducing agent, a binder and a fatty acid silver salt as a photoinsensitive organic silver salt, wherein the fatty acid silver salt is produced by a producing method, said producing method comprising:

adding (1) a solution of silver ions comprising water or a mixed solution of an organic solvent and water containing therein silver ions, and (2) a solution of a fatty acid alkali metal salt which is a solution or a suspension comprising water, an organic solvent, or a mixed solution of water and an organic solvent, containing therein an alkali metal salt of a fatty acid to a closed mixing means to react the solution (1) and the solution (2), wherein from 50 to 99.5 mol % of the entire fatty acid alkali metal salt solution is added to the closed mixing means under such a condition that the concentration of the fatty acid alkali metal salt is higher than the silver ion concentration, and from 0.5 to 30 mol % of the entire fatty acid alkali metal salt solution is added to the closed mixing means or downstream of the closed mixing means after the silver ion solution has been added to the closed mixing means;

said photothermographic image-recording material further contains a photosensitive silver halide on a support; and the ratio of the aqueous latex solid content weight to the fatty acid silver weight in the layer containing the fatty acid silver salt is from 1.0 to 2.5.

12. The photothermographic image-recording material as claimed in claim 11, wherein from 0.5 to 30 mol % of the entire fatty acid alkali metal salt solution is added to a formation tank equipped downstream from the closed mixing means after the silver ion solution has been added to the closed mixing means.

13. The photothermographic image-recording material of claim 11, wherein said fatty acid silver salt is a scaly fatty acid silver salt.

14. The photothermographic image-recording material of claim 11, wherein said salt of the alkali metal of the fatty acid is selected from the group consisting of a Na salt, a K salt and a Li salt.

15. The photothermographic image-recording material of claim 11, wherein said fatty acid is a long chain aliphatic carboxylic acid having 10 to 30 carbon atoms.

16. The photothermographic image-recording material of claim 11, wherein said fatty acid is selected from the group consisting of cerotic acid, lignoceric acid, behenic acid, erucic acid, arachidic acid, stearic acid, oleic acid, lauric acid, caproic acid, myristic acid, palmitic acid, maleic acid, fumaric acid, tartaric acid, linoleic acid, butyric acid, camphoric acid and mixtures of any of said acids.

17. The photothermographic image-recording material of claim 11, wherein 70 to 95 mol % of said entire fatty acid alkali metal salt solution is added to the closed mixing means.

18. The photothermographic image-recording material of claim 11, wherein said solution (1) or solution (2) further comprises an auxiliary dispersant.

19. The photothermographic image-recording material of claim 12, wherein 3 to 20 mol % of the entire fatty acid alkali metal salt solution is added to the formation tank equipped downstream from the closed mixing means after the silver ion solution has been added to the closed mixing means.

20. The photothermographic image-recording material of claim 11, wherein said photothermographic image-recording material comprises 0.1 to 5 $g/m^2$ of said fatty acid silver salt.

* * * * *